US008050586B2

(12) United States Patent
Hoshino et al.

(10) Patent No.: US 8,050,586 B2
(45) Date of Patent: Nov. 1, 2011

(54) IMAGE FORMING APPARATUS AND DISPLAY UNIT OF AN IMAGE FORMING APPARATUS

(75) Inventors: Naoki Hoshino, Ageo (JP); Yuko Kimoto, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/472,151

(22) Filed: May 26, 2009

(65) Prior Publication Data

US 2009/0257772 A1 Oct. 15, 2009

Related U.S. Application Data

(63) Continuation of application No. 11/373,645, filed on Mar. 9, 2006, now Pat. No. 7,539,433.

(51) Int. Cl.
*G03G 15/00* (2006.01)

(52) U.S. Cl. ..... 399/81; 399/82; 399/410

(58) Field of Classification Search ..... 399/81, 399/410, 82

See application file for complete search history.

(56) References Cited

U.S. PATENT DOCUMENTS

| | | | | |
|---|---|---|---|---|
| 6,091,929 | A * | 7/2000 | Yamazaki et al. | 399/410 |
| 6,144,818 | A * | 11/2000 | Ohtani | 399/81 |
| 6,285,842 | B1 | 9/2001 | Katamoto | |
| 6,356,719 | B1 * | 3/2002 | Yoshiura | 399/45 |
| 6,430,389 | B1 * | 8/2002 | Kimura | 399/410 |
| 6,697,091 | B1 * | 2/2004 | Rzepkowski et al. | 715/835 |
| 7,512,354 | B2 | 3/2009 | Hoshino | |
| 7,532,837 | B2 | 5/2009 | Kimoto | |
| 7,546,055 | B2 | 6/2009 | Hoshino | |
| 2004/0169881 | A1 * | 9/2004 | Sato | 358/1.15 |
| 2004/0174552 | A1 * | 9/2004 | Miyake et al. | 358/1.12 |
| 2007/0211262 | A1 | 9/2007 | Kimoto | |
| 2007/0211263 | A1 | 9/2007 | Hoshino | |
| 2007/0211264 | A1 | 9/2007 | Hoshino | |
| 2007/0212100 | A1 | 9/2007 | Kimoto | |

* cited by examiner

*Primary Examiner* — David Porta
*Assistant Examiner* — Bryan Ready
(74) *Attorney, Agent, or Firm* — SoCal IP Law Group LLP; Steven C. Sereboff; John E. Gunther

(57) ABSTRACT

In a case where a display unit displays a setting screen having a first display area to display a draft graphical image in accordance with draft setting and a second display area to display a finished graphical image in accordance with sheet setting, and a user designates a position to be stapled, a staple region mark is superimposed and displayed on a region corresponding to the position to be stapled in the draft graphical image in accordance with the draft setting, and a staple position mark is superimposed and displayed on a position corresponding to the position to be stapled in the finished graphical image in accordance with the sheet setting.

20 Claims, 25 Drawing Sheets

IMAGE FORMING APPARATUS AND DISPLAY UNIT OF AN IMAGE FORMING APPARATUS

RELATED APPLICATION INFORMATION

This patent claims priority from the following prior-filed copending non-provisional patent application: U.S. patent application Ser. No. 11/373,645 filed Mar. 9, 2006, now U.S. Pat. No. 7,539,433, the entire disclosure of which is incorporated by reference in its entirety.

BACKGROUND OF THE INVENTION

1. Field of the Invention

The present invention relates to an operation device for a user to set photocopy processing, and an image forming apparatus which performs photocopy processing based on user's designated setting of the photocopy processing.

2. Description of the Related Art

Heretofore, an image forming apparatus such as a photocopier is provided with an operation panel to perform various settings. However, in the conventional operation panel, an operation for setting predetermined photocopy processing is complicated or is not easy to understand. Therefore, in the image forming apparatus provided with the operation panel, it is difficult to set the desired photocopy processing, and a result of the photocopy processing becomes different from that intended by a user in many cases. There is an example of an image forming apparatus such as a photocopier having a function of stapling together sheets on which draft images have been printed.

In such stapling function of the image forming apparatus, the user sets a position to be stapled by use of the operation panel in many cases. However, in the operation panel of the conventional image forming apparatus, it is difficult for the user to securely confirm the position to be stapled during the setting of the position to be stapled. Therefore, in the conventional image forming apparatus, the position to be stapled often becomes different from that intended by the user.

BRIEF SUMMARY OF THE INVENTION

In an aspect of the present invention, an object is to provide an operation device and an image forming apparatus in which operability in setting photocopy processing has been improved.

The image forming apparatus of the aspect of the present invention performs photocopy processing, and has: a scanner which reads an image of a draft; a printer which prints the image on an image forming medium; a stapler which staples together the image forming mediums on which the images have been formed by the printer; a display unit which displays a setting screen having a first display area and a second display area; an operation unit which inputs setting information; a setting unit which sets the photocopy processing in accordance with contents input by the operation unit; a first display control unit which displays, in the first display area, a graphical image of the draft in accordance with set contents every time the setting unit changes the set contents concerning the draft of the photocopy processing; a second display control unit which displays, in the second display area, a finished graphical image in accordance with the set contents every time the setting unit changes the set contents concerning the image forming medium of the photocopy processing; a third display control unit which displays marks indicating positions to be stapled in the draft graphical image and the finished graphical image, respectively, in a case where the setting unit sets the positions to be stapled by the stapler; and a control unit which reads the image of the draft by the scanner, prints the image read by the scanner on the image forming medium by the printer, and staples together, by the stapler, the image forming mediums on which the images read by the scanner have been printed by the printer, based on the contents set by the setting unit.

In another aspect of the present invention, a method of setting an image forming apparatus is a method of setting an image forming apparatus having a display device, an operation device, a scanner, a printer, and a stapler, the method comprising: displaying, in the display device, an operation screen having a first display area and a second display area; setting photocopy processing in accordance with contents input by the operation device; displaying, in the first display area, a graphical image of a draft in accordance with set contents every time the set contents concerning the draft of the photocopy processing are changed; displaying, in the second display area, a finished graphical image in accordance with the set contents every time the set contents concerning an image forming medium of the photocopy processing are changed; and displaying marks indicating positions to be stapled in the draft graphical image and the finished graphical image, respectively, in a case where the positions to be stapled by the stapler are set with respect to the image forming medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will be described hereinafter with reference to the drawings.

Figure 1:
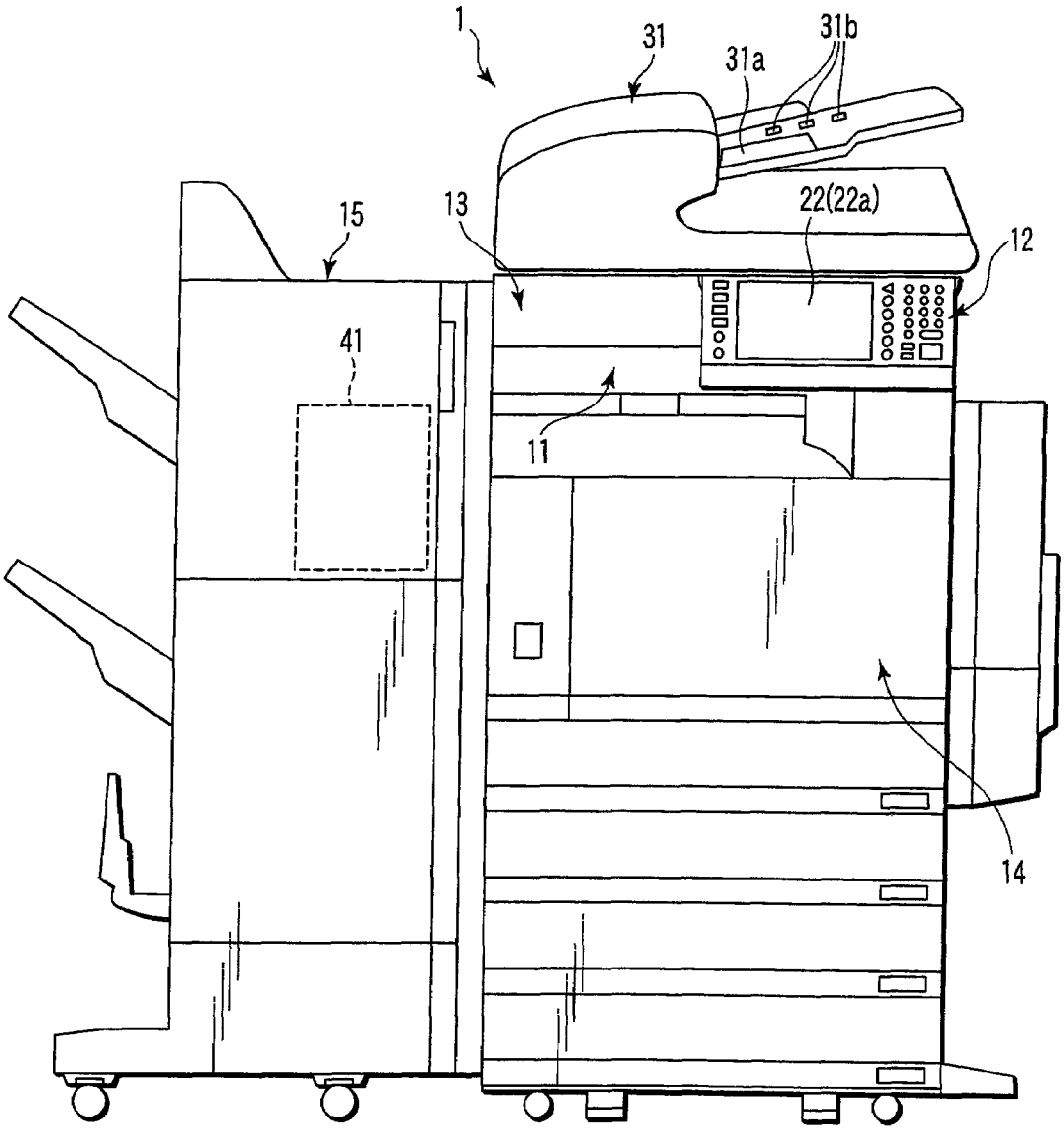
FIG. 1 is a diagram showing an appearance constitution of a digital multifunction peripherals 1 as an image forming apparatus in an embodiment of the present invention.

FIG. 1 is a diagram showing an appearance constitution of a digital multifunction peripherals 1 as an image forming apparatus in the embodiment of the present invention.

As shown in FIG. 1, this digital multifunction peripherals 1 is constituted of a system control unit 11, an operation panel 12, a scanner unit 13, a printer unit 14, a finisher unit 15 and the like.

The system control unit 11 controls the whole digital multifunction peripherals 1. The system control unit 11 is disposed in a main body of the digital multifunction peripherals 1. The system control unit 11 is connected to the operation panel 12, the scanner unit 13, the printer unit 14, the finisher unit 15 and the like. Accordingly, the system control unit 11 performs various controls with respect to the respective units.

The operation panel 12 is disposed on a front surface of the digital multifunction peripherals main body. The operation panel 12 is a user interface. An operation surface of the operation panel 12 is provided with hardware keys 21 as an operating section, a display section 22 in which a touch panel 22*a* is built and the like.

The scanner unit 13 functions as an image reading unit which reads an image of a draft. The scanner unit 13 is disposed in an upper part of the digital multifunction peripherals main body. The scanner unit 13 main body is constituted of: a scanning section (not shown) which optically scans a draft surface; a photoelectric converting section (not shown) such as a CCD line sensor which converts, into an electric signal, light reflected by the draft surface optically scanned by the scanning section and the like.

Moreover, the scanner unit 13 has an auto document feeder (ADF) 31. The ADF 31 conveys the surface of the draft to be read to an image reading position of the scanner unit 13 main body. That is, the image of the draft conveyed by the ADF 31 is read by the scanner unit 13 main body. The ADF 31 has: a draft table on which the draft is to be set; a conveying mechanism which conveys the drafts set on the draft table one by one; and a draft discharge section to which the draft conveyed by the conveying mechanism is discharged. The draft table of the ADF 31 is provided with a guide section 31*a* which guides the conveyed drafts and a plurality of sensors 31*b* for detecting a size of the draft. The guide section 31*a* and each sensor 31*b* function as a detector for detecting the size of the draft on the draft table.

The printer unit 14 forms an image on a sheet (photocopy sheet) as an image forming medium. The printer unit 14 is constituted of, for example, a conveying section which conveys the sheet, an image forming section which forms an image on the sheet conveyed by the conveying section and the like.

The finisher unit 15 performs various types of finish processing with respect to the sheet as the image forming medium printed by the printer unit 14. The finisher unit 15 has finishing functions such as: a stapling function of stapling together a plurality of sheets printed by the printer unit 14; a sorting function of sorting the sheets printed by the printer unit 14 based on a set sorting method; and a stacking function of discharging the sheet printed by the printer unit 14 based on a set sheet discharging order or a set sheet discharging method. The finisher unit 15 has finishing functions realized by a control similar to that of the stapling function, such as: a hole punching function of making a hole in a predetermined position in the sheet printed by the printer unit 14; and a saddle stitching function of folding back a plurality of sheets printed by the printer unit 14 along the center line of each sheet to staple together the sheets.

The finisher unit 15 has a stapler 41 or the like as a mechanism for performing the stapling function. For example, the stapler 41 staples together the plurality of sheets sorted by the sorting function. The stapler 41 has a function of stapling together the sheets by multi-positions thereof. Therefore, the stapling function staples together the positions to be stapled, selected by the user, with respect to the plurality of sheets sorted by the sorting function.

Figure 2:
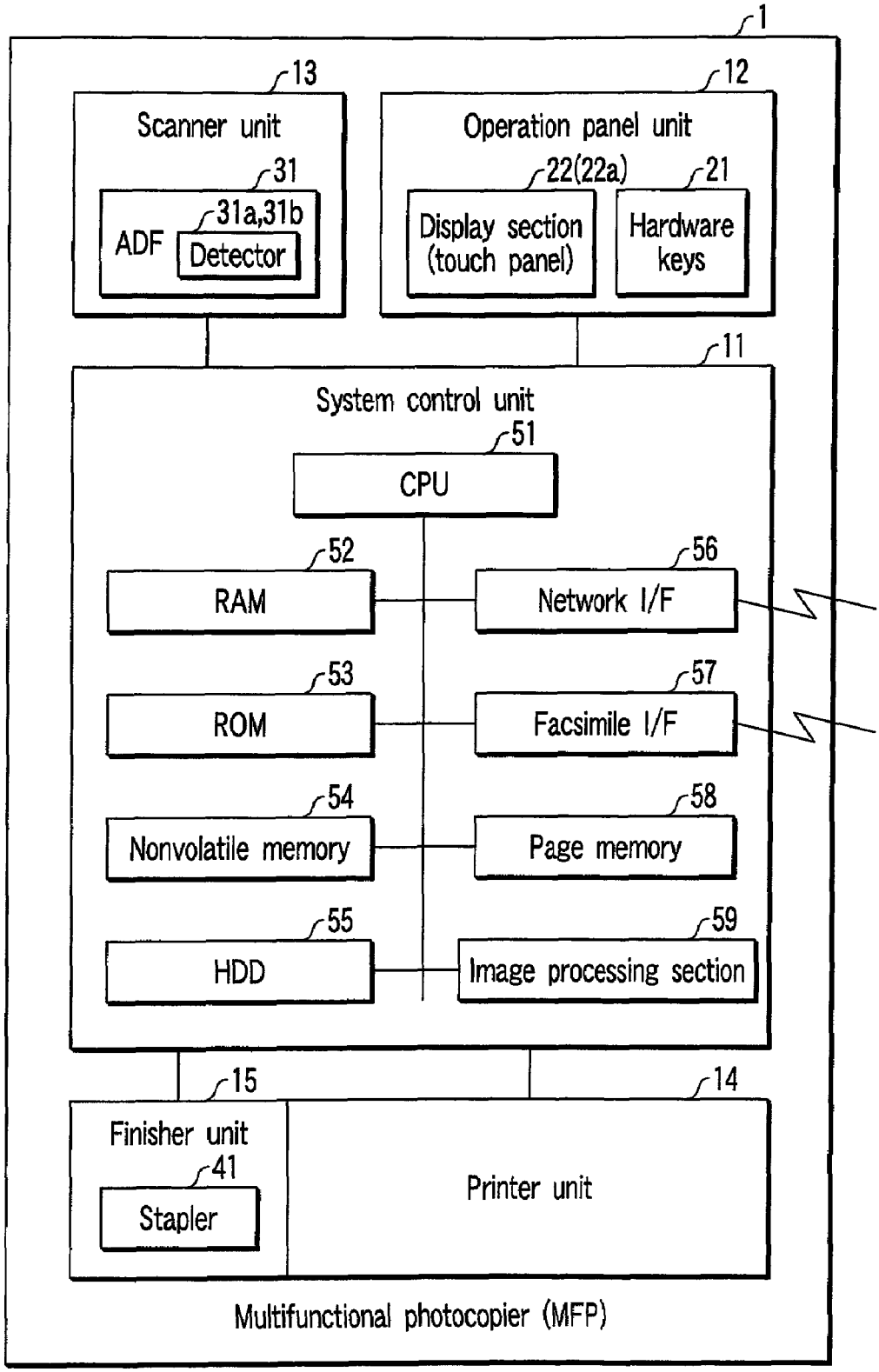
FIG. 2 is a block diagram showing a constitution of a control system of the digital multifunction peripherals 1 as the image forming apparatus in the embodiment of the present invention.

FIG. 2 is a block diagram showing a constitution of a control system of the digital multifunction peripherals 1 as an image forming apparatus in the embodiment of the present invention.

As shown in FIG. 2, in this digital multifunction peripherals 1, the system control unit 11 is connected to the operation panel 12, the scanner unit 13, the printer unit 14, and the finisher unit 15.

The system control unit 11 controls the operation panel 12, the scanner unit 13, the printer unit 14, the finisher unit 15 and the like. The system control unit 11 has various functions of performing various types of processing based on signals supplied from the operation panel 12, the scanner unit 13, the printer unit 14 and the finisher unit 15.

The operation panel 12 has the hardware keys 21, the display section 22 in which the touch panel 22*a* is built and the like. In the display section 22, there are displayed an operation guidance, keys (icons) selectable by the touch panel 22*a* and the like under a display control of the system control unit 11. In the operation panel 12, the user operates the hardware keys 21, or inputs the icon selectable by the touch panel 22*a*. The operation panel 12 supplies, to the system control unit 11, information input by the user (the information indicating the hardware key 21 pressed by the user or the icon selectable by the touch panel 22*a* touched by the user).

The scanner unit 13 converts the image of the draft into image data under the control of the system control unit 11. The scanner unit 13 converts the draft image into color or monochromatic digital image data. The scanner unit 13 supplies the digital image data as the read draft image to the system control unit 11.

Moreover, the scanner unit 13 has the ADF 31 provided with the detectors 31*a*, 31*b*. Detection signals of the detectors 31*a*, 31*b* of the ADF 31 are supplied to the system control unit 11. The system control unit 11 realizes an ADF draft size detecting function of detecting a size of the draft set in the ADF 31 based on the detection signals of the detectors 31*a*, 31*b*.

The printer unit 14 prints the image on the sheet as the image forming medium under the control of the system control unit 11. A result of the print processing performed by the printer unit 14 and the like are notified to the system control unit 11. The printer unit 14 performs color printing to form a color image on the image forming medium based on the color image data, or monochromatic printing to form a monochromatic image on the image forming medium based on the monochromatic image data. The printer unit 14 is constituted of: for example, the conveying section (not shown) which conveys the image forming medium; the image forming section (not shown) which forms the color image or the monochromatic image on the image forming medium conveyed by the conveying section and the like.

The finisher unit 15 performs various types of processing with respect to the sheet as the image forming medium printed by the printer unit 14 under the control of the system control unit 11. The processing result and the like of the finisher unit 15 are notified to the system control unit 11. The finisher unit 15 executes a finishing function such as the stapling function, the sorting function, or the stacking function based on the control by the system control unit 11.

Moreover, as shown in FIG. 1, the system control unit 11 is constituted of: a central processing unit (CPU) 51; a random access memory (RAM) 52; a read only memory (ROM) 53; a nonvolatile memory 54; a hard disk drive (HDD) 55; a network interface (I/F) 56; a facsimile interface (I/F) 57; a page memory 58; an image processing section 59 and the like.

The CPU 51 controls the whole system control unit 11. The CPU 51 executes a program stored in the ROM 53, the nonvolatile memory 54 or the HDD 55 to thereby perform various types of processing. For example, the CPU 51 executes the control program to thereby realize the ADF draft size detecting function. A display control of the display section 22 of the operation panel 12 is executed by the CPU 51 based on the program and control data stored in the ROM 53, the nonvolatile memory 54, or the HDD 55.

The RAM 52 is a memory which temporarily stores data for working or which stores data to be referred to. The RAM 52 is used as a main memory for executing various types of processing based on various control programs. In the RAM 52, there is held information indicating various set contents during an operation of the digital multifunction peripherals. For example, the information indicating the set contents of the photocopy processing is also held by the RAM 52.

It is to be noted that the set contents of the photocopy processing include set particulars such as a photocopy magnification, the number of sheets to be photocopied and a finishing mode (position to be stapled, etc.) in addition to a draft setting and a sheet setting. The draft setting includes a size of a draft, a draft setting direction, a direction of the image in the draft, the surface of the draft to be read (a draft reading mode is single-sided or double-sided) and the like. The sheet setting includes a size of the sheet, a direction of the sheet, a direction of the image in the sheet, the surface of the sheet to be printed (a sheet printing mode is single-sided or double-sided) and the like.

The ROM 53 is a nonvolatile memory. In the ROM 53, there are stored, for example, a control program, control data and the like for controlling the digital multifunction peripherals 1. In the ROM 53, there may be stored display data and the like to be displayed in the display section 22 of the operation panel 12.

The nonvolatile memory 54 is a rewritable nonvolatile memory. In the nonvolatile memory 54, there is stored data such as system setting information. The nonvolatile memory 54 may store display data and the like to be displayed in the display section 22 of the operation panel 12.

The HDD 55 is a large-capacity storage device. In the HDD 55, there are stored various data such as various setting data, management data, control program and control data. In the HDD 55, there are also stored display data and the like to be displayed in the display section 22 of the operation panel 12. In the HDD 55, there are also stored image data and the like read by the scanner unit 13. Furthermore, the HDD 55 may be used as a backup memory for various memories.

The network interface 56 performs data communication via the network. The network interface 56 is constituted of, for example, a network interface card (NIC) and the like. The digital multifunction peripherals 1 realizes a network printing function of printing, on the sheet, print data from an external device connected to the network interface 56 via the network.

The facsimile interface 57 transmits and receives facsimile data. In the digital multifunction peripherals 1, a facsimile function is realized using the facsimile interface 57. For example, facsimile reception processing is realized by monochromatically printing, by the printer unit 14, the facsimile data received by the facsimile interface 57. Moreover, the facsimile interface 57 realizes facsimile transmission processing by transferring, to a destination, the facsimile data converted from the image data of the draft read by the scanner unit 13.

The page memory 58 is a memory in which the image data to be printed by the printer unit 14 and the like are stored. The page memory 58 is controlled by a page memory controller (not shown). For example, in a case where the printer unit 14 performs the print processing, in the page memory 58 there is developed (stored) the color image data or the monochromatic image data of each page to be printed by the printer unit 14.

The image processing section 59 subjects the image data to various types of image processing. The image processing section 59 is constituted of an image processing circuit and the like. The image processing section 59 performs image processing such as correction, compression, or extension of the image data.

Next, there will be described a constitution of the operation panel 12.

Figure 3:
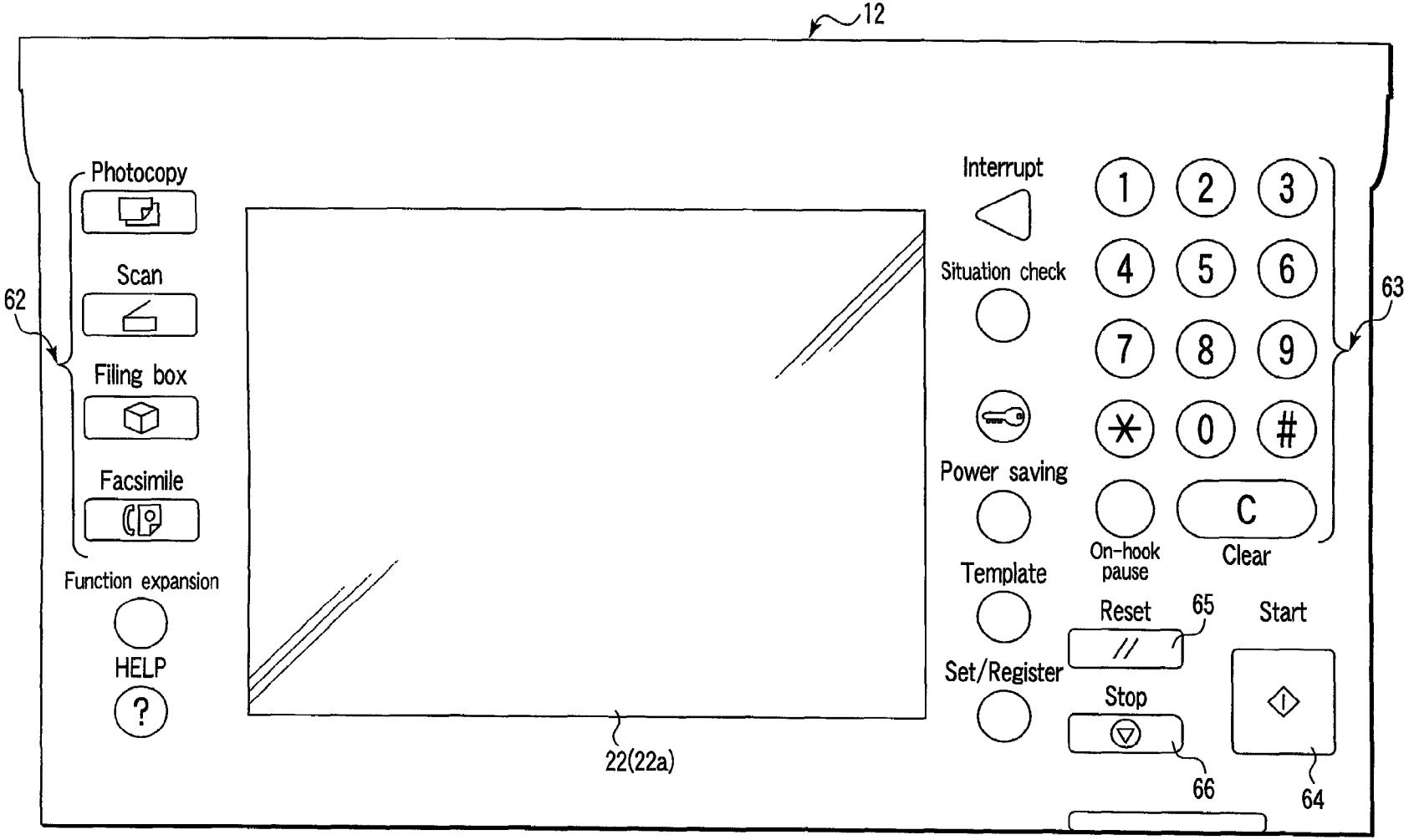
FIG. 3 is an appearance diagram showing a constitution example of an operation panel.

FIG. 3 is an appearance diagram showing a constitution example of the operation panel 12.

As shown in FIG. 3, the operation panel 12 is provided with various hardware keys 21, the display section 22 in which the touch panel 22*a* is built and the like. Examples of the hardware keys 21 include function selecting keys 62, ten keys 63, a start key 64, a reset key 65 and a stop key 66.

The function selecting keys 62 are hardware keys for selecting various functions. Examples of the function selecting keys 62 include a scanning function selecting key for selecting a scanning function, a photocopy function selecting key for selecting a photocopy function and a FAX function selecting key for selecting a facsimile function.

The ten keys 63 are hardware keys for inputting numerals and the like. The ten keys 63 are used in inputting information such as the number of sheets to be photocopied, a photocopy magnification and a personal identification number for management. The start key 64 is a hardware key for instruction start of an operation. For example, in the photocopy function, a photocopy operation is started in response to an instruction of the start key 64. The reset key 65 is a hardware key for instructing reset of the set contents and the like. For example, when the reset key 65 is input, the set contents and the like designated by the user are reset, and changed into a default set value. The stop key 66 is a hardware key for instructing discontinuation of the operation being executed by the digital multifunction peripherals. For example, when the stop key 66 is indicated during the photocopy operation of the digital multifunction peripherals, the photocopy operation is stopped.

Moreover, in addition to the above-described keys, the operation panel 12 shown in FIG. 3 includes, as the hardware keys 21: a help (HELP) key to instruct display of a user guidance; a set/register key to instruct execution of setting or registering; a template key to select a template as data registered beforehand; an interrupt key to demand an interrupt of an operation; a situation check key to confirm a state of the digital multifunction peripherals; a key to perform security setting or the like; a power saving key for switching a power saving operation mode to reduce power consumption and a usual operation mode; an on-hook/pause key to bring a phone function into an on-hook state; a clear key to clear numerals and the like input by the ten keys and the like. Furthermore, the operation panel 12 shown in FIG. 3 also includes an alarm display to notify an abnormality of the digital multifunction peripherals and the like.

The display section 22 is constituted of a liquid crystal display in which the touch panel 22*a* is built. In the display section 22, various operation screens are displayed. Each operation screen displayed in the display section 22 displays a key (icon) selectable by the touch panel 22*a* in addition to the operation guidance and the like. An example of a screen displayed in the display section 22 will be described later in detail.

The display contents displayed in the display section 22 are controlled by, for example, the system control unit 11. The display data to be displayed in the display section 22 is stored in a storage device of the system control unit 11, such as the HDD 55, the nonvolatile memory 54 or the ROM 53. That is, the storage device (the HDD 55, the nonvolatile memory 54 or the ROM 53) of the system control unit 11 stores data such as the screen, guidance, icon or graphical image to be displayed in the display section 22.

The CPU 51 of the system control unit 11 judges user's operation contents or display contents in accordance with an operation situation of each component. Based on this judgment, the CPU 51 of the system control unit 11 executes a control in reading the display data to be displayed in the display section 22 from the HDD 55, the nonvolatile memory 54 or the ROM 53 to display the data in the display section 22. That is, the CPU 51 of the system control unit 11 controls the display of the display section 22 in accordance with the user's operation contents or the operation situation of each component. The guidance, the icon, the graphical image and the like displayed in the screen of the display section 22 are controlled by the CPU 51 of the system control unit 11 in accordance with the user's operation contents or the operation situation of each component.

Next, there will be described various operation screens to be displayed in the display section 22 of the operation panel 12, and processing in a state in which each operation screen is displayed.

First, there will be described a display example of a basic screen 70 displayed in the display section 22 of the operation panel 12, and a processing example in a state in which the basic screen 70 is displayed.

Figure 4:
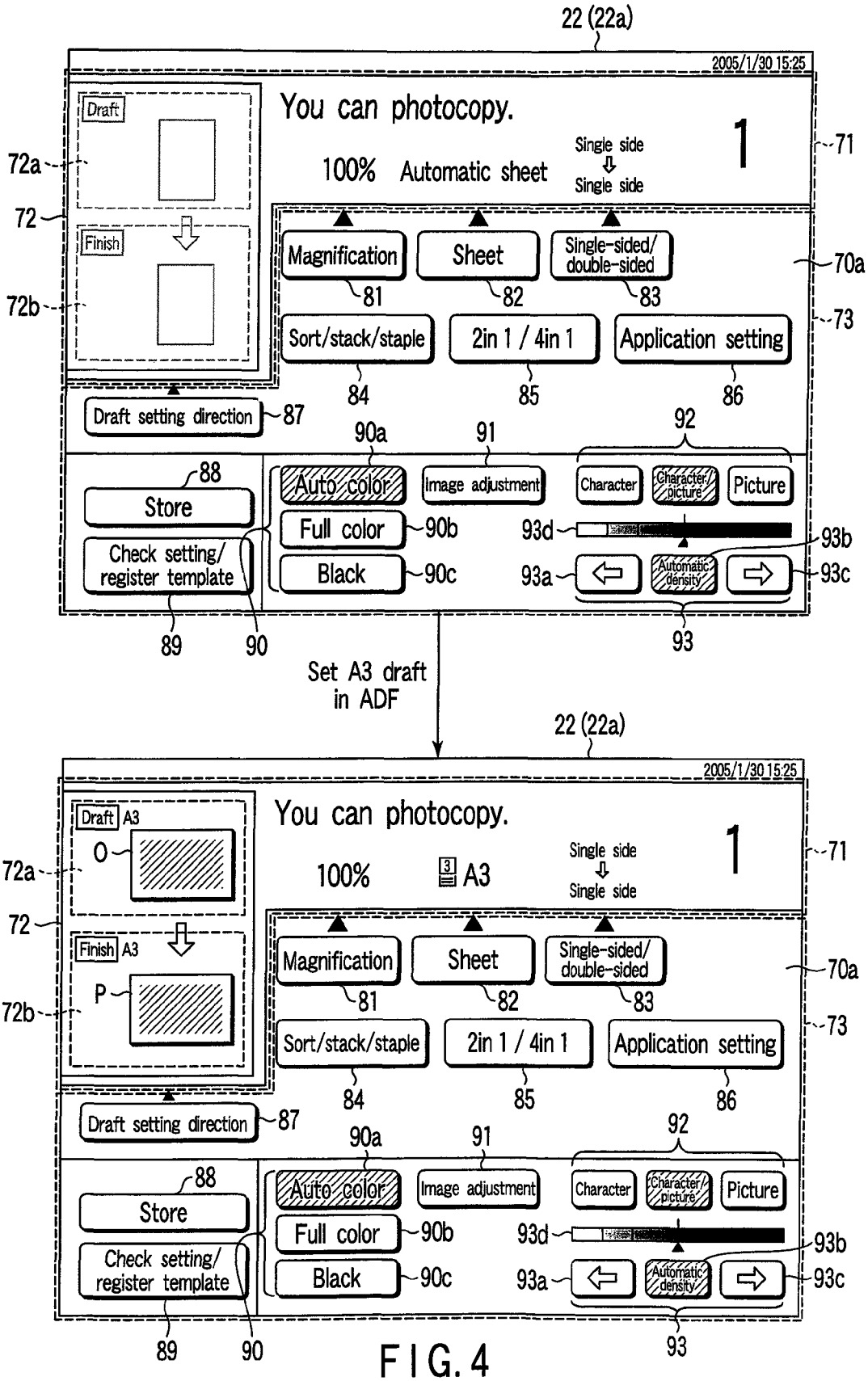
FIG. 4 is a diagram showing a display example of a basic screen in a photocopy mode.
Figure 5:
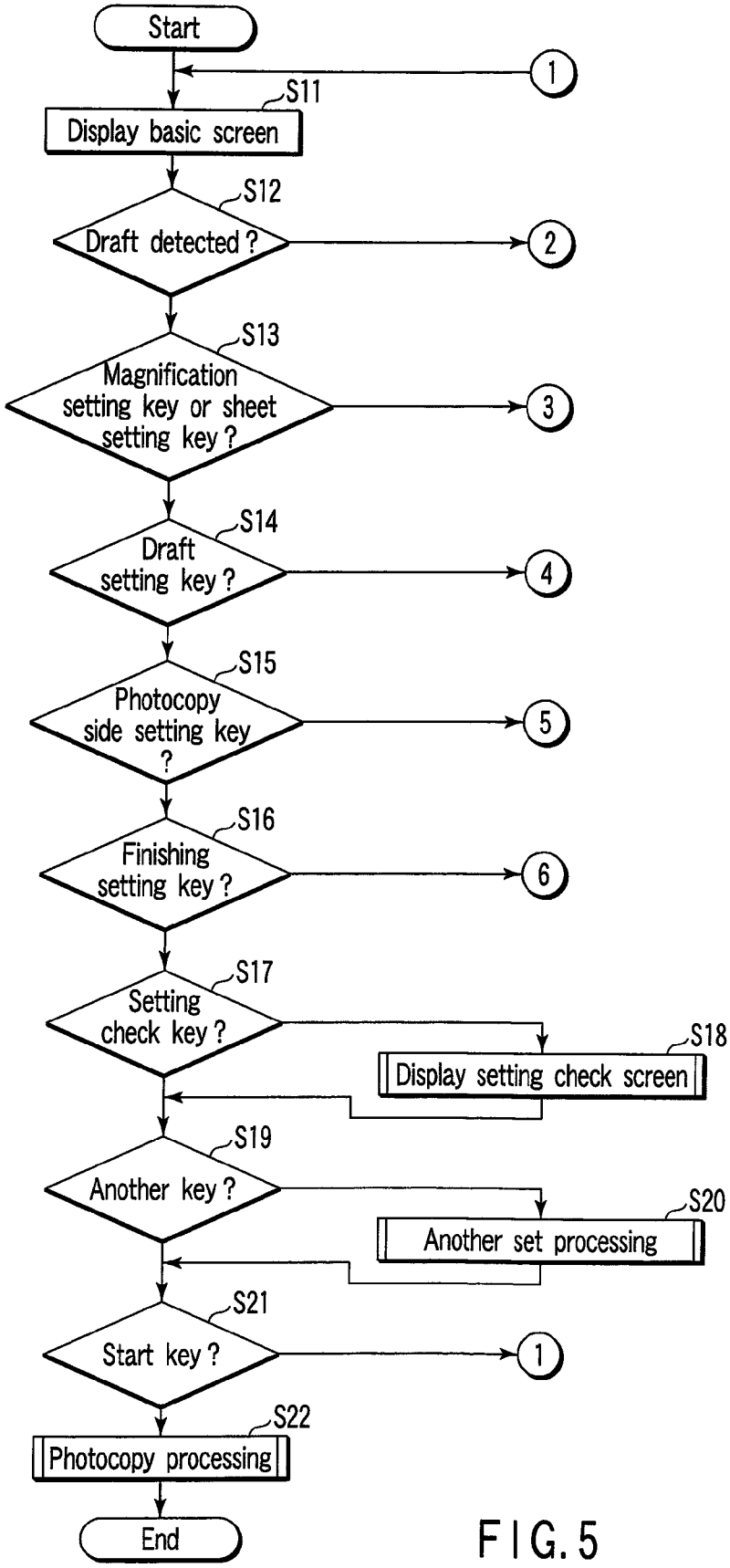
FIG. 5 is a flowchart showing a processing example in a state in which the basic screen is displayed.

FIG. 4 is a diagram showing a display example of the basic screen 70 (70*a*, 70*b*) in a photocopy mode. FIG. 5 is a flowchart showing a processing example in a state in which the basic screen 70 is displayed. It is to be noted that in the following description, there is assumed a case where the draft is set in the ADF 31.

The basic screen 70 is displayed in the display section 22 in a case where the digital multifunction peripherals has a photocopy mode. Even in a case where various set contents are set in the photocopy mode, the basic screen 70 is displayed in a state in which the set contents are reflected. The basic screen 70*a* shown in FIG. 4 shows a display example of the basic screen displayed in the display section 22 in a case where the digital multifunction peripherals is brought into a standby state in the photocopy mode (i.e., a case where various settings are brought into default set states). The basic screen 70*b* shown in FIG. 4 shows a display example of the basic screen displayed in the display section 22 in a case where an "A3" draft is set in the ADF 31 of the digital multifunction peripherals brought into the standby state.

First, in a case where the digital multifunction peripherals is brought into the photocopy mode, the CPU 51 of the system control unit 11 displays the basic screen 70*a* shown in FIG. 4 in the display section 22 of the operation panel 12 in the standby state (step S1). When the draft is set on the ADF 31 in this state (step S12, YES), the CPU 51 of the system control unit 11 performs draft size detection processing by the ADF draft size detecting function, and performs draft set processing and sheet set processing based on a detection result of the draft size. There will be described later in detail the draft set processing and the sheet set processing based on the detection result of this draft size.

In the display example shown in FIG. 4, the basic screen 70*a* or 70*b* has display areas such as a guidance display area 71, a draft and sheet setting display area 72, and a function setting button display area 73.

In the display area 71, there are displayed a message, a magnification, a sheet size, a photocopy side (single-sided/double-sided), the number of sheets to be photocopied and the like. As the message, a present state of the digital multifunction peripherals or the like is displayed. As the magnification, the presently set magnification is displayed. As the sheet size, the presently set sheet size is displayed. As the photocopy side, the presently set mode is displayed: a mode (single-sided/single-sided mode) to photocopy a single side of the draft on a single side of the sheet; a mode (single-sided/ double-sided mode) to photocopy the single side of the draft on double sides of the sheet; a mode (double-sided/single-sided mode) to photocopy the double sides of the draft on the single side of the sheet; or a mode (double-sided/double-sided mode) to photocopy the double sides of the draft on the double sides of the sheet. As the number of the sheets to be photocopied, the presently set print number (photocopy number) is displayed.

The display area 72 is provided with a first display area 72*a* and a second display area 72*b*.

In the first display area 72*a*, there is displayed information indicating the presently set draft. For example, in the first display area 72*a*, a draft graphical image O is displayed together with character information indicating the draft size. The draft graphical image O displayed in the first display area 72*a* shows the draft size, the draft direction (setting direction), the direction of the image in the draft (portrait or landscape), the surface of the draft to be read (single-sided or double-sided) and the like. Accordingly, the user can visually and intuitively image the present draft setting.

The second display area 72*b* displays information indicating finish (printed sheet) in a case where the sheet is printed with the present set contents. The second display area 72*b* displays a graphical image P of the finish together with the character information indicating a finish size (photocopy sheet size). The finished graphical image P displayed in the second display area 72*b* shows the size of the sheet (photocopy sheet) on which the draft image is to be printed, the direction of the sheet, the direction of the image (portrait or landscape) to be printed on the sheet, the surface of the sheet to be printed (single-sided/double-sided) and the like. Accordingly, the user can visually and intuitively image the present sheet setting.

Moreover, as shown in FIG. 4, the first display area is adjacent to the second display area. Furthermore, the draft graphical image displayed in the first display area is associated with the finished graphical image displayed in the second display area by a mark such as an arrow. Therefore, the user can visually and intuitively associate the set contents of the draft with those of the sheet (finish) to confirm them.

In the display area 73, there are displayed keys for setting various functions selectable by the touch panel 22*a*. The various keys displayed in the display area 73 are keys for performing various settings. The various keys displayed in the display area 73 are characters indicating the set contents and the like and icons in which patterns, graphics or the like are displayed.

The display area 73 displays: a magnification key 81; a sheet key 82; a photocopy side (single-sided/double-sided) key 83; a finishing setting (sort/stack/staple) key 84; an Nin1 (2in1/4in1) key 85; an application setting key 86; a draft setting (draft setting direction) key 87; a store key 88; a setting check key 89; a color mode setting portion (an auto color key 90*a*, a full color key 90*b*, and a black key 90*c*) 90, an image adjustment key 91; a draft mode setting portion (a character key 92*a*, a character picture key 92*b*, and a picture key 92*c*) 92; a density adjustment portion (a density down key 93*a*, a density up key 93*b*, an automatic density key 93*c*, and a density display portion 93*d*) 93 and the like.

The magnification key 81 is constituted of an icon in which "magnification" is displayed. The magnification key 81 is a key to be touched by the user in setting the magnification of the image to be printed on the sheet with respect to the image on the draft. When the magnification key 81 is touched (step S13, YES), the CPU 51 of the system control unit 11 displays a setting screen (magnification setting screen) for setting the magnification in the display section 22. In this case, the CPU 51 performs magnification set processing in response to the key input by the user in a state in which the magnification setting screen is displayed. It is to be noted that there will be described later in detail the magnification setting screen and the magnification set processing.

The sheet key 82 is constituted of an icon in which "sheet" is displayed. The sheet key 82 is a key to be touched by the user in setting the sheet size or the draft size. When the sheet key 82 is touched (step S13, YES), the CPU 51 of the system control unit 11 displays, in the display section 22, a setting screen (sheet setting screen) for setting the photocopy sheet size or the draft size. In this case, the CPU 51 performs the sheet set processing in response to the key input in a state in which the sheet setting screen is displayed. It is to be noted that there will be described later in detail the sheet setting screen and the sheet set processing.

The draft setting key 87 is constituted of an icon in which the "draft setting direction" is displayed. The draft setting key 87 is a key to be touched by the user in setting a direction in which the draft is to be set. When the draft setting key 87 is touched (step S14, YES), the CPU 51 of the system control unit 11 displays, in the display section 22, a draft direction setting screen for setting the draft setting direction. In this case, the CPU 51 performs the draft set processing in response to the key input in a state in which the draft direction setting screen is displayed. It is to be noted that there will be described later in detail the draft direction setting screen and the draft direction set processing.

It is to be noted that in a case where the ADF draft size detecting function is invalid, the draft setting key 87 is constituted of an icon in which the "draft size/setting direction" is displayed. In this case, when the draft setting key 87 is touched, the CPU 51 of the system control unit 11 displays, in the display section 22, the draft setting screen for setting the draft size and the draft setting direction in the ADF. In this case, the CPU 51 performs the draft set processing in response to the input key in a state in which the draft setting screen is displayed. It is to be noted that there will be described later in detail the draft setting screen and the draft set processing.

The photocopy side key 83 is constituted of an icon in which "single-sided/double-sided" is displayed. The photocopy side key 83 is a key to be touched by the user in setting the photocopy side. When the photocopy side key 83 is touched (step S15, YES), the CPU 51 of the system control unit 11 displays, in the display section 22, a setting screen (photocopy side setting screen) for setting one of the single-sided/single-sided mode, the single-sided/double-sided mode, the double-sided/single-sided mode and the double-sided/double-sided mode as a photocopy side mode. In this case, the CPU 51 performs the photocopy side set processing in response to the key input in a state in which the photocopy side setting screen is displayed. It is to be noted that there will be described later in detail the photocopy side setting screen and the photocopy side set processing.

Moreover, the magnification key 81, the sheet key 82 and the photocopy side key 83 are disposed in the vicinity of the guidance display area 71. The magnification key 81, the sheet key 82 and the photocopy side key 83 are associated with the magnification, the sheet, and the photocopy side displayed in the guidance display area 71. The magnification setting, the sheet setting, and the photocopy side setting are basic set particulars for frequent use in the photocopy mode. Therefore, the magnification key 81, the sheet key 82 and the photocopy side key 83 are disposed in the vicinity of the guidance display area 71 so that the user easily touches the keys, and easily check the set contents.

The finishing (sort/stack/staple) setting key 84 is constituted of an icon in which the "sort/stack/staple" is displayed. The finishing (sort/stack/staple) setting key 84 is a key to be touched by the user in setting contents of finishing processing performed by the finisher unit 15.

In a case where the finishing setting key 84 is touched (step S16, YES), the CPU 51 of the system control unit 11 displays, in the display section 22, a setting screen (finishing setting screen) for setting the finishing (sort/stack/staple). In this case, the CPU 51 performs the finishing set processing in response to the key input in a state in which the finishing setting screen is displayed. It is to be noted that there will be described later in detail the finishing setting screen and the finishing set processing.

The store key 88 is constituted of an icon in which "store" is displayed. The store key 88 is a key to be touched by the user in storing the present set contents. The setting check key 89 is constituted of an icon in which "check setting/register template" is displayed. The setting check key 89 is a key to be touched in a case where the present set contents are checked, or registered as a template. When the setting check key 89 is touched (step S17, YES), the CPU 51 of the system control unit 11 displays, in the display section 22, a setting check screen displaying the present set contents (step S18). It is to be noted that a display example of the setting check screen be described later in detail.

The Nin1 (2in1/4in1) key 85 is constituted of an icon in which "2in1/4in1" is displayed. The Nin1 key 85 is a key to be touched by the user in setting photocopy in an Nin mode in which an image for N (e.g., 2 or 4) pages of the draft is to be printed on one sheet. When the Nin1 key 85 is touched (step S19, YES), the CPU 51 of the system control unit 11 displays, in the display section 22, an Nin1 setting screen for setting an Nin1 mode. In this case, the CPU 51 performs Nin1 set processing in response to the key input in a state in which the Nin1 setting screen is displayed (step S20).

The application setting key 86 is constituted of an icon in which "application setting" is displayed. The application setting key 86 is a key to be touched by the user in setting contents other than those set by each key displayed in the display area 73 or the hardware key 21. When the application setting key 86 is touched (step S19, YES), the CPU 51 of the system control unit 11 displays, in the display section 22, an application setting screen for setting application. In this case, the CPU 51 performs application set processing in response to the key input in a state in which the application setting screen is displayed (step S20).

The color mode setting portion 90 is constituted of keys for designating a color mode. The color mode setting portion 90 is constituted of the auto color key 90*a*, the full color key 90*b*, and the black key 90*c*. The auto color key 90*a* is constituted of an icon in which "auto color" is displayed. The full color key 90*b* is constituted of an icon in which "full color" is displayed. The black key 90*c* is constituted of an icon in which "monochromatic photocopy" is displayed.

The auto color key 90*a* is a key for judging whether the draft is chromatic or monochromatic, and setting color photocopy or monochromatic photocopy in accordance with the judgment result. The full color key 90*b* is a key for setting the color photocopy. The black key 90*c* is a key for setting the monochromatic photocopy.

The image adjustment key 91 is constituted of an icon in which "image adjustment" is displayed. The image adjustment key 91 is a key to be touched in performing setting to adjust the image. In a case where the image adjustment key 91 is touched (step S19, YES), the CPU 51 displays, in the display section 22, a setting screen for setting color balance, RGB adjustment, image quality adjustment, substrate adjustment, sharpness, two-color photocopy and the like (step S20).

The draft mode setting portion 92 is a key for selecting a type of the image to be photocopied. The draft mode setting portion 92 is constituted of the character key 92*a*, the character picture key 92*b*, and the picture key 92*c*. The character key 92*a* is constituted of an icon in which "character" is displayed. The character picture key 92*b* is constituted of an icon in which "character picture" is displayed. The picture key 92*c* is constituted of an icon in which "picture" is displayed.

The character key 92*a* is a key to be selected in a case where the image to be photocopied is a binary image (image constituted of white or black pixels) or an image to be processed as the binary image. For example, since the image constituted of characters has less grey-level pixels, the image is preferably photocopied as the binary image. Therefore, in a case where the image to be photocopied is constituted of the characters, the character key 92*a* is selected.

The picture key 92*c* is a key to be selected in a case where the image to be photocopied is an image having multiple tones. For example, since an image such as a picture has many grey-level pixels, the image is preferably photocopied as the multiple-tone image. Therefore, when the image to be photocopied is constituted of the picture, the picture key 92*c* is selected.

The character picture key 92*b* is a key to be selected in a case where the image to be photocopied is an image mixed with the binary image and the multiple-tone image. For example, the character picture key 92*b* is selected, in a case where the image to be photocopied is an image mixed with the characters and the picture.

The density adjustment portion 93 is constituted of keys for setting a photocopy density. The density adjustment portion 93 is constituted of the density down key 93*a*, the density up key 93*b*, the automatic density key 93*c*, the density display portion 93*d* and the like. The density down key 93*a* is constituted of an icon in which ".rarw." is displayed. The density up key 93*b* is constituted of an icon in which ".fwdarw." is displayed. The automatic density key 93*c* is constituted of an icon in which "automatic density" is displayed. In the density display portion 93*d*, the presently set photocopy density is displayed.

The density down key 93*a* is a key to be touched in a case where the photocopy density is reduced. Every time the density down key 93*a* is touched, the photocopy density is set to gradually decrease from the presently set photocopy density. The density up key 93*b* is a key to be touched in a case where the photocopy density is increased. Every time the density up key 93*b* is touched, the photocopy density is set to gradually increase from the presently set photocopy density. The automatic density key 93*c* is a key to be touched in a case where the photocopy density is set based on a predetermined reference value.

Moreover, in a case where any key of the color mode setting portion 90, the image adjustment key 91, the draft mode setting portion 92 and the density adjustment portion 93 is touched (step S19, YES), the CPU 51 of the system control unit 11 performs processing to change the set contents in response to the input key (step S20), and the set contents are reflected in the basic screen 70.

Furthermore, in a case where the start key as the hardware key 21 is input in a state in which the basic screen 70 is displayed (step S21, YES), the CPU 51 of the system control unit 11 executes photocopy processing based on the set contents displayed in the basic screen 70 (step S22). It is to be noted that the set contents concerning the photocopy processing are held as information set in the RAM 52 as described above.

Next, there will be described a processing example of automatic draft set processing based on a detection result of the ADF draft size detecting function.

Figure 6:
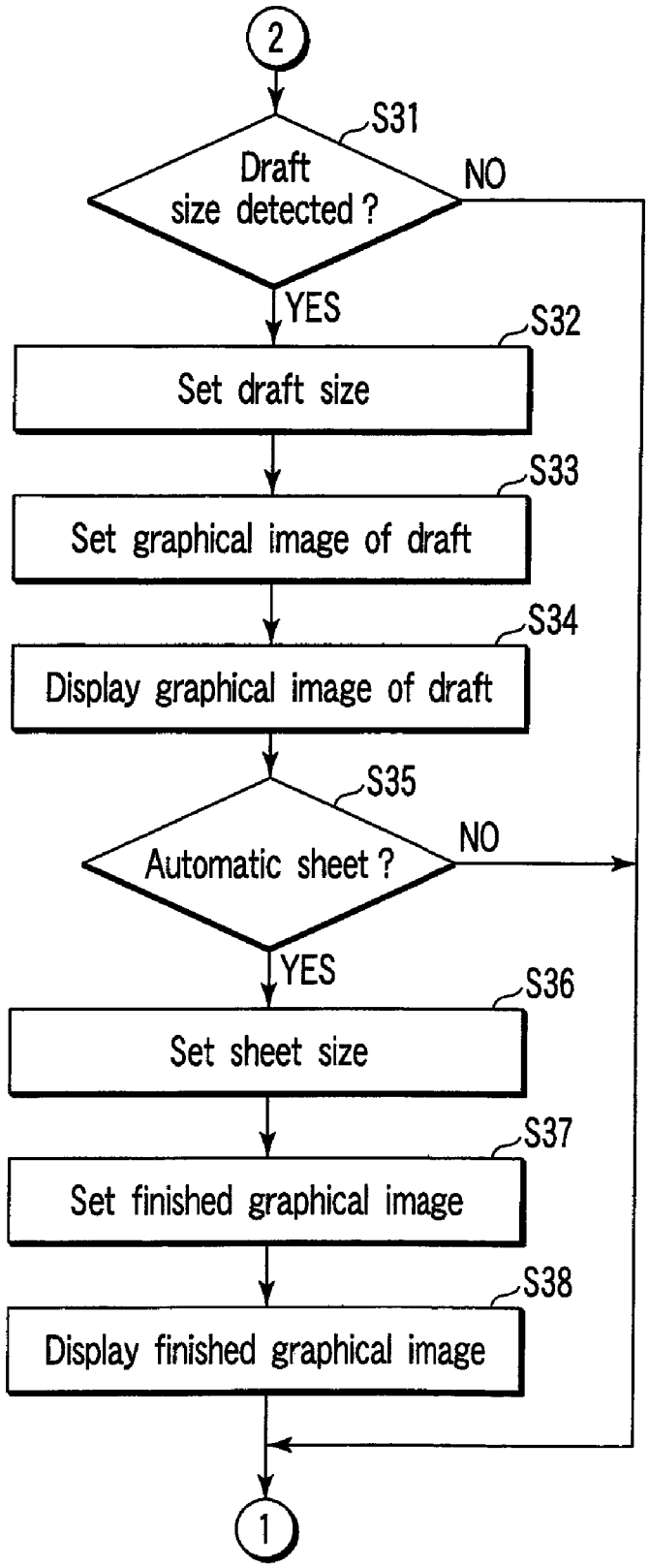
FIG. 6 is a flowchart showing a processing example of automatic draft set processing.

FIG. 6 is a flowchart showing a processing example of the automatic draft set processing. Here, it is assumed that the ADF draft size detecting function is valid. In the following description, it is assumed that the basic screen 70 is displayed in the display section 22 of the operation panel 12.

In a case where the draft is set on the draft table of the ADF 31, when the ADF draft size detecting function is effective, the CPU 51 of the system control unit 11 performs the automatic draft set processing.

First, when the draft is set on the draft table of the ADF 31, among a plurality of sensors 31*b* disposed on the draft table of the ADF 31, the sensor 31*b* corresponding to a position where the draft has been set supplies a detection signal indicating that the draft has been detected to the CPU 51 of the system control unit 11. On receiving, from any sensor 31*b*, the detection signal indicating that the draft has been detected, the CPU 51 of the system control unit 11 judges that the draft has been set on the draft table.

When it is judged that the draft has been set on the draft table of the ADF 31, the CPU 51 judges whether or not the ADF draft size detecting function is valid (step S31). In a case where the ADF draft size detecting function is invalid (step S31, NO), processing of steps S32 to S38 described later is cancelled. When the ADF draft size detecting function is valid (step S31, YES), the CPU 51 detects the size of the draft set on the draft table based on a signal indicating a position of the guide section 31*a* functioning as a draft size detector and a detection signal of each sensor 31*b* indicating whether or not the draft exists.

For example, the ADF draft size detecting function judges a length of the draft in a direction perpendicular to a direction in which the draft is conveyed by the ADF 31 based on a signal indicating the position of the guide section 31*a*. Furthermore, the ADF draft size detecting function judges a length of the draft in a direction parallel to the direction in which the draft is conveyed by the ADF 31 based on the detection signal of each sensor 31*b* indicating the presence of the draft. Therefore, the CPU 51 of the system control unit 11 judges the draft size and the draft direction based on the length of the draft in the direction perpendicular to the direction of the draft conveyed by the ADF 31 and that in the direction parallel to the direction of the draft conveyed by the ADF 31.

On judging the size (magnitude and direction) of the draft set in the ADF 31, the CPU 51 sets the size of the draft in accordance with the detected size (step S32). When the draft size is set, the CPU 51 determines the draft graphical image O in accordance with the set draft size (step S33).

The draft graphical image O indicates the present draft setting by the graphical image. Here, the draft size (magnitude and direction) is set. Therefore, as the draft graphical image O, the graphical image is determined which indicates at least the draft size (magnitude and direction).

As the draft graphical image O, an image matched with the draft size is selected from a plurality of types of graphical images stored beforehand in the HDD 55, the nonvolatile memory 54 or the ROM 53. In a case where sizes such as A3, A4, A4-R and B4 are presumed as the draft sizes, graphical images of various sizes corresponding to the presumed draft sizes are stored beforehand in the HDD 55, the nonvolatile memory 54 or the ROM 53. It is to be noted that the draft graphical image O may be prepared by the CPU 51 every time the draft setting is changed.

In a case where the graphical image is determined which is to be displayed as the draft graphical image O, the CPU 51 displays the determined image as the draft graphical image O in the first display area 72*a* (step S34).

When the ADF draft size detecting function judges the draft size, the CPU 51 judges whether or not a sheet setting mode is set to "automatic sheet" (step S35). Here, the "automatic sheet" as the sheet setting mode is a mode to set the sheet size matched with the draft size as the sheet setting. For example, when the magnification is 100%, the sheet having a size equal to that of the draft is set. It is to be noted that when the sheet setting mode is not the "automatic sheet" (step S35, NO), the CPU 51 cancels processing of steps S35 to S37 described later.

When the sheet setting mode is the "automatic sheet" (step S35, YES), the CPU 51 sets the sheet size as the sheet setting to the size (magnitude and direction) in accordance with the draft size (step S36). On setting the sheet size, the CPU 51 determines the finished graphical image P in accordance with the set sheet size (step S37).

The finished graphical image P shows a graphical image of the sheet (finish) to be printed based on the present set contents. Here, the sheet size (magnitude and direction) is set. Therefore, as the finished graphical image P, the graphical image is determined which indicates at least the sheet size (magnitude and direction).

As the finished graphical image P, the image matched with the sheet size is selected from a plurality of types of graphical images stored beforehand in the HDD 55, the nonvolatile memory 54 or the ROM 53. In a case where sizes such as A3, A4, A4-R and B4 are presumed as the sheet sizes, graphical images of various sizes corresponding to the presumed sheet sizes are stored beforehand in the HDD 55, the nonvolatile memory 54 or the ROM 53. The finished graphical image P may be prepared by the CPU 51 every time the sheet size setting is changed.

In a case where the image is determined which is to be displayed as the finished graphical image P, the CPU 51 displays the determined image as the finished graphical image P in the second display area 72*b* (step S38).

According to the above-described automatic draft set processing, the size judged by the ADF draft size detecting function is set as the draft size, and the draft graphical image indicating the draft size is displayed in the first display area. Accordingly, the user can visually and intuitively confirm the draft size (magnitude and direction) judged by the ADF draft size detecting function.

Furthermore, in a case where the "automatic sheet" is set as the sheet setting mode, the size judged by the ADF draft size detecting function in accordance with the draft size is set as the sheet size, and the finished graphical image indicating the sheet size is displayed in the second display area. Accordingly, the user can visually confirm the size of the photocopy sheet (finish) together with the draft size (magnitude and direction).

Next, there will be described photocopy magnification and sheet set processing.

Here, there will be described a display example of the magnification and sheet setting screen (magnification/sheet setting screen) and processing examples of the magnification set processing and the sheet set processing in a state in which the magnification/sheet setting screen is displayed.

Figure 7:
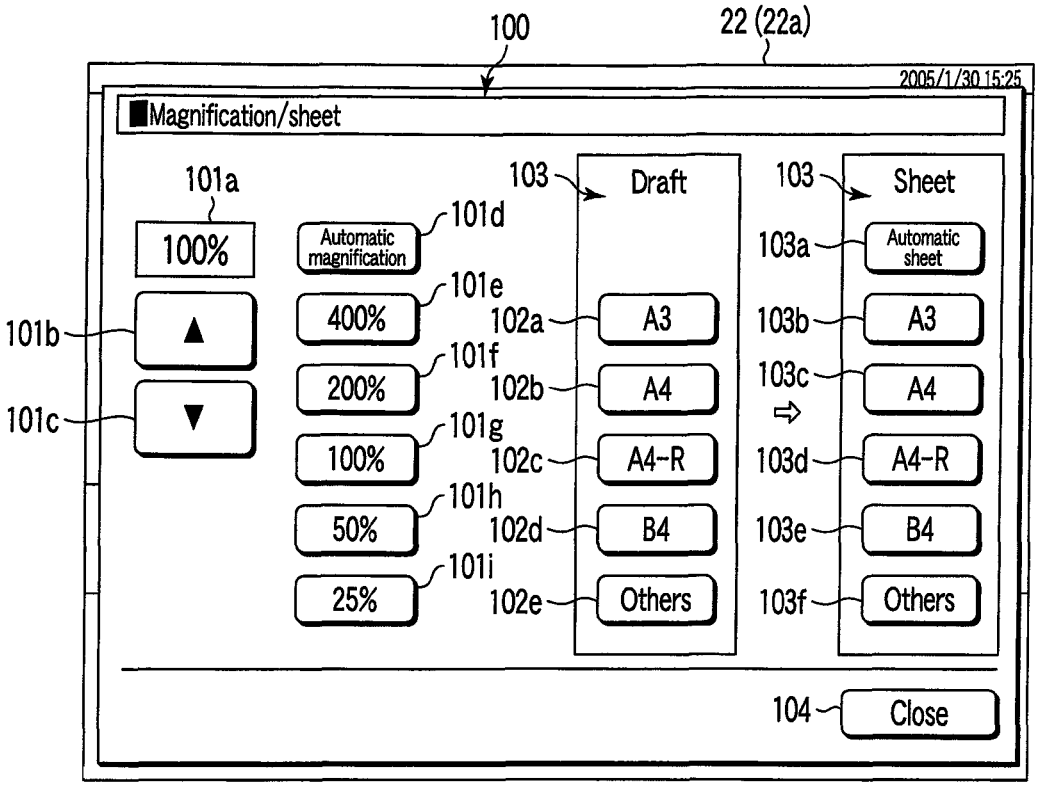
FIG. 7 is a diagram showing a first display example of a magnification/sheet setting screen.
Figure 8:
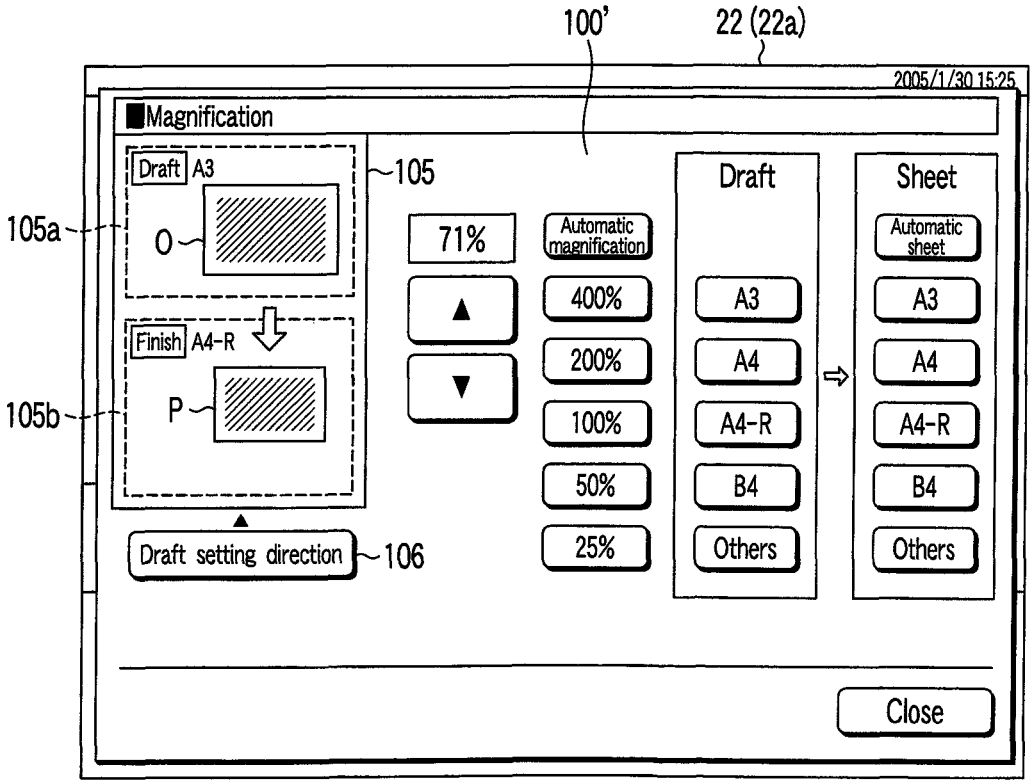
FIG. 8 is a diagram showing a second display example of a magnification/sheet setting screen.

FIG. 7 is a diagram showing a first display example of a magnification/sheet setting screen 100. FIG. 8 is a diagram showing a second display example of a magnification/sheet setting screen 100'.

It is to be noted that in the magnification/sheet setting screen 100' shown in FIG. 8, display contents of the magnification/sheet setting screen 100 shown in FIG. 7 further include a display area 105 having a first display area 105*a* and a second display area 105*b* and a draft setting key 106. The first display area 105*a*, the second display area 105*b*, and the draft setting key 106 are similar to the first display area 72*a*, the second display area 72*b* and the draft setting key 87 displayed in the basic screen 70, respectively. That is, the first display area 105*a* is an area in which a draft graphical image O is displayed. The second display area 105*b* is an area in which a finished graphical image P is displayed.

In the display examples shown in FIGS. 7 and 8, the same setting screen (magnification/sheet setting screen) is used as a photocopy magnification setting screen and a sheet size (and draft size) setting screen. The photocopy magnification setting is closely related to the photocopy sheet setting. Therefore, the photocopy magnification and the sheet size can be set in the same screen. For example, when the draft size and the photocopy sheet size are determined, there is determined a photocopy magnification (optimum photocopy magnification) at which the image of the whole draft just fits the photocopy sheet. Conversely, when the draft size and the photocopy magnification are determined, there is determined a photocopy sheet size (optimum sheet size) which just fits the image of the whole draft.

In the magnification/sheet setting screen 100 shown in FIG. 7 or the magnification/sheet setting screen 100' shown in FIG. 8, there are displayed a magnification setting section 101, a draft size setting section 102, a sheet size setting section 103, a close key 104 and the like.

The magnification setting section 101 is constituted of a magnification display portion 101*a*, a magnification up key 101*b*, a magnification down key 10*c*, an automatic magnification key 101*d*, a 400% key 101*e*, a 200% key 101*f*, a 100% key 101*g*, a 50% key 101*h*, a 25% key 101*i* and the like. In the magnification display portion 101*a*, the presently set photocopy magnification is displayed. The magnification up key 101*b* is touched when increasing the photocopy magnification every percentage. The magnification down key 101*c* is touched when decreasing the photocopy magnification every percentage. The automatic magnification key 101*d* is a key brought into a selected state in a case where the magnification is set in accordance with the draft size and the sheet size. The 400% key 101*e*, the 200% key 101*f*, the 100% key 101*g*, the 50% key 101*h* and the 25% key 101*i* are touched in a case where the photocopy magnification is set to 400%, 200%, 100%, 50% and 25%, respectively.

The draft size setting section 102 is constituted of an "A3" key 102*a*, an "A4" key 102*b*, an "A4-R" key 102*c*, a "B4" key 102*d*, another key 102*e* and the like. The "A3" key 102*a*, the "A4" key 102*b*, the "A4-R" key 102*c* and the "B4" key 102*d* are keys to be touched in a case where the draft size is set to "A3", "A4", "A4-R" and "B4", respectively. The other key 102*e* is a key to be touched in a case where the draft size is set to a size other than "A3", "A4", "A4-R" and "B4". In a case where the draft size detecting function is valid, in an initial state, the key corresponding to the draft having a size detected by the draft size detecting function is brought into the selected state in the draft size setting section 102.

The sheet size setting section 103 is constituted of an automatic sheet setting key 103*a*, an "A3" key 103*b*, an "A4" key 103*c*, an "A4-R" key 103*d*, a "B4" key 103*e*, another key 103*f* and the like. The automatic sheet setting key 103*a* is a key brought into the selected state in a case where the sheet is set in accordance with the draft size and the photocopy magnification. For example, in a case where the automatic sheet setting key 103*a* is brought into the selected state, when the photocopy magnification is 100%, a sheet is selected which has a size equal to that of the draft. The "A3" key 103*b*, the "A4" key 103*c*, the "A4-R" key 103*d* and the "B4" key 103*e* are keys to be touched in a case where the sheet size is set to "A3", "A4", "A4-R" and "B4", respectively. The other key 103*f* is a key to be touched in a case where the sheet having a size other than "A3", "A4", "A4-R" and "B4" is set.

The close key 104 is a key to be touched in a case where the settings of the magnification and the sheet have been completed. When the close key 104 is touched, the display section 22 displays the basic screen 70 in which the settings of the magnification and the sheet set in the magnification/sheet setting screen have been reflected.

Next, there will be described processing examples of the magnification set processing and the sheet set processing.

Figure 9:
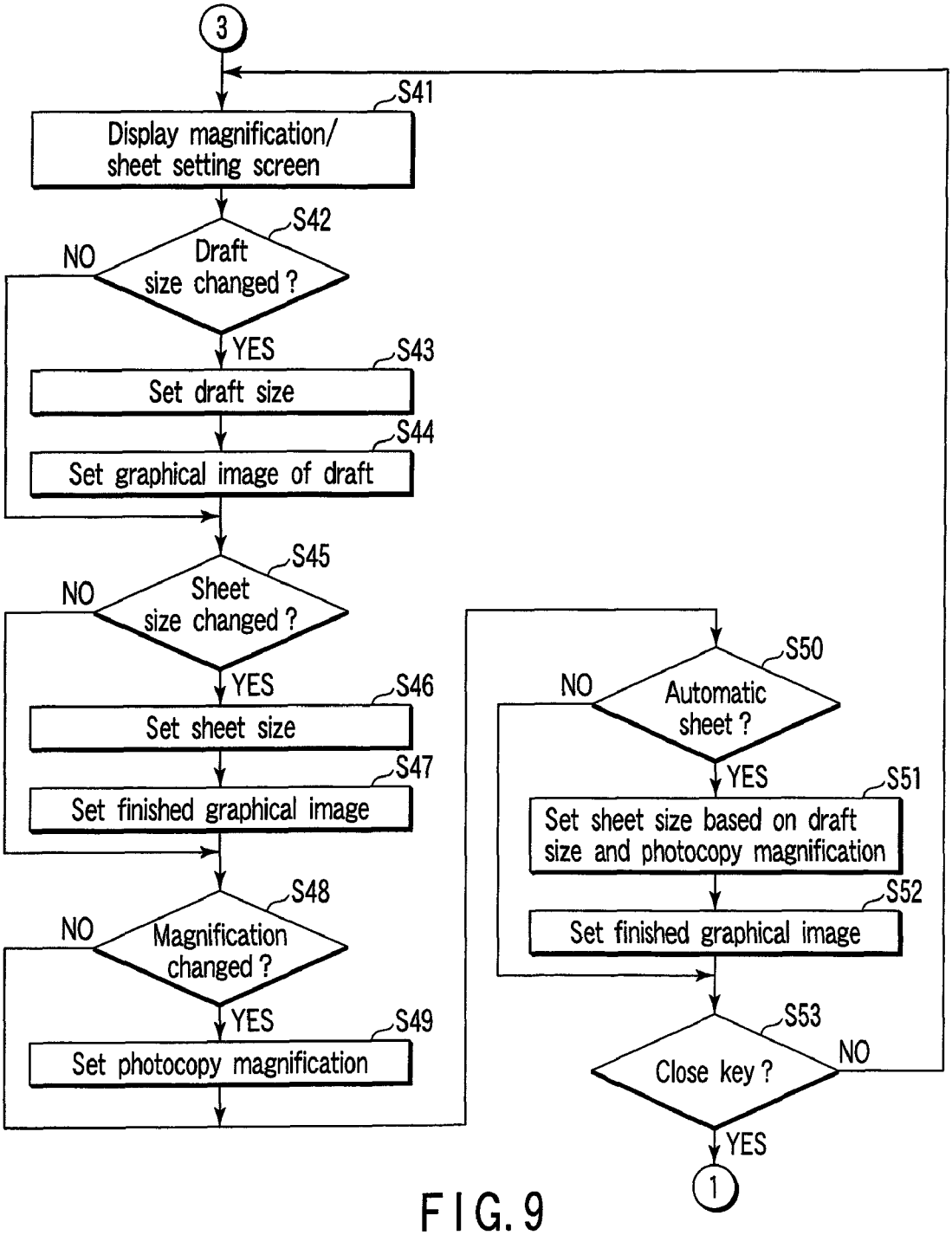
FIG. 9 is a flowchart showing processing examples of magnification set processing and sheet set processing.

FIG. 9 is a flowchart showing the processing examples of the magnification set processing and the sheet set processing in a state in which the magnification/sheet setting screen 100 shown in FIG. 7 or the magnification/sheet setting screen 100' shown in FIG. 8 is displayed.

When the magnification key 81 or the sheet key 82 is touched in the basic screen 70, the CPU 51 of the system control unit 11 displays, in the display section 22, the magnification/sheet setting screen 100 in which the present set contents have been reflected (step S41). For example, when the magnification is "100%", the draft size is "A4", and the sheet size (sheet setting mode) is "automatic sheet", as shown in FIG. 7, the display section 22 displays the magnification/sheet setting screen 100 in which the magnification is "100%", the draft size is "A4", and the sheet is "automatic sheet".

In a case where any key (102*a* to 102*e*) of the draft size setting section 102 is input in a state in which the magnification/sheet setting screen 100 is displayed, the CPU 51 brings the input key into the selected state (a display color of the key is changed), and judges that the draft size has been changed (step S42, YES). When it is judged that the draft size has been changed, the CPU 51 performs processing to set the draft size to a size corresponding to the input key (step S43). Furthermore, when the draft size setting is changed, the CPU 51 sets the draft graphical image O in accordance with the set draft size (step S44).

For example, in a case where the user touches the "A3" key 102*a* in the magnification/sheet setting screen 100 in which the "A4" key 102*b* is brought into the selected state, the CPU 51 brings the "A3" key 102*a* into the selected state, and sets the draft size to "A3". When the draft size is set to "A3", the CPU 51 sets the graphical image corresponding to "A3" as the draft graphical image.

It is to be noted that as shown in FIG. 8, in a case where the magnification/sheet setting screen 100' is provided with the first display area 72*a*, the CPU 51 displays the set draft graphical image O in the first display area 72*a*.

Moreover, when any key (103*b* to 103*f*) of the sheet size setting section 103 is input, the CPU 51 of the system control unit 11 brings the input key into the selected state (a display color of the key is changed), and judges that the sheet size (finished sheet size) has been changed (step S45, YES). When it is judged that the sheet size has been changed, the CPU 51 of the system control unit 11 performs processing to set the sheet size to a size corresponding to the input key (step S46). It is to be noted that when the "automatic sheet" setting key

103*a* is input, the CPU 51 performs processing to set the sheet size as described later in steps S51, S52.

When the sheet size setting is changed, the CPU 51 sets the finished graphical image P in accordance with the set sheet size (step S47). For example, in a case where the user touches the "A4-R" key 103*d* in the magnification/sheet setting screen 100 in which the "automatic sheet" key 103*a* is brought into the selected state, the CPU 51 brings the "A4-R" key 103*d* into the selected state, and sets the sheet size to "A4-R". When the sheet size is set to "A4-R", the CPU 51 sets the graphical image corresponding to "A4-R" as the finished graphical image P.

It is to be noted that when the magnification/sheet setting screen 100' is provided with the second display area 105*b* as shown in FIG. 8, the CPU 51 displays the set finished graphical image P in the second display area 72*b*.

Moreover, when any key (101*b* to 101*i*) of the magnification setting section 101 is input, the CPU 51 of the system control unit 11 judges that the photocopy magnification has been changed (step S48, YES). When it is judged that the photocopy magnification has been changed, the CPU 51 of the system control unit 11 displays the magnification in response to the input key in the magnification display portion 101*a*, and performs processing to set the photocopy magnification in response to the input key (step S49). When the "automatic magnification" key 101*d* is input, the CPU 51 calculates an optimum magnification in accordance with the draft size and the sheet size. This calculated magnification is displayed in the magnification display portion 101*a*, and set as the photocopy magnification.

Moreover, in a case where the sheet size or the photocopy magnification is changed in a state in which the "automatic sheet" is set as the sheet setting mode (step S50, YES), the CPU 51 performs the processing (automatic sheet set processing) to set the sheet size in accordance with the draft size and the photocopy magnification. Even in a case where the "automatic sheet" key 103*a* is input in a state in which a specific sheet size is set (step S50, YES), the CPU 51 performs the processing (automatic sheet set processing) to set the sheet size in accordance with the draft size and the photocopy magnification.

In the automatic sheet set processing, the CPU 51 judges an optimum sheet size based on the draft size and the photocopy magnification. On judging the optimum sheet size, the CPU 51 sets the sheet size to the judged sheet size (step S51). Furthermore, when the sheet size setting is changed, the CPU 51 sets the finished graphical image P in accordance with the set sheet size (step S52).

It is to be noted that when the magnification/sheet setting screen 100' is provided with the second display area 105*b* as shown in FIG. 8, the CPU 51 displays the set finished graphical image P in the second display area 105*b*.

Moreover, when the close key 104 is input, the CPU 51 of the system control unit 11 ends the displayed magnification and sheet set processing. In this case, the CPU 51 changes, to the basic screen 70, the set screen displayed in the display section 22. It is to be noted that in the basic screen 70, the first display area 72*a* displays the draft graphical image O set in the magnification and sheet set processing, and the second display area 72*b* displays the finished graphical image P set in the magnification and sheet set processing.

Next, draft setting will be described.

The draft setting includes the draft size (magnitude and setting direction) and the direction of the image (portrait or landscape) in the draft. The draft size is detectable by the ADF draft size detecting function. That is, when the ADF draft size detecting function is valid, the size (magnitude and setting direction) of the draft set in the ADF 31 is judged by the ADF draft size detecting function. Therefore, as to the draft setting, there will be described a case where the ADF draft size detecting function is valid and a case where the ADF draft size detecting function is invalid.

First, there will be described the draft setting in a case where the ADF draft size detecting function is valid.

Figure 10:
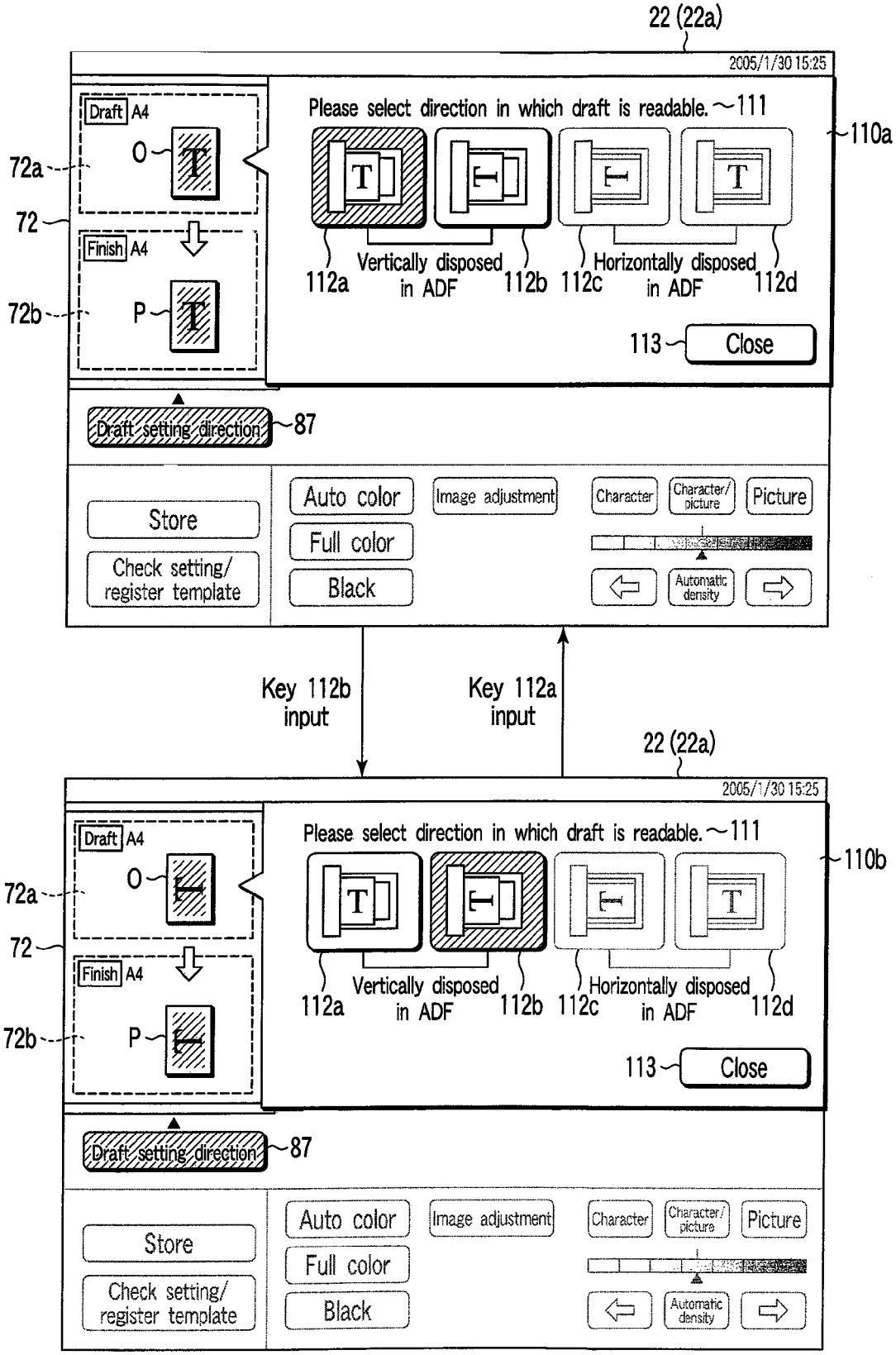
FIG. 10 is a diagram showing a display example of a draft direction setting screen in a case where a draft vertically set in an ADF is detected.
Figure 11:
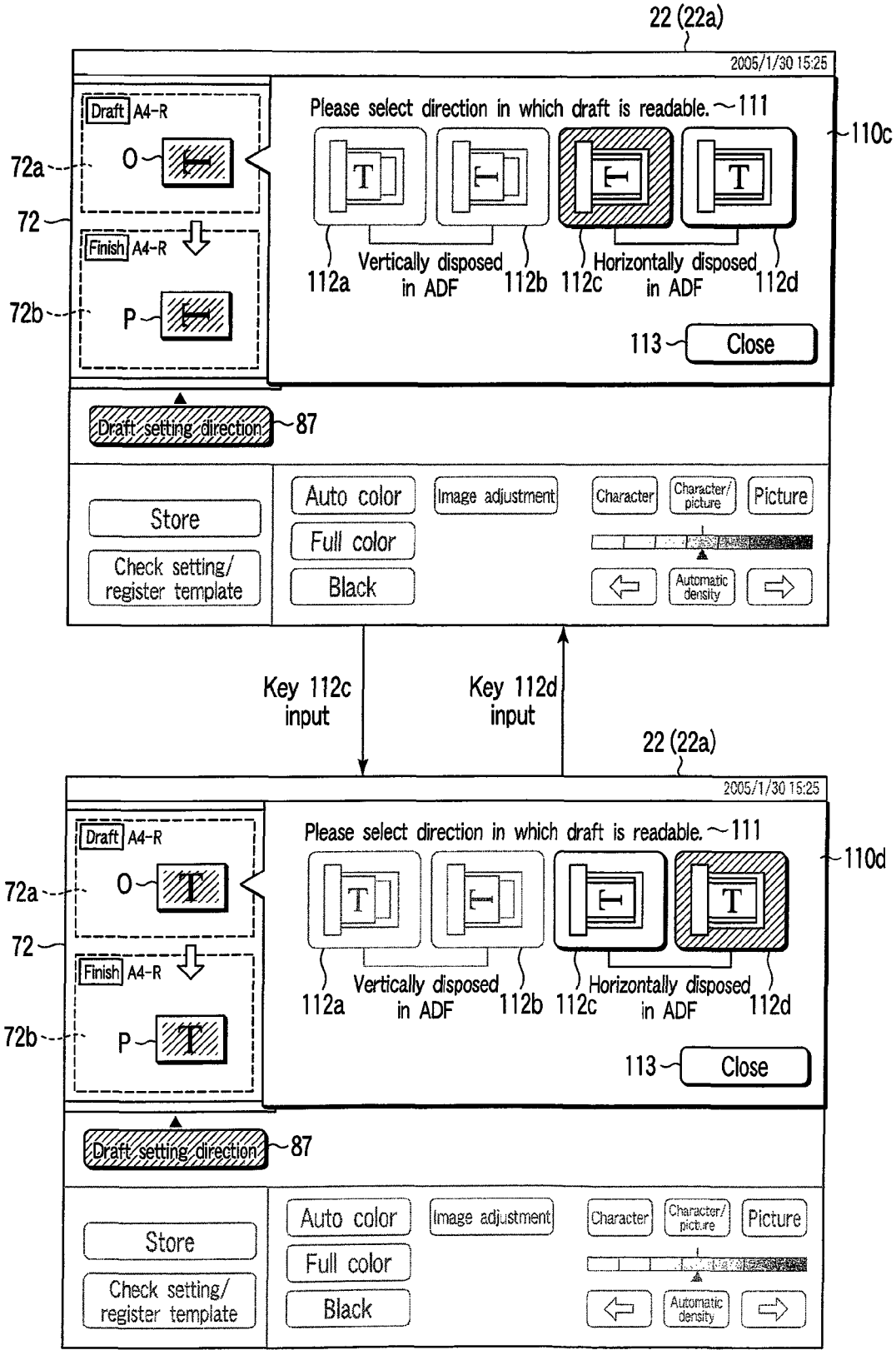
FIG. 11 is a diagram showing a display example of a draft direction setting screen in a case where a draft horizontally set in the ADF is detected.

FIGS. 10 and 11 are diagrams showing display examples of a draft direction setting screen 110 in a case where the ADF draft size detecting function is valid.

FIG. 10 is a diagram showing a display example of the draft direction setting screen 110 (110*a*, 110*b*) in a case where there is detected an A4-size draft (A4 vertically disposed draft) vertically set in the ADF 31. Here, it is assumed that the vertically disposed state means a state in which the draft is set in the ADF 31 so that the direction of the draft conveyed by the ADF 31 is perpendicular to a longitudinal direction of the draft.

Moreover, FIG. 11 is a diagram showing a display example of the draft direction setting screen 110 (110*c*, 110*d*) in a case where there is detected an A4-size draft horizontally set in the ADF 31. Here, it is assumed that the horizontally disposed state means a state in which the draft is set in the ADF 31 so that the direction of the draft conveyed by the ADF 31 is parallel to the longitudinal direction of the draft.

The draft direction setting screen 110 (110*a*, 110*b*, 110*c*, and 110*d*) is displayed as a popup window in a partial area of the basic screen 70 as shown in FIGS. 10 and 11. The draft direction setting screen 110 displays a guidance display area 111, a vertically disposed portrait key 112*a*, a vertically disposed landscape key 112*b*, a horizontally disposed portrait key 112*c*, a horizontally disposed landscape key 112*d*, and a close key 113.

Moreover, the draft direction setting screen 110 is displayed as the popup window in a state in which there are displayed the first display area 72*a*, the second display area 72*b* and the draft setting key 87 of the basic screen 70. Furthermore, the draft direction setting screen 110 is associated with the first display area 72*a* by symbols, graphics or the like. In the first display area 72*a*, the draft graphical image O is displayed in accordance with the draft setting described later. In the second display area 72*b*, the finished graphical image P is displayed in accordance with the draft setting.

It is to be noted that in the display examples shown in FIGS. 10 and 11, the sheet setting is set to the automatic sheet. Therefore, in the display examples shown in FIGS. 10 and 11, the finished graphical image P displayed in the second display area 72*b* is equivalent to the draft graphical image O displayed in the first display area 72*a*.

Moreover, in a state in which the draft direction setting screen 110 is displayed, keys, guidance displays and the like other than the first display area 72*a*, the second display area 72*b* and the draft setting key 87 in the basic screen 70 are displayed to be thin, and they are displayed in a state in which they cannot be selected (whiteout).

The guidance display area 111 displays a guidance indicating that the direction of the image in the draft be selected. The close key 113 is touched in a case where the setting is ended. When the close key 113 is touched, in the display section 22, the draft direction setting screen 110 is closed, and the basic screen 70 is displayed in which the set contents have been reflected.

As shown in FIG. 10, in a case where the draft vertically set in the ADF 31 is detected, in the draft direction setting screen 110 (110*a*, 110*b*), the vertically disposed portrait key 112*a* and the vertically disposed landscape key 112*b* are displayed in selectable states (become valid). In this case, the horizontally disposed portrait key 112*c* and the horizontally disposed landscape key 112*d* are displayed to be thin, and displayed in a state (whiteout) in which they cannot be selected.

Moreover, as shown in FIG. 11, in a case where the draft horizontally set in the ADF 31 is detected, in the draft direction setting screen 110 (110*c*, 110*d*), the horizontally disposed portrait key 112*c* and the horizontally disposed landscape key 112*d* are displayed in the selectable states (become valid). In this case, the vertically disposed portrait key 112*a* and the vertically disposed landscape key 112*b* are displayed to be thin, and displayed in a state (whiteout) in which they cannot be selected.

The vertically disposed portrait key 112*a* is a key to be selected in a case where the direction of the image in the draft vertically disposed in the ADF 31 is that of the portrait. When the vertically disposed portrait key 112*a* is touched, the draft (set in the ADF 31) is set to the vertically disposed draft of the portrait. In this case, the draft graphical image displayed in the display area 72*a* indicates the draft size and the vertically disposed draft of the portrait. For example, in the draft direction setting screen 110*a* shown in FIG. 10, when the vertically disposed portrait key 112*a* is touched, the graphical image O of an A4-size vertically disposed portrait draft is displayed in the first display area 72*a*.

The vertically disposed landscape key 112*b* is a key to be selected in a case where the direction of the image in the draft vertically disposed in the ADF 31 is that of the landscape. When the vertically disposed landscape key 112*b* is touched, the draft (set in the ADF 31) is set to the vertically disposed landscape draft. In this case, the draft graphical image displayed in the display area 72*a* indicates the draft size and the vertically disposed landscape draft. For example, in the draft direction setting screen 110*b* shown in FIG. 10, when the vertically disposed landscape key 112*b* is touched, the graphical image O of an A4-size vertically disposed landscape draft is displayed as the display example in the first display area 72*a*.

The horizontally disposed portrait key 112*c* is a key to be selected in a case where the direction of the image in the draft horizontally disposed in the ADF 31 is that of the portrait. When the horizontally disposed portrait key 112*c* is touched, the draft (set in the ADF 31) is set to the horizontally disposed portrait draft. In this case, the draft graphical image displayed in the display area 72*a* indicates the draft size and the horizontally disposed portrait draft. For example, in the draft direction setting screen 110*c* shown in FIG. 11, when the horizontally disposed portrait key 112*c* is touched, the graphical image O of an A4-size horizontally disposed portrait draft is displayed in the first display area 72*a*.

The horizontally disposed landscape key 112*d* is a key to be selected in a case where the direction of the image in the draft horizontally disposed in the ADF 31 is that of the landscape. When the horizontally disposed landscape key 112*d* is touched, the draft (set in the ADF 31) is set to the horizontally disposed landscape draft. In this case, the draft graphical image displayed in the display area 72*a* indicates the draft size and the horizontally disposed landscape draft. For example, in the draft direction setting screen 110*d* shown in FIG. 11, when the horizontally disposed landscape key 112*d* is touched, the graphical image O of an A4-size horizontally disposed landscape draft is displayed in the first display area 72*a*.

It is to be noted that as to the draft direction, the default set value may be set to that of the portrait or the landscape. For example, in a case where the default set value of the draft direction is set to that of the portrait, when the ADF draft size detecting function detects the vertically disposed draft, the draft setting is set as default setting to the vertically disposed draft of the portrait.

Next, there will be described draft setting in a case where the ADF draft size detecting function is invalid.

Figure 12:
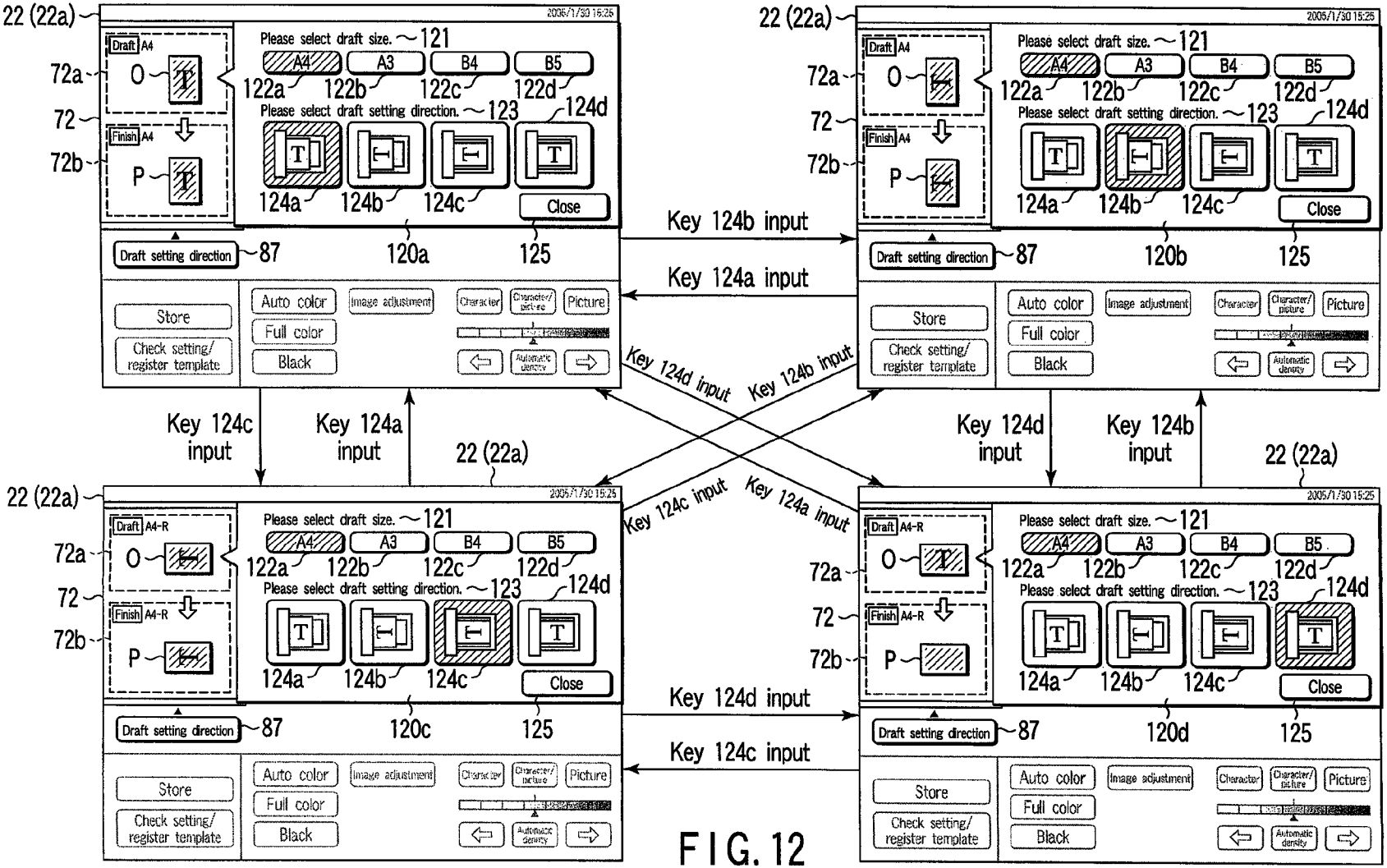
FIG. 12 is a diagram showing a display example of a draft setting screen in a case where an ADF draft size detecting function is invalid.

FIG. 12 is a diagram showing display examples of a draft direction setting screen 120 (120*a*, 120*b*, 120*c*, and 120*d*) in a case where a draft size detecting function is invalid which detects the size of the draft set in the ADF 31. When the draft size detecting function of detecting the size of the draft set in the ADF is invalid, the size and the direction of the draft set in the ADF 31 are set in the draft direction setting screens 120 (120*a*, 120*b*, 120*c*, and 120*d*) shown in FIG. 12.

As shown in FIG. 12, the draft direction setting screen 120 is displayed as a popup window in the basic screen 70. The draft direction setting screen 120 displays: a guidance display area 121; a draft size selection key 122 (an A4 key 122*a*, an A3 key 122*b*, a B4 key 122*c*, and a B5 key 122*d*); a guidance display area 123; a draft setting direction key 124 (a vertically disposed portrait key 124*a*, a vertically disposed landscape key 124*b*, a horizontally disposed portrait key 124*c*, and a horizontally disposed landscape key 124*d*); and a close key 125.

Moreover, the draft direction setting screen 120 is displayed as the popup window so that the first display area 72*a*, the second display area 72*b*, and the draft setting key 87 in the basic screen 70 remain to be displayed. Furthermore, the draft direction setting screen 120 is associated with the first display area 72*a* by graphics and the like. It is to be noted that when the draft direction setting screen 120 is displayed, the ADF draft size detecting function is invalid. Therefore, the draft setting key 87 is constituted of an icon in which "draft size/direction" is displayed.

It is to be noted that in a state in which the draft direction setting screen 120 is displayed, keys, guidance displays and the like other than the first display area 72*a*, the second display area 72*b*, and the draft setting key 87 in the basic screen 70 are displayed to be thin, and they are displayed in a state in which they cannot be selected (whiteout).

The guidance display area 121 displays a guidance indicating that the draft size be selected. The draft size selection key 122 is constituted of the A4 key 122*a*, the A3 key 122*b*, the B4 key 122*c*, and the B5 key 122*d*. The A4 key 122*a*, the A3 key 122*b*, the B4 key 122*c*, and the B5 key 122*d* are keys for selecting A4, A3, B4, and B5 as the draft sizes, respectively.

The draft setting direction key 124 is constituted of the vertically disposed portrait key 124*a*, the vertically disposed landscape key 124*b*, the horizontally disposed portrait key 124*c*, and the horizontally disposed landscape key 124*d*.

The vertically disposed portrait key 124*a* is a key to be selected in a case where the draft set in the ADF is vertically disposed, and the direction of the image in the draft is that of the portrait. When the vertically disposed portrait key 124*a* is touched, the draft (set in the ADF) is set to the vertically disposed draft of the portrait. In this case, the first display area 72*a* displays the graphical image O indicating the vertically disposed draft of the portrait. It is to be noted that as to other set contents (draft size, etc.), the first display area 72*a* displays the draft graphical image O in which the present draft setting is reflected.

The vertically disposed landscape key 124*b* is a key to be selected in a case where the draft set in the ADF is vertically disposed, and the direction of the image in the draft is that of the landscape. When the vertically disposed landscape key 124*b* is touched, the draft (set in the ADF) is set to the vertically disposed landscape draft. In this case, the first display area 72*a* displays the graphical image O indicating the vertically disposed landscape draft. It is to be noted that as to the other set contents (draft size, etc.), the first display area 72*a* displays the draft graphical image O in which the present draft setting is reflected.

The horizontally disposed portrait key 124*c* is a key to be selected in a case where the draft set in the ADF is horizontally disposed and the direction of the image in the draft is that of the portrait. When the horizontally disposed portrait key 124*c* is touched, the draft (set in the ADF) is set to the horizontally disposed portrait draft. In this case, the first display area 72*a* displays the draft graphical image O indicating the horizontal disposed portrait. It is to be noted that as to the other set contents (draft size, etc.), the first display area 72*a* displays the draft graphical image O in which the present draft setting is reflected.

The horizontally disposed landscape key 124*d* is a key to be selected in a case where the draft set in the ADF 31 is horizontally disposed and the direction of the image in the draft is that of the landscape. When the horizontally disposed landscape key 124*d* is touched, the draft (set in the ADF) is set to the horizontally disposed landscape draft. In this case, the first display area 72*a* displays the draft graphical image O indicating the horizontally disposed landscape draft, It is to be noted that as to the other set contents (draft size, etc.), the first display area 72*a* displays the draft graphical image O in which the present draft setting is reflected.

Next, there will be described a processing example of draft set processing.

Here, as the processing example of the draft set processing, there will be described the draft set processing in a case where the ADF draft size detecting function is valid.

Figure 13:
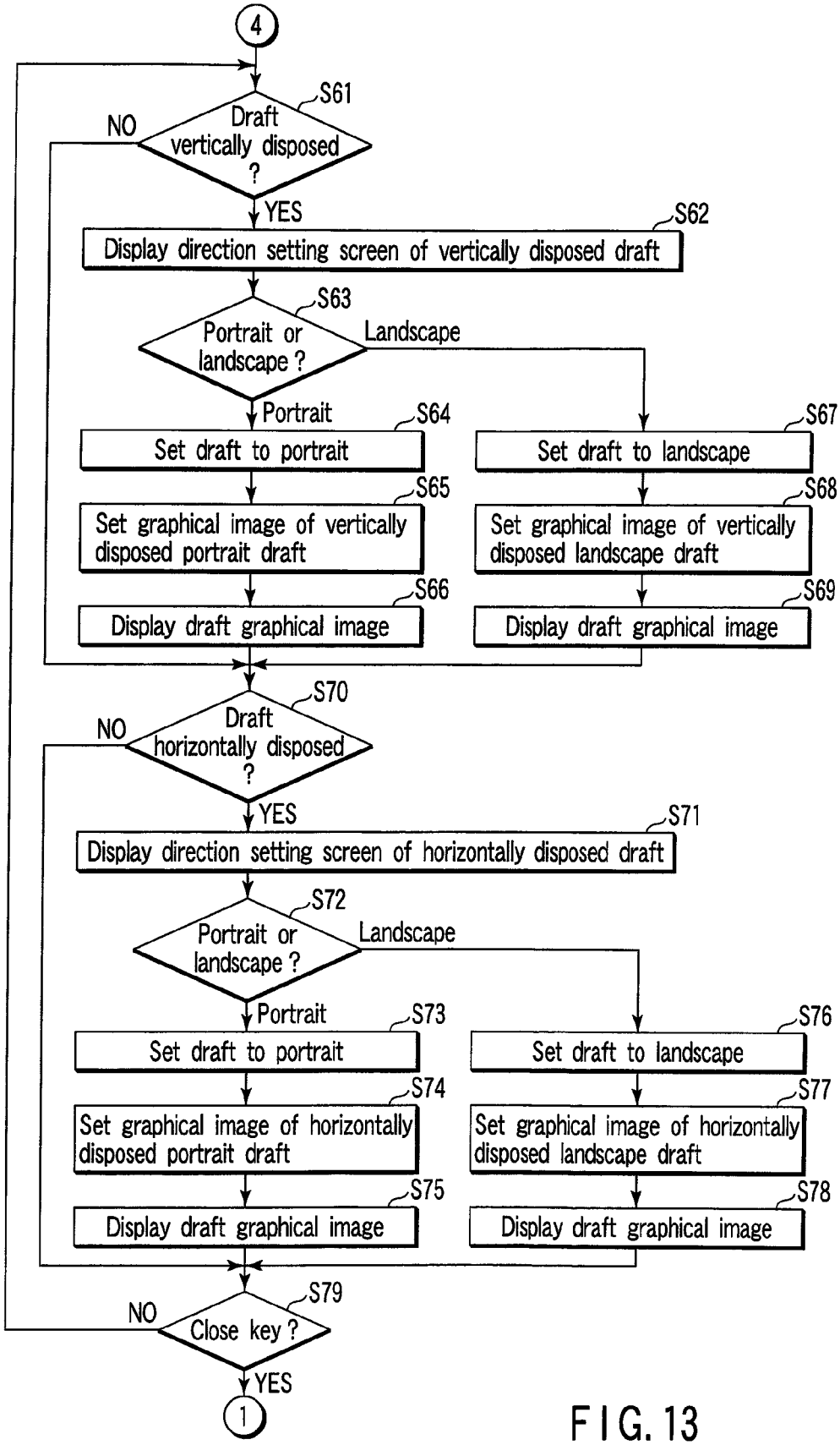
FIG. 13 is a flowchart showing a processing example of draft set processing.

FIG. 13 is a flowchart showing a processing example of the draft set processing in a state in which the draft direction setting screen 110 shown in FIG. 10 or 11 is displayed.

When the draft setting key 87 is touched in the basic screen 70, the CPU 51 of the system control unit 11 performs the draft set processing in response to user's instruction. As described above, when the ADF draft size detecting function is valid, the CPU 51 selectively displays, in the display section 22, a draft setting direction setting screen in accordance with a direction in which the draft is disposed in the ADF, which is judged by the ADF draft size detecting function.

That is, in a case where the draft setting key 87 is touched, when the ADF draft size detecting function detects the vertically disposed draft (step S61, YES), the CPU 51 displays, in the display section 22, the setting screen 110 (110*a* or 11*b*) for setting the direction of the image in the vertically disposed draft (step S62). It is to be noted that in a case where the draft setting key 87 is touched, when the draft is vertically disposed, the CPU 51 displays either the draft direction setting screen 110*a* or 11*b* based on default setting.

In a case where the portrait is selected as the direction of the image in the vertically disposed draft, that is, the user touches the vertically disposed portrait key 112*a* in the draft direction setting screen 110*a* or 110*b* (step S63, portrait), the CPU 51 sets the direction of the image in the draft to that of the portrait (step S64).

When the direction of the image in the draft is set to that of the portrait, the CPU 51 sets the graphical image corresponding to the present draft setting (step S65). In this step S65, as the draft setting, at least the draft size, the vertically disposed draft, the portrait and the like are set. Therefore, the CPU 51 sets, as the draft graphical image, a graphical image indicating at least the draft size, the vertically disposed draft, the portrait and the like. In this case, the CPU 51 displays the set graphical image as the draft graphical image O in the first display area 72*a* (step S66).

Moreover, in a case where the landscape is selected as the direction of the image in the vertically disposed draft, that is, the user touches the vertically disposed landscape key 112*b* in the draft direction setting screen 110*a* or 110*b* (step S63, landscape), the CPU 51 sets the direction of the image in the draft to that of the landscape (step S67). When the direction of the image in the draft is set to that of the landscape, the CPU 51 sets the graphical image corresponding to the draft setting (step S68).

In this step S68, as the draft setting, at least the draft size, the vertically disposed draft, the landscape and the like are set. Therefore, the CPU 51 sets, as the draft graphical image O, a graphical image indicating at least the draft size, the vertically disposed draft, the landscape and the like. In this case, the CPU 51 displays the set graphical image as the draft graphical image O in the first display area 72*a* (step S69).

Moreover, in a case where the draft setting key 87 is touched, when the ADF draft size detecting function detects the horizontally disposed draft (step S70, YES), the CPU 51 displays, in the display section 22, the setting screen 110*c* or 110*d* for setting the direction of the image in the horizontally disposed draft as shown in FIG. 11. It is to be noted that in the draft setting key 87 is touched, when the draft is horizontally disposed, the CPU 51 displays either the draft direction setting screen 110*c* or 110*d* based on default setting.

In a case where the portrait is selected as the direction of the image in the horizontally disposed draft, that is, the user touches the horizontally disposed portrait key 112*c* in the draft direction setting screen 110*c* or 110*d* (step S72, portrait), the CPU 51 sets the direction of the image in the draft to that of the portrait (step S73).

When the direction of the image in the draft is set to that of the portrait, the CPU 51 sets the graphical image corresponding to the present draft setting (step S74). In this step S74, as the draft setting, at least the draft size, the horizontally disposed draft, the portrait and the like are set. Therefore, the CPU 51 sets, as the draft graphical image O, a graphical image indicating at least the draft size, the horizontally disposed draft, and the portrait. In this case, the CPU 51 displays the set graphical image as the draft graphical image O in the first display area 72*a* (step S75).

Moreover, in a case where the landscape is selected as the direction of the image in the horizontally disposed draft, that is, the user touches the horizontally disposed landscape key 112*d* in the draft direction setting screen 110*c* or 110*d* (step S72, landscape), the CPU 51 sets the direction of the image in the draft to that of the landscape (step S76). When the direction of the image in the draft is set to that of the landscape, the CPU 51 sets the graphical image corresponding to the draft setting (step S77).

In this step S77, as the draft setting, at least the draft size, the horizontal disposed draft, the landscape and the like are set. Therefore, the CPU 51 sets, as the draft graphical image O, a graphical image indicating at least the draft size, the horizontally disposed draft, the landscape and the like. In this case, the CPU 51 displays the set graphical image as the draft graphical image O in the first display area 72*a* (step S78).

It is to be noted that the draft graphical image corresponding to the draft setting is selected from various types of graphical images stored beforehand in the HDD 55 or the like. The ADF draft size detecting function detects the draft size and the vertically or horizontally disposed draft. Therefore, the CPU 51 may select the graphical image from the HDD 55 or the like in accordance with the draft size and the direction in which the draft is disposed, and synthesize an image (character "T") indicating the image direction with the selected graphical image to set the draft graphical image O. In the display example shown in FIG. 10 or 11, the character "T" is drawn as the image indicating the direction of the image in the draft in the draft graphical image O (this also applies to the finished graphical image) In such case, the CPU 51 may synthesize the character "T" as the set image direction with the graphical image in accordance with the draft size and the setting direction to generate (set) the draft graphical image O.

The processing of the steps S61 to S78 is executed until the close key 113 is touched. That is, when the user touches the close key 113 (step S79, YES), the CPU 51 closes the draft direction setting screen 110 (110*a*, 110*b*, 110*c*, and 110*d*), and displays the basic screen 70 in which the present set contents are reflected.

Next, there will be described setting of photocopy side.

Here, the photocopy side means the surface of the draft to be read (single-sided or double-sided) and the surface of the sheet to be printed (single-sided or double-sided). That is, photocopy side set processing is processing to set the surface of the draft to be read (single-sided or double-sided) and the surface of the sheet to be printed (single-sided or double-sided).

Figure 14:
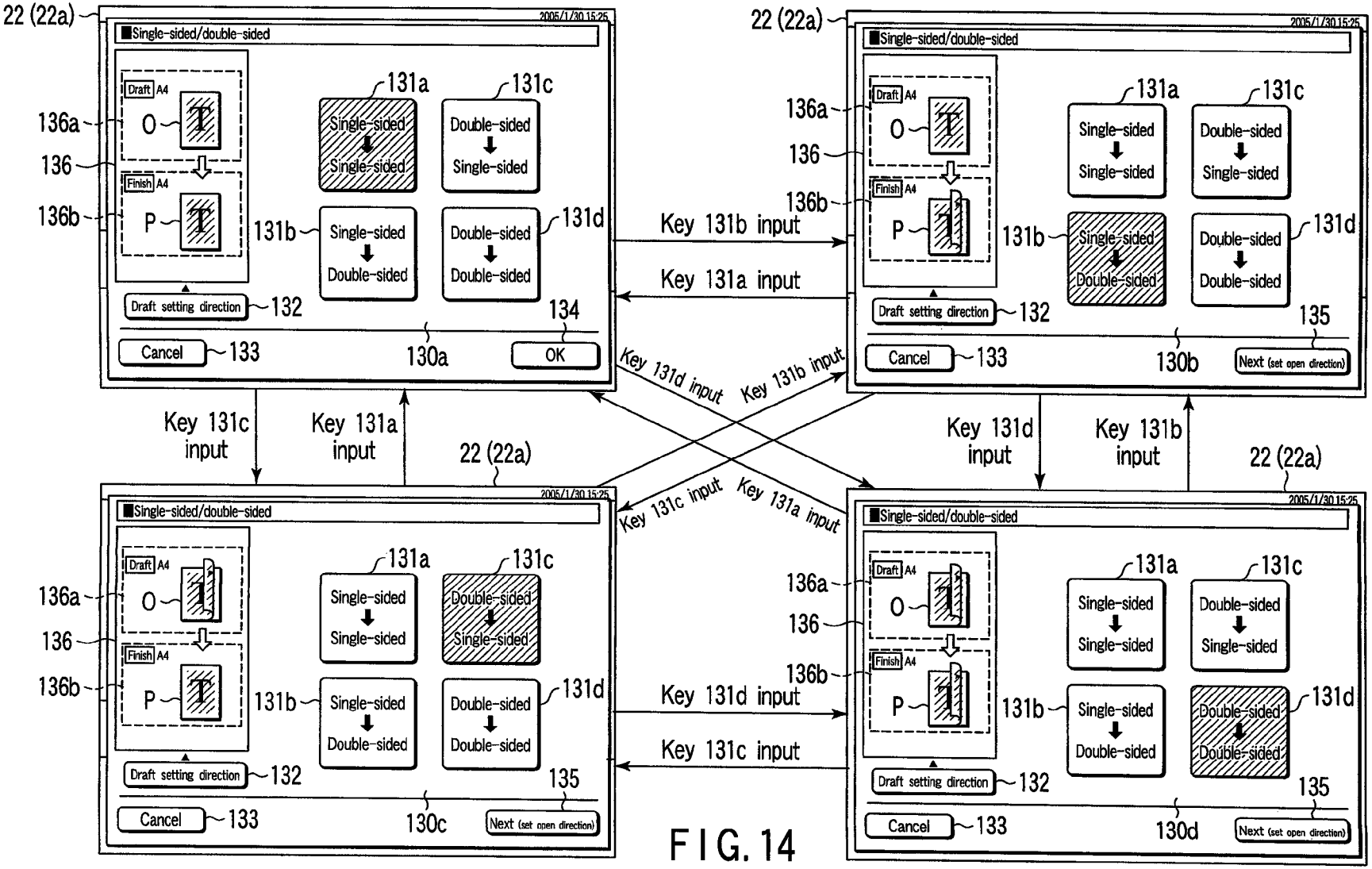
FIG. 14 is a diagram showing a display example of a photocopy side setting screen for setting a photocopy side.

FIG. 14 is a diagram showing display examples of a photocopy side setting screen 130 (130*a*, 130*b*, 130*c*, and 130*d*) for setting a photocopy side.

In the photocopy side setting screen 130, as shown in FIG. 14, there are displayed touch keys such as: a single-sided to single-sided key 131*a*; a single-sided to double-sided key 131*b*; a double-sided to single-sided key 131*c*; a double-sided to double-sided key 131*d*; a draft setting key 132; a cancel key 133; an "OK" key 134; and an open direction setting key 135. Furthermore, the photocopy side setting screen 130 is provided with a display area having a first display area 136*a* and a second display area 136*b*.

The single-sided to single-sided key 131*a* is a touch key for instructing a mode to successively photocopy an image of the single side of the draft to the single side of the sheet. The single-sided to double-sided key 131*b* is a touch key for instructing a mode to successively photocopy the image of the single side of the draft to the double sides of the sheet. The double-sided to single-sided key 131*c* is a touch key for instructing a mode to successively photocopy images of the double sides of the draft to the single side of the sheet. The double-sided to double-sided key 131*d* is a touch key for instructing a mode to successively photocopy the images of the double sides of the draft to the double sides of the sheet.

The draft setting key 132 is a key to be touched in a case where the direction of the image in the draft is set. The cancel key 133 is a key to be touched in a case where the setting of the photocopy side is stopped. The "OK" key 134 is a key to be touched in a case where the setting of the photocopy side is completed. The open direction setting key 135 is constituted of an icon in which "next (open direction setting)" is displayed. The open direction setting key 135 is a key to be touched in a case where an open direction of the double-sided draft or an open direction of the double-sided sheet is set.

It is to be noted that either the "OK" key 134 or the open direction setting key 135 is selectively displayed. That is, in a case where both of draft setting and sheet setting are single-sided setting, in the photocopy side setting screen 130, the open direction setting key 135 is not displayed, and the "OK" key 134 is displayed. When either the draft setting or the sheet setting is double-sided setting, in the photocopy side setting screen 130, the "OK" key 134 is not displayed, and the open direction setting key 135 is displayed.

The display area 136 has a constitution similar to that of the display area 72 of the basic screen 70. A position (upper left area in a screen) of the display area 136 in the photocopy side setting screen 130 is substantially similar to that (upper left area in a screen) of the display area 72 in the basic screen 70.

In the first display area 136*a*, the draft graphical image O and the like are displayed as information indicating the present draft setting in the same manner as in the first display area 72*a*. In the second display area 136*b*, the finished graphical image P and the like are displayed as information indicating the present sheet setting in the same manner as in the second display area 72*b*.

For example, when the draft is set to the single-sided draft, that is, the single-sided to single-sided key 131*a* or the single-sided to double-sided key 131*b* is selected, in the first display area 136*a*, the draft graphical image O is displayed which indicates that the draft is single-sided as shown in the photocopy side setting screen 130*a* or 130*b* of FIG. 14. When the draft is set to the double-sided draft, that is, the double-sided to single-sided key 131*c* or the double-sided to double-sided key 131*d* is selected, in the first display area 136*a*, the draft graphical image O is displayed which indicates that the draft is double-sided as shown in the photocopy side setting screen 130*c* or 130*d* of FIG. 14.

Moreover, in a case where a sheet (finish) is set to the single-sided sheet, that is, the single-sided to single-sided key 131*a* or the double-sided to single-sided key 131*c* is selected, in the second display area 136*b*, the finished graphical image P is displayed which indicates that the sheet is single-sided as shown in the photocopy side setting screen 130*a* or 130*c* of FIG. 14. In a case where the sheet (finish) is set to the double-sided sheet, that is, the single-sided to double-sided key 131*b* or the double-sided to double-sided key 131*d* is selected, in the second display area 136*b*, the finished graphical image P is displayed which indicates that the draft is double-sided as shown in the photocopy side setting screen 130*b* or 130*d* of FIG. 14.

Next, there will be described a processing example of photocopy side set processing.

Figure 15:
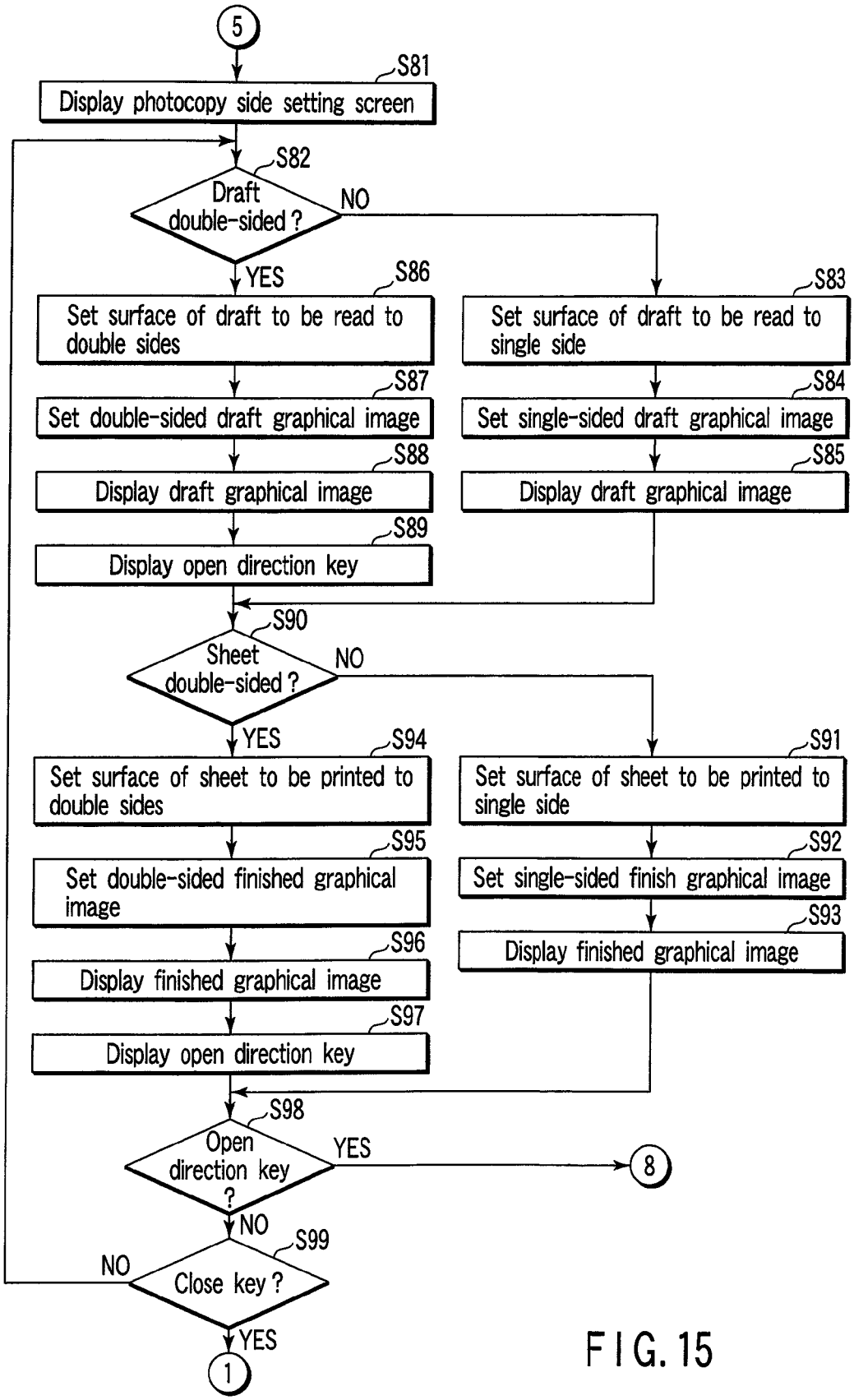
FIG. 15 is a flowchart showing a processing example of photocopy side set processing.

FIG. 15 is a flowchart showing a processing example of the photocopy side set processing in a state in which the photocopy side setting screen 130 is displayed as shown in FIG. 14.

When the photocopy side (single-sided/double-sided) key 83 is touched in the basic screen 70, the CPU 51 of the system control unit 11 displays the photocopy side setting screen 130 in the display section 22 (step S81). For example, in a case where both of the draft size and the sheet size is "A4", the display section 22 displays the photocopy side setting screen 130 (130*a*, 130*b*, 130*c*, or 130*d*) as shown in FIG. 14. In a state in which such photocopy side setting screen 130 is displayed, the CPU 51 performs the processing to set the photocopy side in response to the input into each key.

For example, when the single-sided to single-sided key 131*a* or the single-sided to double-sided key 131*b* is brought into the selected state (the user touches the single-sided to single-sided key 131*a* or the single-sided to double-sided key 131*b*), the CPU 51 judges that the single side is selected as the surface of the draft to be read (step S82, NO). When it is judged that the a single side is selected as the surface of the draft to be read, the CPU 51 sets, as the draft setting, the surface of the draft to be read to the single side (step S83). When the surface of the draft to be read is set to the single side, the CPU 51 sets the single-sided graphical image as the draft graphical image O based on the present draft setting (step S84). When the draft graphical image O is set, the CPU 51 displays the set draft graphical image O in the first display area 136*a* (step S85).

Moreover, when the double-sided to single-sided key 131*c* or the double-sided to double-sided key 131*d* is brought into the selected state (the user touches the double-sided to single-sided key 131*c* or the double-sided to double-sided key 131*d*), the CPU 51 judges that the double sides are selected as the surfaces of the draft to be read (step S82, YES). When it is judged that the double sides are selected as the surfaces of the draft to be read, the CPU 51 sets, as the draft setting, the surfaces of the draft to be read to the double sides (step S83). When the surfaces of the draft to be read are set to the double sides, the CPU 51 sets the double-sided graphical image as the draft graphical image O based on the present draft setting (step S84). When the draft graphical image O is set, the CPU 51 displays the set graphical image O in the first display area 136*a* (step S85).

Furthermore, when the double sides are set as the surfaces of the draft to be read, the CPU 51 displays the open direction setting key 135 (step S86).

Furthermore, when the single-sided to single-sided key 131*a* or the double-sided to single-sided key 131*c* is brought into the selected state (the user touches the single-sided to single-sided key 131*a* or the double-sided to single-sided key 131*c*), the CPU 51 judges that the single side is selected as the surface of the sheet to be printed (step S90, NO). When it is judged that the single side is selected as the surface of the sheet to be printed, the CPU 51 sets, as the sheet setting, the surface of the sheet to be printed to the single side (step S91). When the surface of the sheet to be printed is set to the single side, the CPU 51 sets the single-sided graphical image as the sheet graphical image P based on the present sheet setting (step S92). When the sheet graphical image is set, the CPU 51 displays the set sheet graphical image in the second display area 136*b* (step S93).

In addition, when the single-sided to double-sided key 131*b* or the double-sided to double-sided key 131*d* is brought into the selected state (the user touches the single-sided to double-sided key 131*b* or the double-sided to double-sided key 131*d*), the CPU 51 judges that the double sides are selected as the surfaces of the sheet to be printed (step S90, YES). When it is judged that the double sides are selected as the surfaces of the sheet to be printed, the CPU 51 sets, as the sheet setting, the surface of the sheet to be printed to be double-sided (step S94). When the surface of the sheet to be printed is set to be double-sided, the CPU 51 sets the double-sided graphical image as the sheet graphical image P based on the present sheet setting (step S95). When the sheet graphical image is set, the CPU 51 displays the set sheet graphical image P in the second display area 136*b* (step S96). Furthermore, when the surface of the sheet to be printed is set to be double-sided, the CPU 51 displays the open direction setting key 135 (step S97).

Moreover, when the open direction setting key 135 displayed in the step S89 or S97 is touched (step S98, YES), the CPU 51 performs the open direction set processing described later. When the cancel key 133 is touched, the CPU 51 closes the photocopy side setting screen to end the photocopy side set processing, and displays the basic screen 70 in the display section 22.

Next, there will be described open direction set processing.

Figure 16:
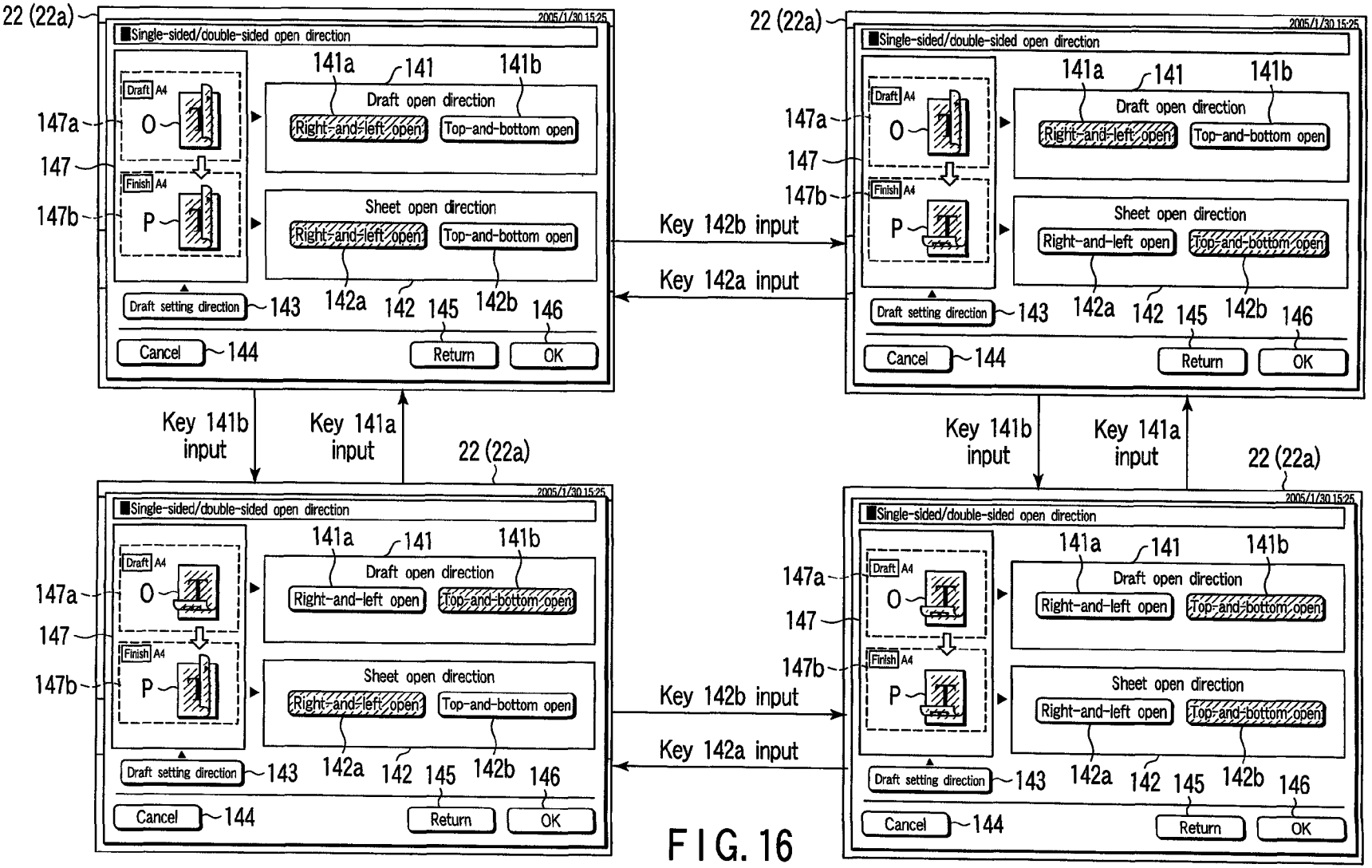
FIG. 16 is a diagram showing a display example of an open direction setting screen for setting an open direction.

FIG. 16 is a diagram showing display examples of an open direction setting screen 140 (140*a*, 140*b*, 140*c*, and 140*d*) for setting an open direction. FIG. 16 shows display examples of the open direction setting screens 140*a*, 140*b*, 140*c*, and 140*d* displayed in the display section 22 in a case where the double sides are set as the surfaces of the draft to be read and as the surfaces of the sheet to be printed. It is to be noted that in the display example shown in FIG. 16, the draft setting is an A4 vertical draft, and the sheet setting is an A4 vertical sheet.

In the display example shown in FIG. 16, the open direction setting screen 140 displays: a draft open direction setting portion 141; a sheet open direction setting portion 142; a draft setting key 143; a cancel key 144; a "return" key 145; an "OK" key 146; a display area 147 and the like.

The draft open direction setting portion 141 is a display area for setting the open direction of the draft which is set to be double-sided. Therefore, the draft open direction setting portion 141 is displayed only in a case where the draft is set to be double-sided. That is, when the draft is set to be single-sided and the sheet is set to be double-sided, the draft open direction setting portion 141 is not displayed. The draft open direction setting portion 141 displays a right-and-left open key 141*a* and a top-and-bottom open key 141*b* together with a guidance "draft open direction". Furthermore, the open direction setting screen 140 displays the draft open direction setting portion 141 which is associated with a first display area 147*a* where the draft graphical image O is displayed.

The sheet open direction setting portion 142 is a display area for setting an open direction of a sheet which is set to be double-sided. The sheet open direction setting portion 142 is displayed only in a case where the sheet is set to be double-sided. That is, when the draft is set to be double-sided and the sheet is set to be single-sided, the sheet open direction setting portion 142 is not displayed. The sheet open direction setting portion 142 displays a right-and-left open key 142*a* and a top-and-bottom open key 142*b* together with a guidance "sheet open direction". Furthermore, the open direction setting screen 140 displays the sheet open direction setting portion 142 which is associated with a second display area 147*b* where the finished (sheet) graphical image P is displayed.

The draft setting key 143 is a key to be touched in a case where the direction of the image in the draft is set in the same manner as in the draft setting key 87. The cancel key 144 is a key to be touched in a case where the setting of the photocopy side is stopped. The "return" key 145 is a key to be touched in returning to the photocopy side setting screen 130. The "OK" key 146 is a key to be touched in completing the setting of the photocopy side.

The display area 147 has a constitution similar to that of the display area 136 (or the first display area 72*a*). The first display area 147*a* displays the draft graphical image O and the like as information indicating the present draft setting in the same manner as in the first display area 136*a* (or the first display area 72*a*). The second display area 147*b* displays the finished graphical image P and the like as information indicating the present sheet setting in the same manner as in the second display area 136*b* (or the second display area 72*b*).

For example, in a case where the draft open direction is set to a right-and-left open direction, that is, the right-and-left open key 141*a* is selected, the first display area 147*a* displays the draft graphical image O indicating that the draft is right-and-left open and double-sided as shown in the open direction setting screen 140*a* or 140*b* of FIG. 16. When the draft open direction is set to a top-and-bottom open direction, that is, the top-and-bottom open key 141*b* is selected, the first display area 147*a* displays the draft graphical image O indicating that the draft is top-and-bottom open and double-sided as shown in the open direction setting screen 140*c* or 140*d* of FIG. 16.

Moreover, when the sheet (finish) open direction is set to a right-and-left open direction, that is, the right-and-left open key 142*a* is selected, the second display area 147*b* displays the finished graphical image P indicating that the sheet is right-and-left open and double-sided as shown in the open direction setting screen 140*a* or 140*b* of FIG. 16. When the sheet (finish) open direction is set to a top-and-bottom open direction, that is, the top-and-bottom open key 142*b* is selected, the second display area 147*b* displays the finished graphical image P indicating that the sheet is top-and-bottom open and double-sided as shown in the open direction setting screen 140*b* or 140*d* of FIG. 16.

Next, there will be described a processing example of open direction set processing.

Figure 17:
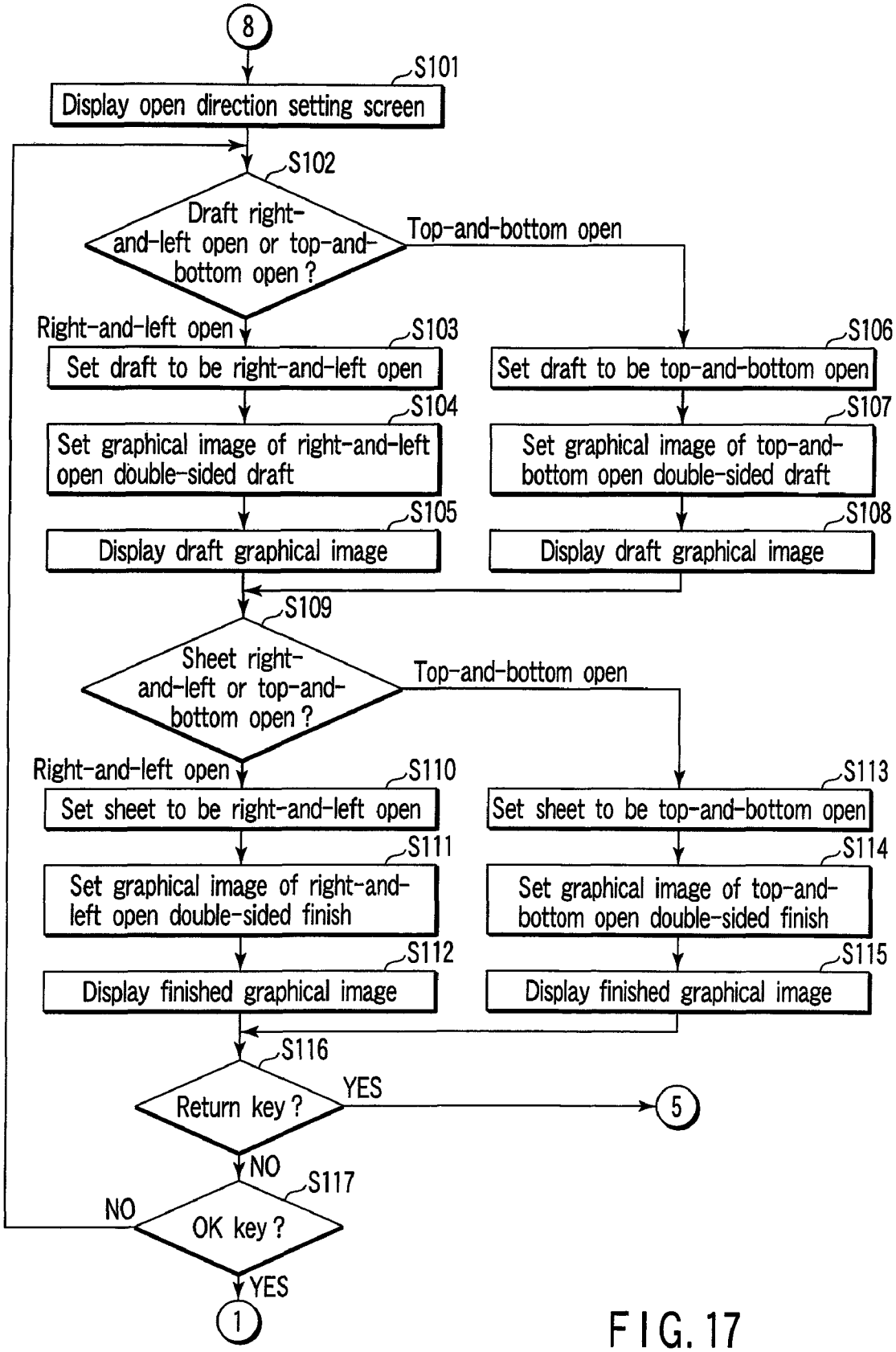
FIG. 17 is a flowchart showing a processing example of open direction set processing.

FIG. 17 is a flowchart showing a processing example of the open direction set processing in a state in which the open direction setting screen 140 is displayed as shown in FIG. 16.

When the open direction setting key 135 is touched in the photocopy side setting screen 130, the CPU 51 of the system control unit 11 displays the open direction setting screen 140 in the display section 22 (step S101). For example, when both of the draft and the sheet are set to "A4, vertical, and double-sided" (the double-sided to double-sided key 131*d* is selected in the photocopy side setting screen 130), the display section 22 displays the open direction setting screen 140 (140*a*, 140*b*, 140*c*, or 140*d*) as shown in FIG. 16. In such state in which the open direction setting screen 140 is displayed, the CPU 51 sets the open direction of the draft or the sheet in response to an input into each key.

For example, when the right-and-left open key 141*a* is brought into a selected state (the user touches the right-and-left open key 141*a*), the CPU 51 judges that the draft open direction is designated as the right-and-left open direction (step S102, right-and-left open). When it is judged that the right-and-left open direction is selected as the draft open direction, the CPU 51 sets the draft open direction to the right-and-left open direction as the draft setting (step S103). When the draft open direction is set to the right-and-left open direction, the CPU 51 sets a right-and-left open and double-sided graphical image as the draft graphical image O based on the present draft setting (step S104). When the draft graphical image O is set, the CPU 51 displays the set draft graphical image O in the first display area 147*a* (step S105).

Moreover, when the top-and-bottom open key 141*b* is brought into the selected state (the user touches the top-and-bottom open key 141*b*), the CPU 51 judges that the draft open direction is designated as the top-and-bottom open direction (step S102, top-and-bottom open). When it is judged that the top-and-bottom open direction is selected as the draft open direction, the CPU 51 sets the draft open direction to the top-and-bottom open direction as the draft setting (step S106). When the draft open direction is set to the top-and-bottom open direction, the CPU 51 sets a top-and-bottom open and double-sided graphical image as the draft graphical image O based on the present draft setting (step S107). When the draft graphical image O is set, the CPU 51 displays the set draft graphical image O in the first display area 147*a* (step S108).

For example, when the right-and-left open key 142*a* is brought into the selected state (the user touches the right-and-left open key 142*a*), the CPU 51 judges that the sheet open direction is designated as the right-and-left open direction (step S109, right-and-left open). When it is judged that the right-and-left open direction is selected as the sheet open direction, the CPU 51 sets the sheet open direction to the right-and-left open direction as the sheet setting (step S110). When the sheet open direction is set to the right-and-left open direction, the CPU 51 sets a right-and-left open and double-sided graphical image as the finish (sheet) graphical image P based on the present sheet setting (step S111). When the finished graphical image P is set, the CPU 51 displays the set finished graphical image P in the second display area 147*b* (step S112).

Moreover, when the top-and-bottom open key 142*b* is brought into the selected state (the user touches the top-and-bottom open key 142*b*), the CPU 51 judges that the sheet open direction is designated as the top-and-bottom open direction (step S109, top-and-bottom open). When it is judged that the top-and-bottom open direction is selected as the sheet open direction, the CPU 51 sets the finish open direction to the top-and-bottom open direction as the sheet setting (step S113). When the sheet open direction is set to the top-and-bottom open direction, the CPU 51 sets a top-and-bottom open and double-sided graphical image as the finish (sheet) graphical image P based on the present sheet setting (step S114). When the finish (sheet) graphical image P is set, the CPU 51 displays the set finished graphical image P in the second display area 147*b* (step S115).

Furthermore, when the user touches the return key 145 (step S116, YES), the CPU 51 closes the open direction setting screen 140, and returns to the step S81. In this case, the display section 22 displays the photocopy side setting screen 130 in which the set open direction is reflected. When the user touches the OK key 146 (step S117, YES), the CPU 51 closes the open direction setting screen, and completes the open direction set processing and the photocopy side set processing. In this case, the display section 22 displays the basic screen 70 in which the photocopy side setting and the open direction setting are reflected.

Next, there will be described staple set processing as one of the finishing functions.

Figure 18:
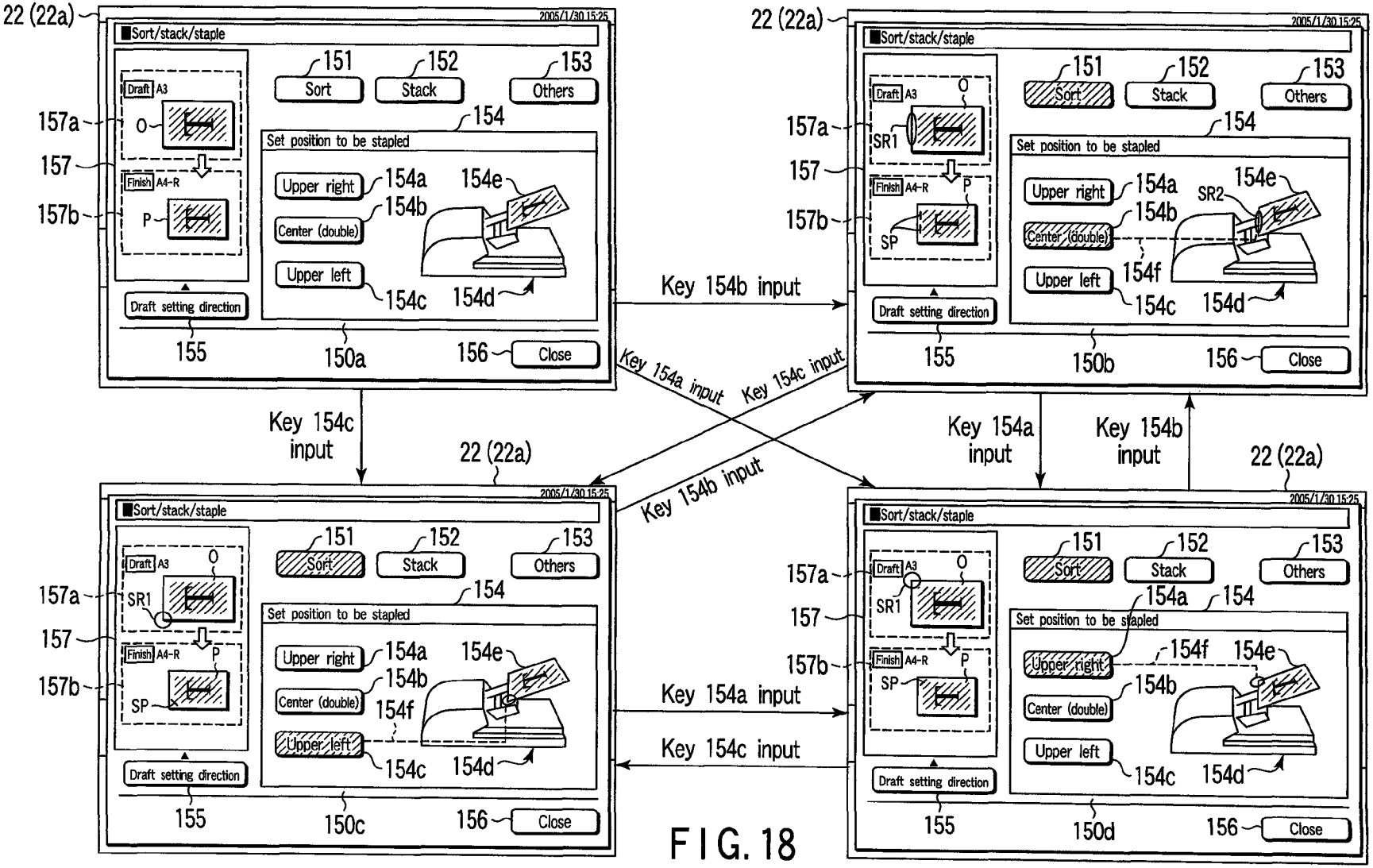
FIG. 18 is a diagram showing a display example of a finishing setting screen for performing a finishing function setting including a staple setting.
Figure 19:
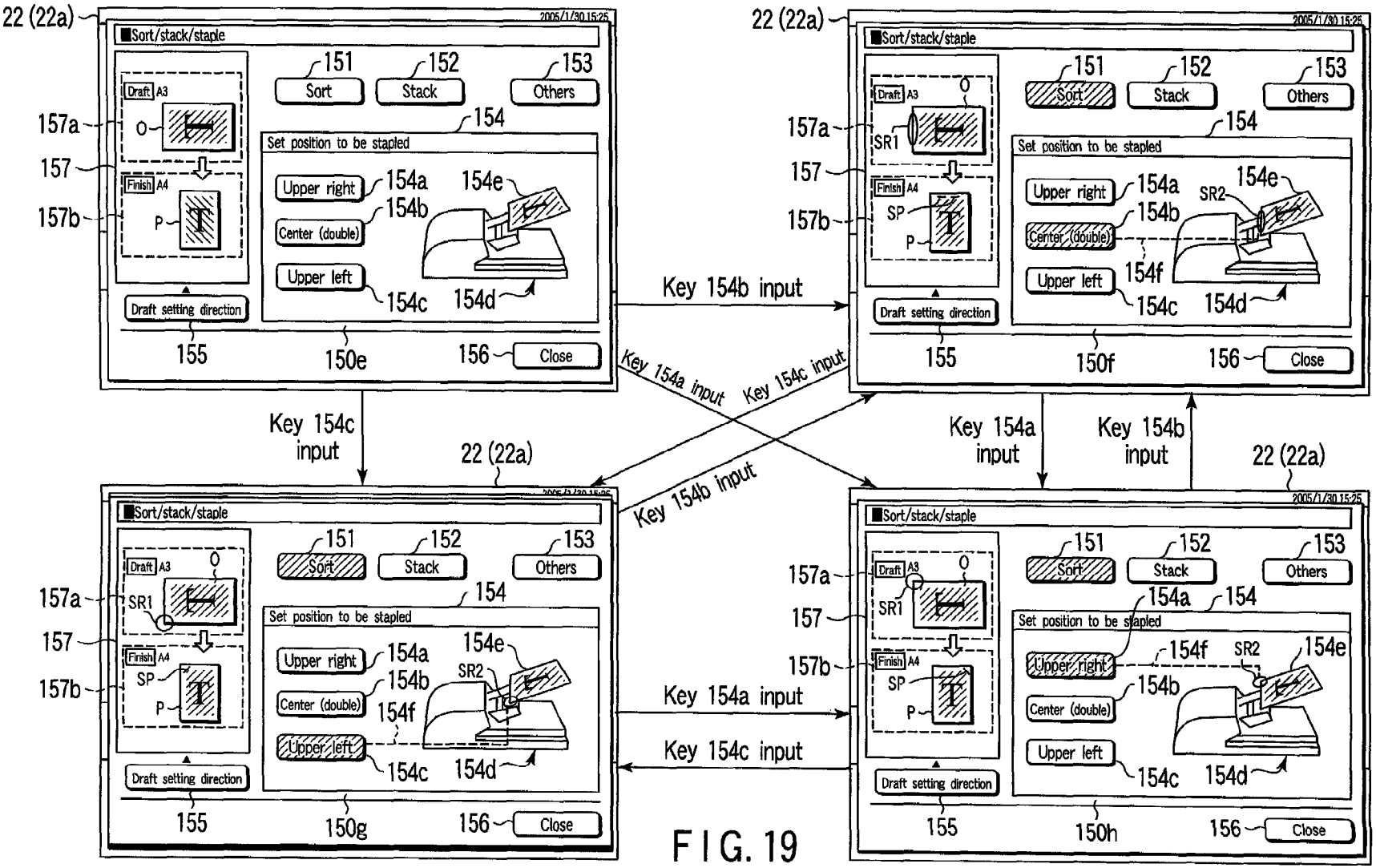
FIG. 19 is a diagram showing a display example of the finishing setting screen for performing the finishing function setting including the staple setting.

FIG. 18 is a diagram showing display examples of a finishing setting screen 150 (150*a*, 150*b*, 150*c*, and 150*d*) for performing a finishing function setting including a staple setting. FIG. 19 is a diagram showing a display example of the finishing setting screen 150 (150*e*, 150*f*, 150*g*, and 150*h*) for performing the finishing function setting including the staple setting. FIG. 18 shows display examples of the finishing setting screens 150*a*, 150*b*, 150*c*, and 150*d* displayed in the display section 22 in a case where the draft setting is "A3, horizontal, and single-sided", and the sheet setting is "A4, horizontal, and single-sided". FIG. 19 shows display examples of the finishing setting screens 150*e*, 150*f*, 150*g*, and 150*h* displayed in the display section 22 in a case where the draft setting is "A3, horizontal, and single-sided", and the sheet setting is "A4, vertical, and single-sided".

In the display examples shown in FIGS. 18 and 19, the finishing setting screen 150 displays: a sort key 151; a stack key 152; another key 153; a staple position setting portion (staple position setting screen) 154; a draft setting key 155; a "close" key 156; a display area 157 and the like.

The sort key 151 is a key to be touched in setting a sorting function. The stack key 152 is a key to be touched in setting a stacking function. The other key 153 is a key to be touched in setting another finishing function. The draft setting key 155 is a key to be touched in setting a direction of an image in the draft in the same manner as in the draft setting key 87. The close key 156 is a key to be touched in completing the finishing setting (completing the setting of the position to be stapled).

The staple position setting portion 154 is a display area for setting the position to be stapled.

The staple position setting portion 154 displays an upper right key 154*a*, a center (double) key 154*b*, and an upper left key 154*c* together with a guidance "staple position setting". Furthermore, the staple position setting portion 154 displays an ADF graphical image 154*d*, a draft graphical image 154*e*, a staple region mark SR2, and a dot line 154*f*.

The upper right key 154*a*, the center (double) key 154*b*, and the upper left key 154*c* are setting keys for setting the position to be stapled. The upper right key 154*a* is a key to be touched in setting the vicinity of upper right to the position to be stapled with respect to the direction of the image in the sheet.

The center (double) key 154*b* is a key to be touched in setting the vicinity of the center of an upper part of the sheet to the position to be stapled with respect to the direction of the image in the sheet. The center key 154*b* sets two portions to be stapled in the vicinity of the center of the upper part of the sheet with respect to the direction of the image in the sheet. The upper left key 154*c* is a key to be touched in setting the vicinity of upper left to the position to be stapled with respect to the direction of the image in the sheet.

The ADF graphical image 154*d* displays a graphical image of the ADF 31. The draft graphical image 154*e* shows a state of the draft set on the ADF 31. The draft graphical image 154*e* is superimposed and displayed on the ADF graphical image 154*d*. Accordingly, the staple position setting portion 154 displays a state of the draft set on the ADF 31. The staple region mark SR2 indicates a region corresponding to the position to be stapled in the draft. The staple region mark SR2 is superimposed and displayed on the draft graphical image 154*e*. The dot line 154*f* shows an association of the staple region mark SR2 with the staple position setting key (154*a*, 154*b*, or 154*c*). The dot line 154*f* is displayed to connect the selected staple position setting key to the staple region mark SR2.

It is to be noted that the position to be stapled is set in accordance with a position which can be stapled by the stapler 41. Therefore, the staple position setting portion 154 of the finishing setting screen 150 is designed in accordance with the position which can be stapled by the stapler 41. For example, when the stapler 41 can staple the upper right, the center, and the upper left, the finishing setting screen 150 is designed as shown in FIGS. 18 and 19. In other words, in the finishing setting screen, the staple position setting portion 154 displays the staple position setting key in accordance with the function of the stapler 41.

The display area 157 has a constitution similar to that of the display area 72. A first display area 157*a* displays the draft graphical image O and the like as information indicating the present draft setting in the same manner as in the first display area 72*a*. A second display area 157*b* displays the finished graphical image P as information indicating the present sheet setting in the same manner as in the second display area 72*b*.

Furthermore, when the position to be stapled is set in the staple position setting portion 154, the positions to be stapled are displayed in the draft graphical image O and the finished graphical image P as shown in the finishing setting screen 150*b*, 150*c*, or 150*d* of FIG. 18, or the finishing setting screen 150*f*, 150*g*, or 150*h* of FIG. 19. A staple region mark SR1 indicating a region corresponding to the position to be stapled is superimposed and displayed on the draft graphical image O displayed in the first display area 157*a*. A staple position mark SP indicating the position to be stapled is superimposed and displayed on the finished graphical image P displayed in the second display area 157*b*.

Next, there will be described a display example in accordance with a set state of the position to be stapled.

First, there will be described a case where the position to be stapled is set to the center, that is, the center key 154*b* is selected.

When the position to be stapled is set to the center (the center key 154*b* is selected), the staple region mark SR1 indicating the region corresponding to the position to be stapled in the draft is superimposed and displayed on the vicinity of the center of the upper part of the draft graphical image O with respect to the image direction as shown in the finishing setting screen 150*b* of FIG. 18 or the finishing setting screen 150*f* of FIG. 19.

Moreover, when the position to be stapled is set to the center (the center key 154*b* is selected), the staple position mark SP indicating the position to be stapled in the sheet is superimposed and displayed on the vicinity of the center of the upper part of the finished graphical image P with respect to the image direction as shown in the finishing setting screen 150*b* of FIG. 18 or the finishing setting screen 150*f* of FIG. 19.

Furthermore, when the position to be stapled is set to the center (the center key 154*b* is selected), the staple region mark SR2 indicating a region corresponding to the position to be stapled in the draft is superimposed and displayed on the vicinity of the center of the upper part of the draft graphical image 154*e* with respect to the image direction as shown in the finishing setting screen 150*b* of FIG. 18 or the finishing setting screen 150*f* of FIG. 19. Furthermore, the dot line 154*f* is displayed to connect the center key 154*b* to the staple region mark SR2 by the dot line.

Next, there will be described a case where the position to be stapled is set to the upper left, that is, the upper left key 154*c* is selected.

When the position to be stapled is set to the upper left (the upper left key 154*c* is selected), the staple region mark SR1 indicating the region corresponding to the position to be stapled in the draft is superimposed and displayed on the vicinity of the upper left of the draft graphical image O with respect to the image direction as shown in the finishing setting screen 150*c* of FIG. 18 or the finishing setting screen 150*g* of FIG. 19.

When the position to be stapled is set to the upper left (the upper left key 154*c* is selected), the staple position mark SP indicating the position to be stapled in the sheet is superimposed and displayed on the vicinity of the upper left of the finished graphical image P with respect to the image direction as shown in the finishing setting screen 150*c* of FIG. 18 or the finishing setting screen 150*g* of FIG. 19.

Moreover, when the position to be stapled is set to the upper left (the upper left key 154*c* is selected), the staple region mark SR2 indicating a region corresponding to the position to be stapled in the draft is superimposed and displayed on the vicinity of the upper left of the draft graphical image 154*e* with respect to the image direction as shown in the finishing setting screen 150*c* of FIG. 18 or the finishing setting screen 150*g* of FIG. 19. Furthermore, the dot line 154*f* is disposed to connect the upper left key 154*c* to the staple region mark SR2 by the dot line.

Next, there will be described a case where the position to be stapled is set to the upper right, that is, the upper right key 154*a* is selected.

When the position to be stapled is set to the upper right (the upper right key 154*a* is selected), the staple region mark SR1 indicating the region corresponding to the position to be stapled in the draft is superimposed and displayed on the vicinity of the upper right of the draft graphical image O with respect to the image direction as shown in the finishing setting screen 150*d* of FIG. 18 or the finishing setting screen 150*h* of FIG. 19. Furthermore, when the position to be stapled is set to the upper right, that is, the upper right key 154*a* is selected, the staple position mark SP indicating the position to be stapled in the sheet is superimposed and displayed on the vicinity of the upper right of the finished graphical image P with respect to the image direction as shown in the finishing setting screen 150*d* of FIG. 18 or the finishing setting screen 150*h* of FIG. 19.

When the position to be stapled is set to the upper right (the upper right key 154*a* is selected), the staple region mark SR1 indicating the region corresponding to the position to be stapled in the draft is superimposed and displayed on the vicinity of the upper right of the draft graphical image O with respect to the image direction as shown in the finishing setting screen 150*d* of FIG. 18 or the finishing setting screen 150*h* of FIG. 19.

Moreover, when the position to be stapled is set to the upper right (the upper right key 154*a* is selected), in the staple position setting portion 154, the staple region mark SR2 indicating the region corresponding to the position to be stapled in the draft is superimposed and displayed on the vicinity of the upper right of the draft graphical image 154*e* with respect to the image direction as shown in the finishing setting screen 150*d* of FIG. 18 or the finishing setting screen 150*h* of FIG. 19. Furthermore, the dot line 154*f* is disposed to connect the upper right key 154*a* to the staple region mark SR2 by the dot line.

In the above-described finishing setting screen, the marks indicating the positions to be stapled are displayed on the draft graphical image and the sheet graphical image. Furthermore, the mark is displayed even on the graphical image of the draft which is set in the ADF. Accordingly, the user can visually and intuitively recognize the position to be stapled, and the position to be stapled can be set as imaged.

Next, there will be described a display example of a case where the staple position setting is contradictory to the sheet setting.

As described above, the position to be stapled is set in accordance with contents instructed by the user in the finishing setting screen. The sheet (finish) double-sided setting or the open direction in the double-sided setting is also set in accordance with the contents instructed by the user. Therefore, instruction contents concerning the staple position setting might be contradictory to those concerning the sheet setting.

For example, when the positions to be stapled are set to two central portions, and the finish is the double-sided and right-and-left: open sheet, the sheets (finish) stapled by two central portions cannot be opened on either side. In this case, usually, there is a high possibility that the set contents of the position to be stapled or the open direction are wrong. However, there might be a case where the user especially intentionally performs a setting such that the position to be stapled is contradictory to the open direction as described above. Therefore, it is not preferable for the digital multifunction peripherals 1 to automatically change the set contents designated by the user. In the digital multifunction peripherals 1, in a case where the position to be stapled and the open direction are set to be contradictory to each other, a guidance is displayed which urges the user to change the setting of the position to be stapled or the open direction.

Next, there will be described an example of a guidance to be displayed in a case where the staple position setting is contradictory to the finish open direction setting.

Figure 20:
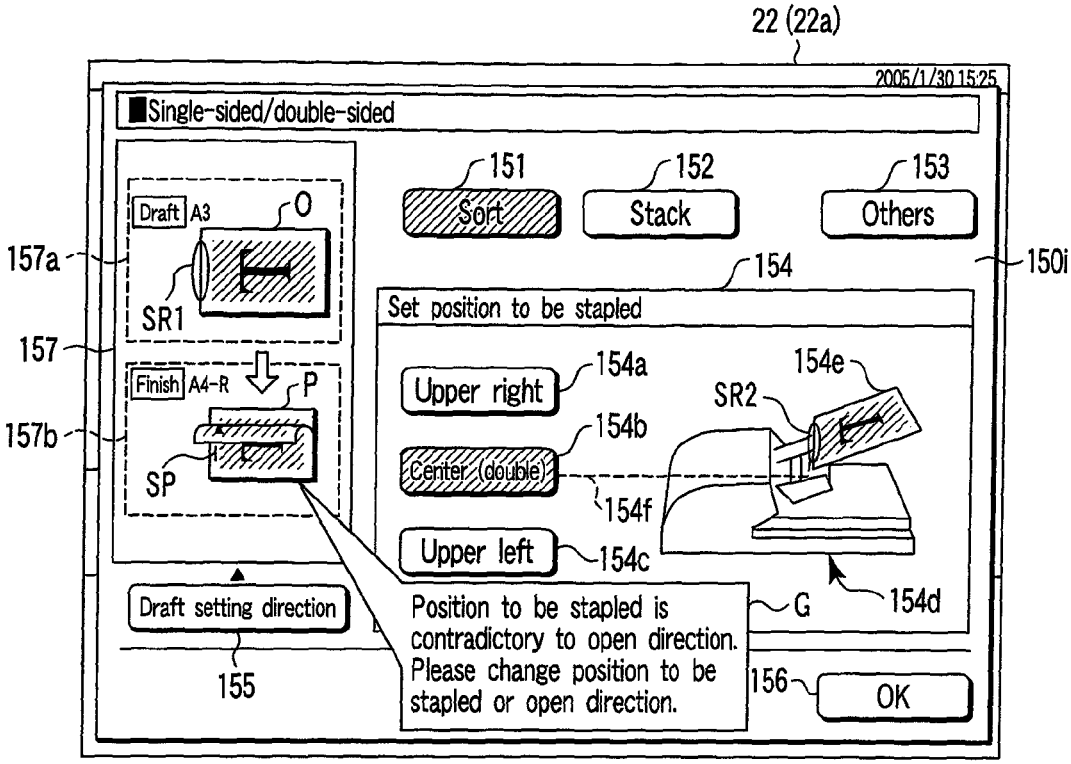
FIG. 20 is a diagram showing a display example of the finishing setting screen.

FIG. 20 shows a display example of the finishing setting screen 150*i*. In the finishing setting screen 150*i* shown in FIG. 20, a guidance display portion G displays a message indicating that the user instructed staple position is contradictory to the finish set contents.

In the example shown in FIG. 20, the finish is set to the double-sided and right-and-left open finish, and the positions to be stapled are set to two central portions as shown by the finished graphical image P.

That is, in a case where the user selects the center key 154*b* of the finishing setting screen in a state in which the finish is set to the double-sided and right-and-left open finish, as described above, the set contents (the positions to be stapled are two central portions) of the staple position are contradictory to those (double-sided and right-and-left open finish) of the finish. Therefore, in the display section 22, the guidance display portion G displays a message indicating that the position to be stapled is contradictory to the open direction.

The guidance display portion G is associated and displayed with the finished graphical image P indicating the finish setting. The guidance display portion G is displayed as a popup screen in the finishing setting screen 150*i*. Accordingly, the user can easily identify the guidance concerning the finish setting.

As the message displayed in the guidance display portion G, there is displayed a guiding message to the effect that the set contents of the position to be stapled are contradictory to those of the open direction. The message displayed in the guidance display portion G may be specifically guide the set contents to be changed. For example, in the finishing setting screen shown in FIG. 20, a guidance to change the position to be stapled to the left or the right may be displayed as a message in order to urge the change of the position to be stapled.

Figure 21:
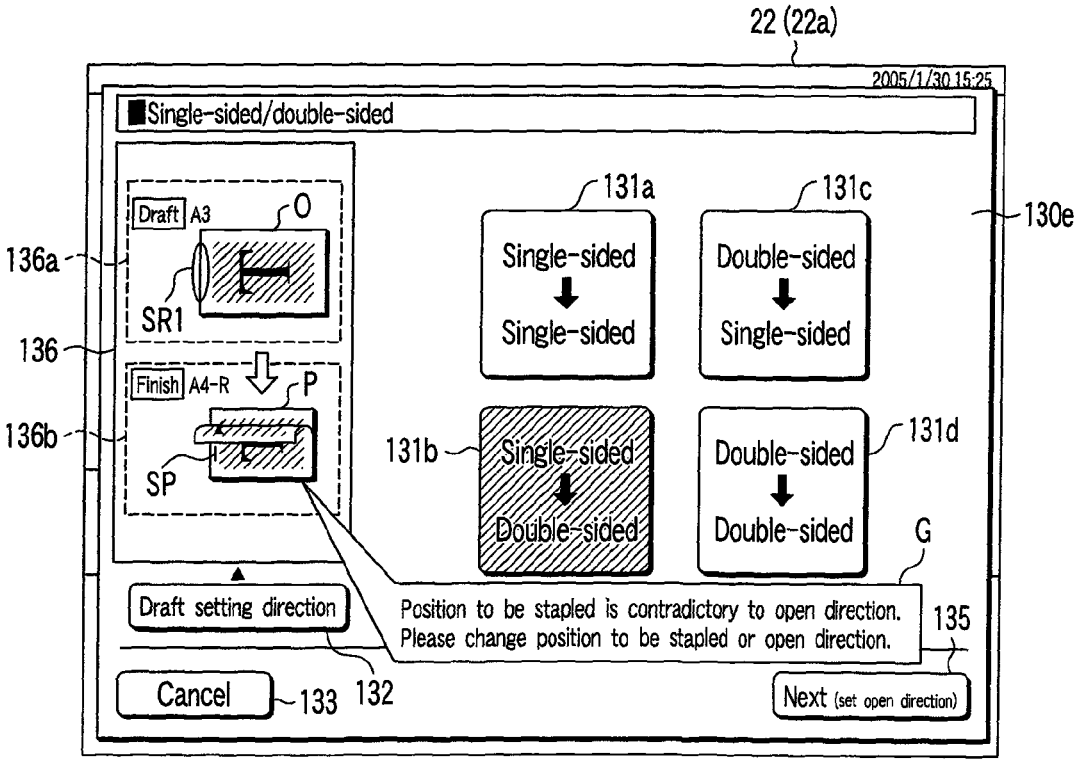
FIG. 21 is a diagram showing a display example of a photocopy side (single-sided/double-sided) setting screen.

FIG. 21 shows a display example of a photocopy side (single-sided/double-sided) setting screen 130*e*. In the photocopy side setting screen 130*e* shown in FIG. 21, the guidance display portion G displays a message to the effect that the setting of the finish instructed by the user is contradictory to the set contents of the position to be stapled.

In the example shown in FIG. 21, as shown by the finished graphical image P, the finish is set to the double-sided and right-and-left open finish, and the positions to be stapled are set to two central portions.

That is, in a case where the user indicates a single-sided to double-sided key 131*b* (or a double-sided to double-sided key 131*d*) in the photocopy side setting screen 130 in a state in which the positions to be stapled are set to two central portions, the set contents indicate that the setting (the positions to be stapled are two central portions) of the position to be stapled is contradictory to the finish setting (the finish is double-sided and right-and-left open). Therefore, in the photocopy side setting screen 130*e*, as shown in FIG. 21, a guidance display portion G displays a message indicating that the position to be stapled is contradictory to the open direction. It is to be noted that here, as default setting with respect to the double-sided finish setting, it is assumed that the open direction is set to the right-and-left open direction (i.e., in a case where the double-sided finish is designated, the finish is set to be double-sided and right-and-left open).

Moreover, the guidance display portion G is displayed as a popup screen associated with the finished graphical image P in the photocopy side setting screen. As the message displayed in the guidance display portion G, there may be displayed, in the photocopy side setting screen shown in FIG. 21, a guidance to change the double-sided setting to single-sided setting and change the open direction to a top-and-bottom direction, for example, in order to urge the change of the open direction.

Figure 22:
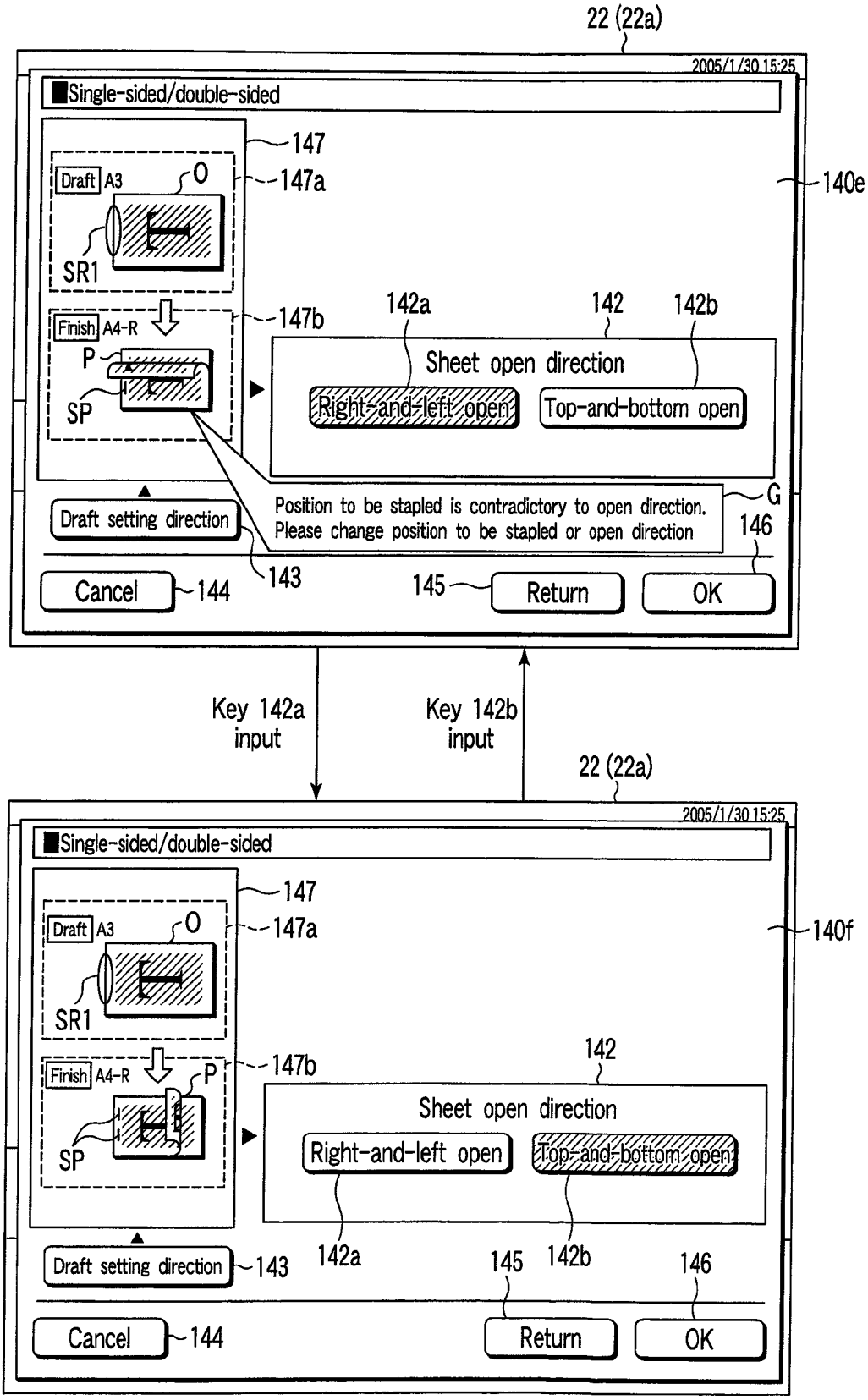
FIG. 22 is a diagram showing a display example of an open direction setting screen.

FIG. 22 is a diagram showing display examples of open direction setting screens 140*e*, 140*f*. FIG. 22 shows the display examples of the open direction setting screen 140*e* in which the guidance display portion G displays a message indicating that user's instructed finish setting is contradictory to set contents of the position to be stapled, and the open direction setting screen 140*f* from which the guidance display portion G has been deleted.

In the open direction setting screen 140*e* shown in FIG. 22, as shown by the finished graphical image P, the finish is set to be double-sided and right-and-left open, and the positions to be stapled are set to two central portions. In the open direction setting screen 140*f* shown in FIG. 22, as shown by the finished graphical image P, the finish is set to be double-sided and top-and-bottom open, and the positions to be stapled are set to two central portions.

That is, in a case where the user indicates a right-and-left open key 142*a* in the open direction setting screen 140 in a state in which the positions to be stapled are set to two central portions, the set contents indicate that the setting (the positions to be stapled are two central portions) of the position to be stapled is contradictory to the finish setting (the finish is double-sided and right-and-left open). Therefore, in the open direction setting screen 140*e*, as shown in FIG. 22, a guidance display portion G displays a message indicating that the position to be stapled is contradictory to the open direction. The guidance display portion G is displayed as a popup screen associated with the finished graphical image P in the open direction setting screen 140*e*. As the message to be displayed in the guidance display portion G, there may be displayed, in the photocopy side setting screen shown in FIG. 22, a guidance to change the open direction to a top-and-bottom direction, for example, in order to urge the change of the open direction.

Moreover, in a case where the user indicates a top-and-bottom open key 142*b* in a state in which the open direction setting screen 140*e* shown in FIG. 22 is displayed, there is eliminated the contradiction between the setting of the position to be stapled and the finish setting. Therefore, in the display section 22, the finish open direction is changed to the top-and-bottom open direction, and the guidance display portion G is deleted as in the open direction setting screen 140*f* shown in FIG. 22.

As described above, when setting such as the finish (sheet) setting is contradictory to the staple setting, in the digital multifunction peripherals 1, the guidance display portion G can display the message indicating that the set contents are contradictory in various setting screens. Accordingly, it can be notified to the user that setting such as the finish (sheet) setting is contradictory to the staple setting.

Next, there will be described a processing example of staple set processing.

Figure 23:
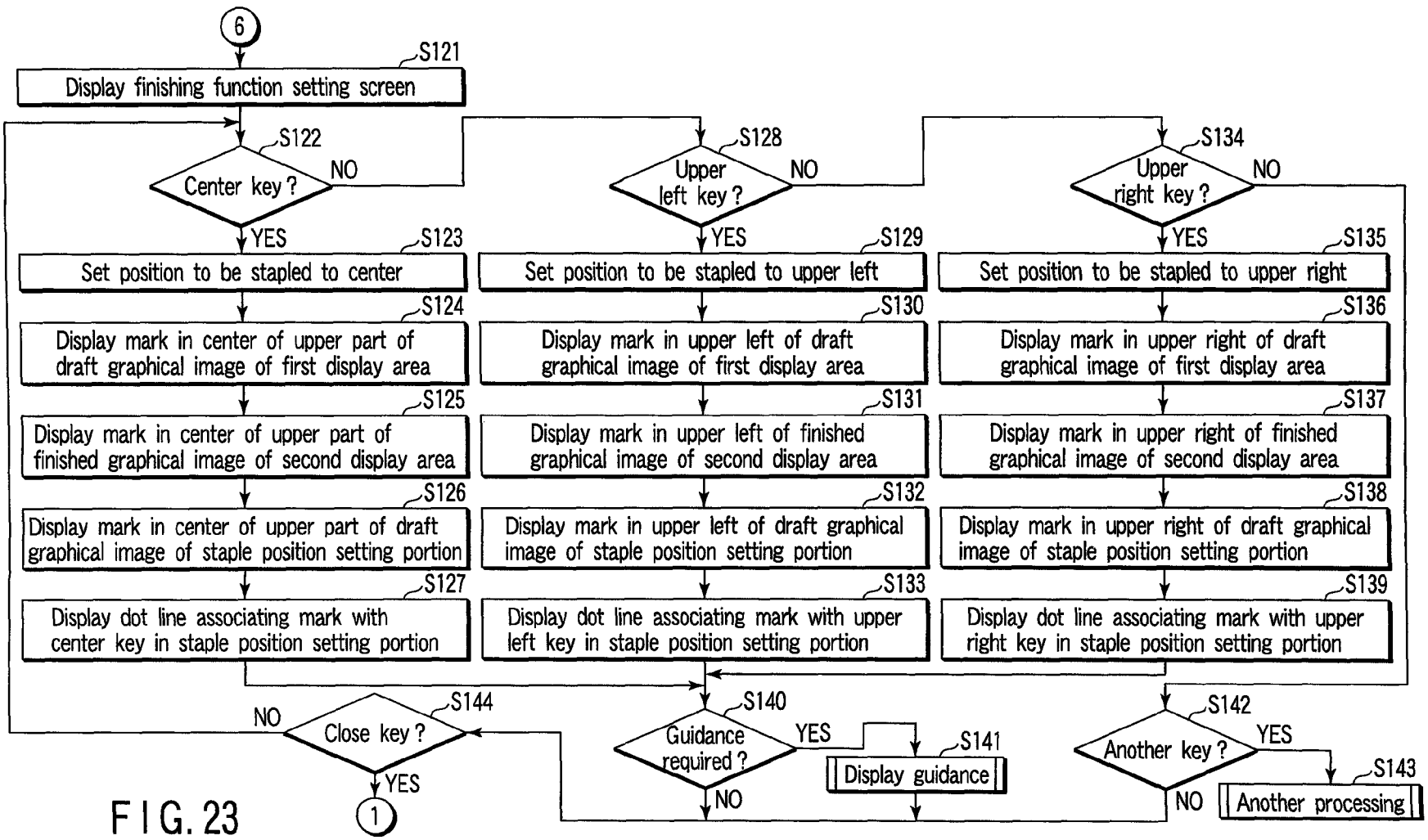
FIG. 23 is a flowchart showing a processing example of staple set processing.

FIG. 23 is a flowchart showing the processing example of the staple set processing.

When the finishing setting key 84 is touched in the basic screen 70, the CPU 51 of the system control unit 11 displays the finishing setting screen 150 in the display section 22 (step S121). For example, when the draft is set to be "A3, horizontal, and single-sided", and the sheet is set to be "A4, horizontal, and single-sided", the display section 22 displays the finishing setting screen 150 (150*a*, 150*b*, 150*c*, or 150*d*) as shown in FIG. 18. The CPU 51 of the system control unit 11 sets stapling in response to an input to each key in a state in which such finishing setting screen 150 is displayed.

For example, when the center key 154*b* is brought into the selected state (the user touches the center key 154*b*), the CPU 51 judges that the center is selected as the position to be stapled (step S122, YES). On judging that the center is selected as the position to be stapled, the CPU 51 sets the position to be stapled to the center (step S123).

On setting the position to be stapled to the center, the CPU 51 superimposes and displays the staple region mark SR1 on the central region of the upper part of the draft graphical image O with respect to the image direction (step S124). In the step S124, the upper central region is indicated as the region corresponding to the position to be stapled by the staple region mark SR1 in the draft graphical image O corresponding to the present draft setting displayed in the first display area 157*a*.

Moreover, the CPU 51 superimposes and displays the staple position mark SP on the center of the upper part of the finished graphical image P with respect to the image direction (step S125). In the step S125, the staple position mark SP indicates that the position to be stapled is the center of the upper part of the sheet with respect to the direction of the graphical image P in accordance with the present sheet setting displayed in the second display area 157*b*.

Furthermore, when the position to be stapled is set to the center, in the staple position setting portion 154, the CPU 51 superimposes and displays the staple region mark SR2 on the upper central region of the draft graphical image 154*e* with respect to the image direction (step S126). Furthermore, the CPU 51 displays the dot line 154*f* which connects the selected center key 154*b* to the staple region mark SR2 superimposed and displayed on the draft graphical image 154*e* in the staple position setting portion 154 (step S127).

The draft graphical image 154*e* displayed in the staple position setting portion 154 is a graphical image showing the set state of the draft on the ADF 31. Therefore, in the step S126, in the staple position setting portion 154, the region (the upper central region with respect to the image direction) corresponding to the position to be stapled in the draft set in the ADF 31 is indicated by the staple region mark SR2 superimposed and displayed on the draft graphical image 154*e*. Alternatively, in the step S127, in the staple position setting portion 154, the dot line 154*f* indicates a correspondence between the staple region mark SR2 indicating the region (the upper central region) corresponding to the staple position in the draft set in the ADF 31 and the selected center key 154*b*.

Moreover, when the upper left key 154*c* is brought into the selected state (the user touches the upper left key 154*c*), the CPU 51 judges that the upper left is selected as the position to be stapled (step S128, YES). On judging that the upper left is selected as the position to be stapled, the CPU 51 sets the position to be stapled to the upper left (step S129).

On setting the position to be stapled to the upper left, the CPU 51 superimposes and displays, in the first display area 157*a*, the staple region mark SR1 on the upper left region of the draft graphical image O with respect to the image direction (step S130). In the step S130, the upper left region is indicated as the region corresponding to the position to be stapled by the staple region mark SR1 in the draft graphical image O corresponding to the present draft setting displayed in the first display area 157*a*.

Moreover, the CPU 51 superimposes and displays the staple position mark SP on the upper left position of the finished graphical image P with respect to the image direction (step S131). In the step S131, the staple position mark SP indicates that the position to be stapled is the upper left of sheet with respect to the image direction in the finished graphical image P in accordance with the present sheet setting displayed in the second display area 157*b*.

Furthermore, when the position to be stapled is set to the upper left, in the staple position setting portion 154, the CPU 51 superimposes and displays the staple region mark SR2 on the upper left region of the draft graphical image 154*e* with respect to the image direction (step S132). Furthermore, the CPU 51 displays the dot line 154*f* which connects the selected upper left key 154*c* to the staple region mark SR2 superimposed and displayed on the draft graphical image 154*e* in the staple position setting portion 154 (step S133).

The draft graphical image 154*e* displayed in the staple position setting portion 154 is a graphical image showing the set state of the draft set in the ADF 31. Therefore, in the step S132, in the staple position setting portion 154, the region (the upper left region with respect to the image direction) corresponding to the staple position in the draft set in the ADF 31 is indicated by the staple region mark SR2 superimposed and displayed on the draft graphical image 154*e*. Alternatively, in the step S133, in the staple position setting portion 154, the dot line 154*f* indicates a correspondence between the staple region mark SR2 indicating the region corresponding to the position to be stapled in the draft set in the ADF 31 and the selected upper left key 154*c*.

Moreover, when the upper right key 154*a* is brought into the selected state (the user touches the upper right key 154*a*), the CPU 51 judges that the upper right is selected as the position to be stapled (step S134, YES). On judging that the upper right is selected as the position to be stapled, the CPU 51 sets the position to be stapled to the upper right (step S135).

On setting the position to be stapled to the upper right, the CPU 51 superimposes and displays, in the first display area 157*a*, the staple region mark SR1 on the upper right region of the draft graphical image O with respect to the image direction (step S136). In the step S136, the upper right region is indicated as the region corresponding to the position to be stapled by the staple region mark SR1 in the draft graphical image O corresponding to the present draft setting displayed in the first display area 157*a*.

Moreover, the CPU 51 superimposes and displays the staple position mark SP on the upper right position of the finished graphical image P with respect to the image direction (step S137). In the step S137, the staple position mark SP indicates that the position to be stapled in the sheet is the upper right of sheet with respect to the image direction in the finished graphical image P in accordance with the present sheet setting displayed in the second display area 157*b*.

Furthermore, when the position to be stapled is set to the upper right, in the staple position setting portion 154, the CPU 51 superimposes and displays the staple region mark SR2 on the upper right region of the draft graphical image 154*e* with respect to the image direction (step S138). Furthermore, the CPU 51 displays the dot line 154*f* which connects the selected upper right key 154*a* to the staple region mark SR2 superimposed and displayed on the draft graphical image 154*e* in the staple position setting portion 154 (step S139).

The draft graphical image 154*e* displayed in the staple position setting portion 154 is a graphical image showing the set state of the draft set in the ADF 31. Therefore, in the step S138, in the staple position setting portion 154, the region (the upper right region with respect to the image direction) corresponding to the staple position in the draft set in the ADF 31 is indicated by the staple region mark SR2 superimposed and displayed on the draft graphical image 154*e*. Alternatively, in the step S139, in the staple position setting portion 154, the dot line 154*f* indicates a correspondence between the staple region mark SR2 indicating the region corresponding to the position to be stapled in the draft set in the ADF 31 and the selected upper right key 154*a*.

Moreover, when the position to be stapled is set, that is, the setting of the position to be stapled is changed (steps S123, S129, and S135), the CPU 51 judges whether or not the guidance is necessary by judging whether or not the setting of the position to be stapled is contradictory to other set contents (step S140). For example, when the position to be stapled is set to the center (two central portions), and the finish (sheet) is double-sided and right-and-left open, the CPU 51 judges that the setting of the position to be stapled is contradictory to that of the finish (sheet).

When it is judged based on the above-described judgment that the setting of the position to be stapled is contradictory to that of the finish (sheet), that is, it is judged that the guidance display portion G needs to be displayed (step S140, YES), the CPU 51 displays the guidance display portion G on the finishing setting screen 150 displayed in the display section 22 as shown in FIG. 20.

Moreover, it is judged based on the above-described judgment that the setting of the position to be stapled is not contradictory to that of the finish (sheet), that is, it is judged that the guidance display portion G does not have to be displayed (step S140, NO), the CPU 51 does not display the guidance display portion G, and performs processing in response to an input into each key. It is to be noted that in a case where the contradiction between the staple position setting and the finish setting is eliminated by the change of the position to be stapled in a state in which the guidance display portion G is displayed (step S140, NO), the CPU 51 deletes the displayed guidance display portion G from the finishing setting screen 150 of the display section 22.

Furthermore, when the user touches a key such as the sort key 151, the stack key 152, or the other key 153 in the finishing setting screen 150 (step S142, NO), the CPU 51 performs various types of processing in response to the input key (step S143). When the user touches the close key 156 (step S144, YES), the CPU 51 closes the finishing setting screen 150. In this case, the CPU 51 completes the finishing setting (staple setting) processing, and displays, in the display section 22, the basic screen 70 in which the set contents of the set finishing function are reflected.

The finishing setting screen 150 displays the draft graphical image O in accordance with the draft setting, the finished graphical image P in accordance with the sheet setting, and the graphical image 154*e* of the draft set in the ADF. When the user designates the position to be stapled in such finishing setting screen 150, the staple region mark SR1 is superimposed and displayed on the region corresponding to the position to be stapled in the draft graphical image O in accordance with the draft setting. The staple position mark SP is superimposed and displayed on a position corresponding to the position to be stapled in the finished graphical image in accordance with the sheet setting, and the staple region mark SR1 is superimposed and displayed on the region corresponding to the position to be stapled in the graphical image of the draft set in the ADF.

Accordingly, the user can check the position to be stapled in three portions: the draft graphical image; the finished graphical image; and the graphical image of the draft set in the ADF. As a result, there can be provided a user interface capable of precisely and easily checking the setting of the position to be stapled.

Various settings described above can be performed in an arbitrary order. The contents set by the various settings are reflected in the draft graphical image O and the sheet graphical image P displayed in various types of setting screens displayed in the display section 22 every time the contents are set. Accordingly, the user can perform various settings while referring to the present set contents.

Moreover, after performing the staple setting (i.e., setting the position to be stapled), in various types of setting screens displayed in the display section 22, constantly the staple region mark indicating the region corresponding to the position to be stapled is superimposed and displayed on the draft graphical image O, and the staple position mark indicating the position to be stapled is superimposed and displayed on the sheet graphical image P.

For example, when the setting is performed in order of the sheet setting, the staple setting, the draft setting, the photocopy side setting, and the open direction setting, in the draft setting screen, the photocopy side setting screen, and the open direction setting screen, constantly the staple region mark indicating the region corresponding to the position to be stapled is superimposed and displayed on the draft graphical image O, and the staple position mark indicating the position to be stapled is superimposed and displayed on the sheet graphical image P. Accordingly, the user can perform various settings while checking the position to be stapled.

Moreover, when the contradiction is generated between the setting of the position to be stapled and the setting of the finish (sheet), the display section 22 displays the guidance indicating that the setting of the position to be stapled is contradictory to that of the finish (sheet) as the popup screen on the setting screen being displayed.

It is to be noted that even during set processing such as the photocopy side setting or the open direction setting, every time the set contents are changed in response to user's instruction, the CPU 51 judges whether or not the setting of the position to be stapled is contradictory to that of the finish (sheet). When this results in judgment that the setting of the position to be stapled is contradictory to that of the finish (sheet), the CPU 51 displays, in the setting screen being displayed, the guidance indicating that the set contents of the position to be stapled are contradictory to those of the finish (sheet) as the popup screen on the setting screen being displayed. Accordingly, the user can easily perform the setting so that the set contents of the position to be stapled are not contradictory to other set contents.

Next, there will be described one example of photocopy setting including the staple setting.

Here, a flow of setting will be described in a case where an image on an "A3, horizontal, portrait, and single-sided" draft set in the ADF is printed on an "A4, horizontal, portrait, double-sided, and right-and-left open" sheet, and the upper left portions of the sheets are stapled together.

First, in a standby state, the display section 22 displays the basic screen 70*a* shown in FIG. 4. When the user sets the "A3" draft in the ADF 31 in this state, the CPU 51 of the system control unit 11 judges by the ADF draft size detecting function that the draft size is "A3, horizontal" based on the signals from the detectors 31*a*, 31*b* disposed in the ADF 31.

When it is judged that the draft size is "A3, horizontal", the CPU 51 displays the draft graphical image O indicating that the draft is "A3, horizontal, and single-sided (default setting)" in the first display area 72*a* of the basic screen 70. In this case, when the sheet size setting is the "automatic sheet", the CPU 51 displays, in the second display area 72*b*, the finished graphical image P indicating that the sheet is "A3, horizontal, and single-sided (default setting)". Here, as the default setting of the photocopy side, it is assumed that the surface of the draft to be read is single-sided and that the sheet to be photocopied is single-sided.

Further after setting the "A3" draft in the ADF 31, the user performs an operation to set the sheet size to A4-R (A4 horizontal) by use of the operation panel 12. That is, when the user touches the sheet key 82 or the magnification key 81 in the basic screen 70, the CPU 51 displays the sheet setting screen 100 shown in FIG. 7 (or the sheet setting screen 100' shown in FIG. 8). When the sheet setting screen 100 is displayed, the user selects a desired sheet size, and touches the A4-R (A4 horizontal) key 103*d*. The CPU 51 then brings the A4-R (A4 horizontal) key 103*d* into the selected state to change (set) the sheet size to "A4-R (A4, horizontal)". When the user touches the close key 104 in this state, the CPU 51 displays, in the display section 22, the basic screen 70 including the second display area 72*b* displaying the finished graphical image P which indicates that the sheet setting is "A4-R, horizontal, and single-sided (default setting)".

After performing the sheet setting, the user further performs an operation to set the direction of the image in the draft to that of the portrait. That is, when the user touches the draft setting key 87 in the basic screen 70, the CPU 51 displays the draft direction setting screen 110 in the display section 22. Here, the ADF draft size detecting function judges that the draft is "A3, horizontal". Therefore, the draft direction setting screen 110*d* shown in FIG. 11 is displayed as the draft direction setting screen 110 in the display section 22.

When the draft direction setting screen 110*d* is displayed, the user touches the horizontally disposed portrait key 112*c* to set the desired direction of the image in the draft. The CPU 51 then brings the horizontally disposed portrait key 112*c* into the selected state to set the direction of the image in the draft to that of the "portrait". Here, it is assumed that the direction of the image in the draft is reflected in the sheet setting. Therefore, by the operation up to this stage, the draft is set to be "A3, horizontal, portrait, and single-sided", and the sheet is set to be "A4, horizontal, portrait, and single-sided".

In this state, in the basic screen 70, the first display area 72*a* displays the draft graphical image O indicating the "A3, horizontal, portrait, and single-sided" draft, and the second display area 72*b* displays the finished graphical image P indicating the "A4, horizontal, portrait, and single-sided" sheet.

In such display state, the user further performs an operation to set the position to be stapled to the upper left position. That is, when the user touches the finishing setting key 84 in the basic screen 70, the CPU 51 displays, in the display section 22, the finishing setting screen 150*a* shown in FIG. 18.

When the finishing setting screen 150*a* is displayed, the user touches the upper left key 154*c* of the staple position setting portion 154 in order to set the position to be stapled to the upper left position. When the user touches the upper left key 154*c*, the CPU 51 sets the position to be stapled to the upper left position, and displays, in the display section 22, the finishing setting screen 150*c* shown in FIG. 18.

It is to be noted that in the finishing setting screen 150 in a state in which the position to be stapled is set to the upper left position, as described above, the staple region mark SR1 is superimposed and displayed on the region corresponding to the position to be stapled of the draft graphical image O corresponding to the draft setting. Moreover, the staple position mark SP is superimposed and displayed on the position corresponding to the position to be stapled in the finished graphical image corresponding to the sheet setting, and the staple region mark SR2 is superimposed and displayed on the region corresponding to the position to be stapled in the graphical image of the draft set in the ADF.

Figure 24:
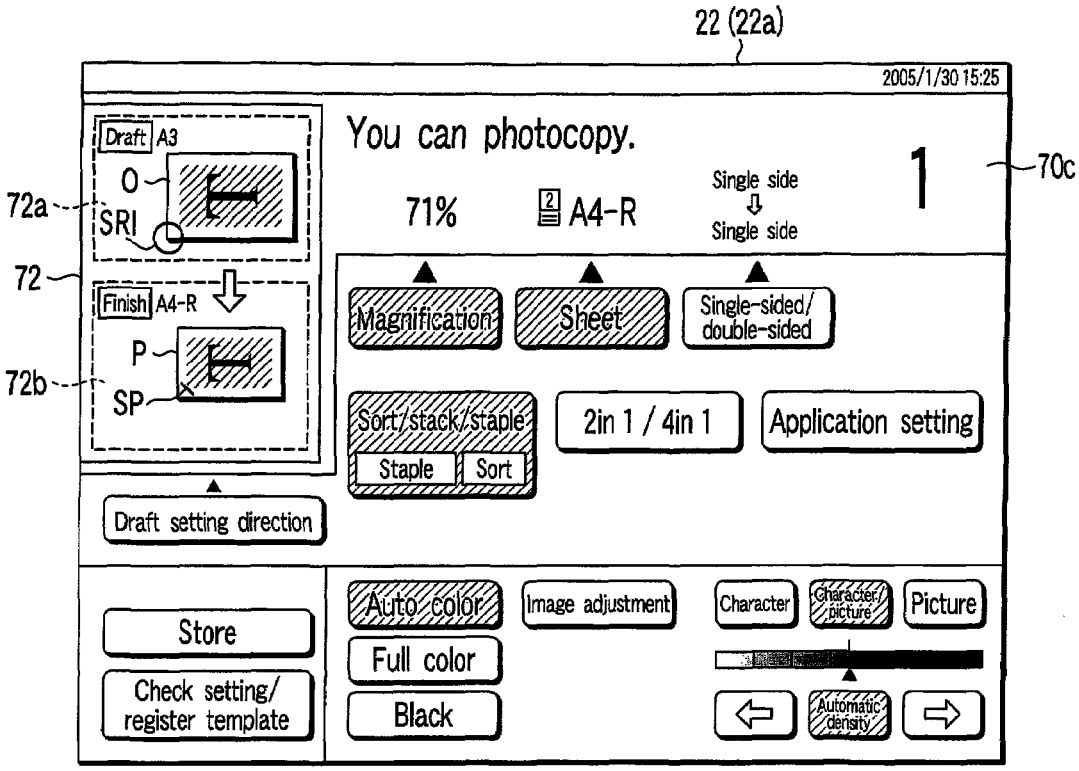
FIG. 24 is a diagram showing a display example of a basic screen in a state in which a position to be stapled is set to an upper left position.

In a case where the user touches the close key 156 in a state in which the position to be stapled is set to the upper left position in this manner, the CPU 51 displays the basic screen 70*c* in which the setting of the position to be stapled is reflected as shown in FIG. 24. FIG. 24 shows a display example of a basic screen 70*c* in a state in which the position to be stapled is set to the upper left position. In the basic screen 70*c* shown in FIG. 24, the first display area 72*a* and the second display area 72*b* display areas which are equivalent to the first display area 157*a* and the second display area 157*b* of the display area 157 in the finishing setting screen 150*d* shown in FIG. 18.

That is, in the first display area 72*a* of the basic screen 70*c* in a state in which the position to be stapled is set to the upper left position, there is displayed the draft graphical image O indicating the "A3, horizontal, portrait, and single-sided" draft. In addition, the staple region mark SR1 is superimposed and displayed on the region corresponding to the position to be stapled in the draft graphical image O. In the second display area 72*b* of the basic screen 70*d* in a state in which the position to be stapled is set to the upper left position, the finished graphical image P is displayed which indicates the "A4, horizontal, portrait, and single-sided" sheet. In addition, the staple position mark SP is superimposed and displayed on the position corresponding to the position to be stapled in the finished graphical image P.

Moreover, in the basic screen 70*c*, the finishing setting key 84 is brought into the selected state. Furthermore, the selected finishing setting key 84 is changed to an icon in which "staple" and "sort" are displayed. Accordingly, when seeing the finishing setting key 84 brought into the selected state in the basic screen 70*d*, the user can recognize that stapling and sorting functions are set.

In a state in which the position to be stapled is set in this manner, the user performs an operation to set the surface of the sheet to be printed to right-and-left open double sides. That is, when the user touches the single-sided/double-sided key 83 in the basic screen 70*c*, the CPU 51 displays the photocopy side setting screen 130 in the display section 22. In this case, in the photocopy side setting screen 130, the first display area 136*a* displays the draft graphical image O including the staple region mark SR1 which indicates the region corresponding to the position to be stapled. Moreover, the second display area 136*b* displays the finished graphical image P including the staple position mark SP which indicates the position corresponding to the position to be stapled.

Figure 25:
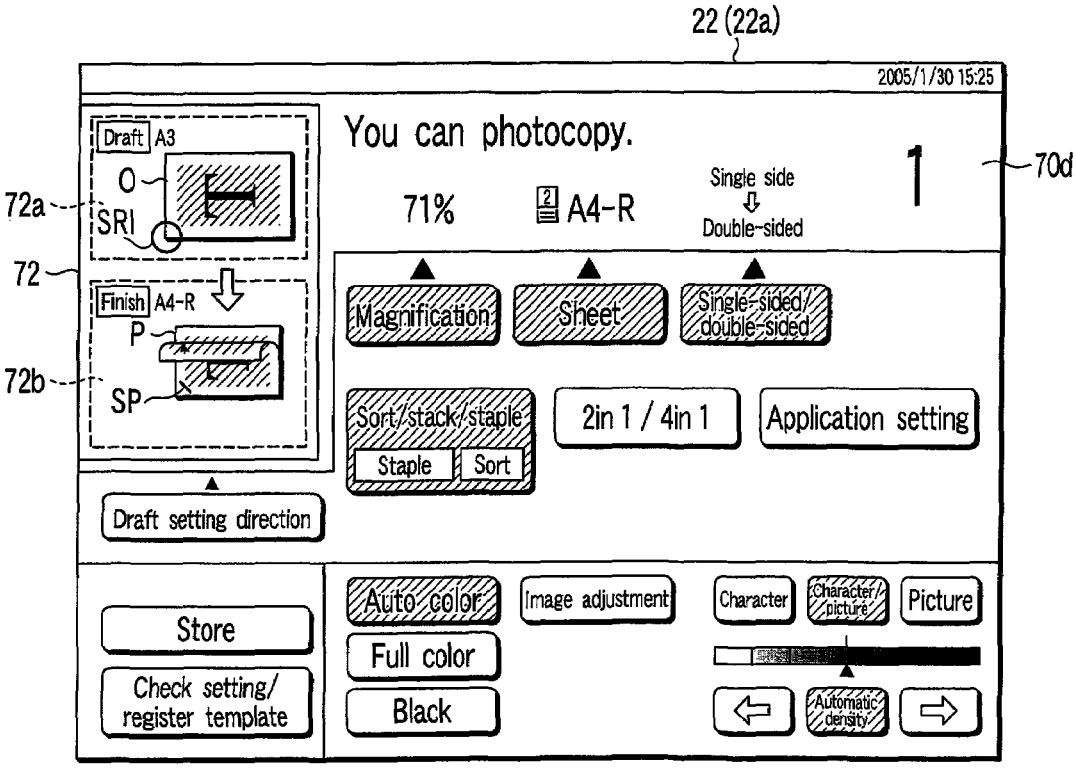
FIG. 25 is a diagram showing a display example of a photocopy side setting screen in a case where the photocopy side is set in a state in which the position to be stapled is set to the upper left position.

FIG. 25 is a diagram showing a display example of a photocopy side setting screen 130 (130*a*, 130*b*, 130*c*, and 130*d*) in a case where the photocopy side is set in a state in which the position to be stapled is set to the upper left position.

Every time the surface of the draft to be read is changed in the photocopy side setting screen 130, the draft graphical image O is changed on which the staple region mark SR1 is superimposed and displayed: with the proviso that a relative position (i.e., the upper left position with respect to the draft) of the displayed staple region mark SR1 is not changed in the draft graphical image O. For example, as shown in FIG. 25, when the surface of the draft to be read is changed to double sides, the draft graphical image O is changed to a double-sided graphical image as shown in the photocopy side setting screen 130. It is to be noted that here the open direction of the double-sided sheet is set to the right-and-left open direction as the default setting.

Similarly, every time the surface of the sheet to be printed is changed in the photocopy side setting screen 130, the finished graphical image P is changed on which the staple position mark SP is superimposed and displayed: with the proviso that a relative position (i.e., the upper left position with respect to the sheet) of the displayed staple position mark SP is not changed in the finished graphical image P. For example, as shown in FIG. 25, when the surface of the sheet to be printed is changed to be double-sided, the finished graphical image P is changed to a double-sided graphical image as shown in the photocopy side setting screen 130.

In such photocopy side setting screen 130, the user touches the single-sided to double-sided key 131*b* to set the draft to be single-sided and set the sheet to be double-sided. When the user touches the single-sided to double-sided key 131*b*, the CPU 51 sets the draft to be single-sided, and sets the sheet to be double-sided. Moreover, the photocopy side setting screen 1301 shown in FIG. 25 is displayed in the display section 22.

In a state in which the photocopy side setting screen 1301 is displayed, the user further touches the open direction setting key 135 in order to set the draft open direction to the right-and-left open direction. It is to be noted that in the photocopy side setting screen 1301 shown in FIG. 25, the sheet open direction is set to the right-and-left open direction as the default setting. Therefore, there may be omitted the operation to set the open direction in the open direction setting screen.

When the user touches the open direction setting key 135, the CPU 51 displays the open direction setting screen 140 in the display section 22. In this case, in the open direction setting screen 140, the first display area 147*a* displays the draft graphical image O including the staple region mark SR1 which indicates the region corresponding to the position to be stapled. Furthermore, the second display area 147*b* displays the finished graphical image P including the staple position mark SP indicating the position corresponding to the position to be stapled.

Figure 26:
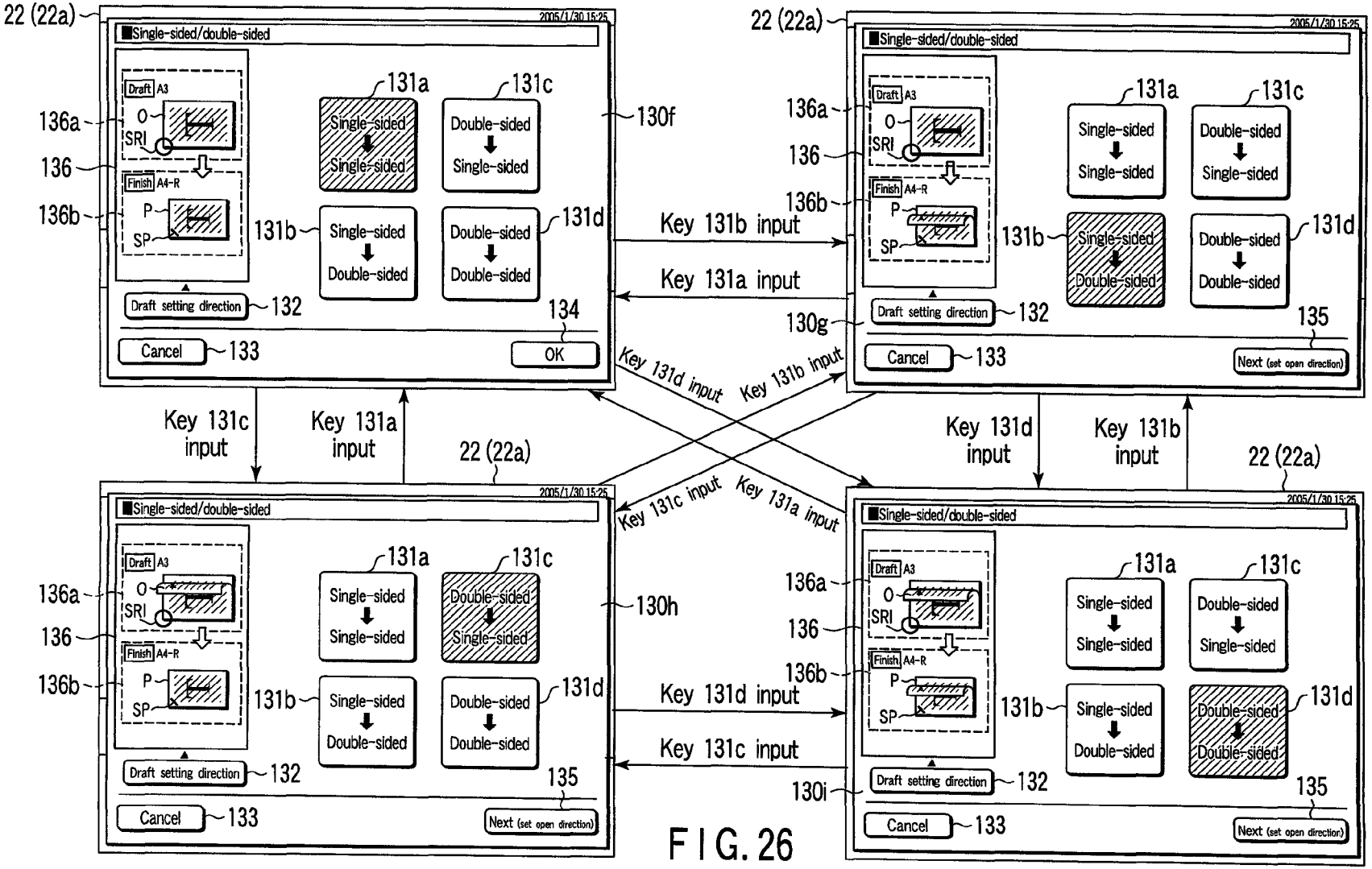
FIG. 26 is a diagram showing a display example of an open direction setting screen in a case where the open direction of a sheet is set in a state in which the position to be stapled is set to the upper left position.

FIG. 26 is a diagram showing a display example of an open direction setting screen 140 (140*g*, 140*h*) in a case where the open direction of the sheet is set in a state in which the position to be stapled is set to the upper left position.

In the open direction setting screen 140, every time the sheet open direction is changed, the finished graphical image P is changed on which the staple position mark SP is superimposed and displayed: with the proviso that a relative position (i.e., the upper left position with respect to the draft) of the displayed staple position mark SP is not changed in the finished graphical image P. For example, as shown in FIG. 26, when the sheet open direction is changed to the top-and-bottom open direction, the finished graphical image P is changed to a top-and-bottom open and double-sided graphical image as shown in the open direction setting screen 140. Alternatively, as shown in FIG. 26, when the sheet open direction is set to the right-and-left open direction, the finished graphical image P is changed to a right-and-left open and double-sided graphical image as shown in the open direction setting screen 140*g*.

Figure 27:
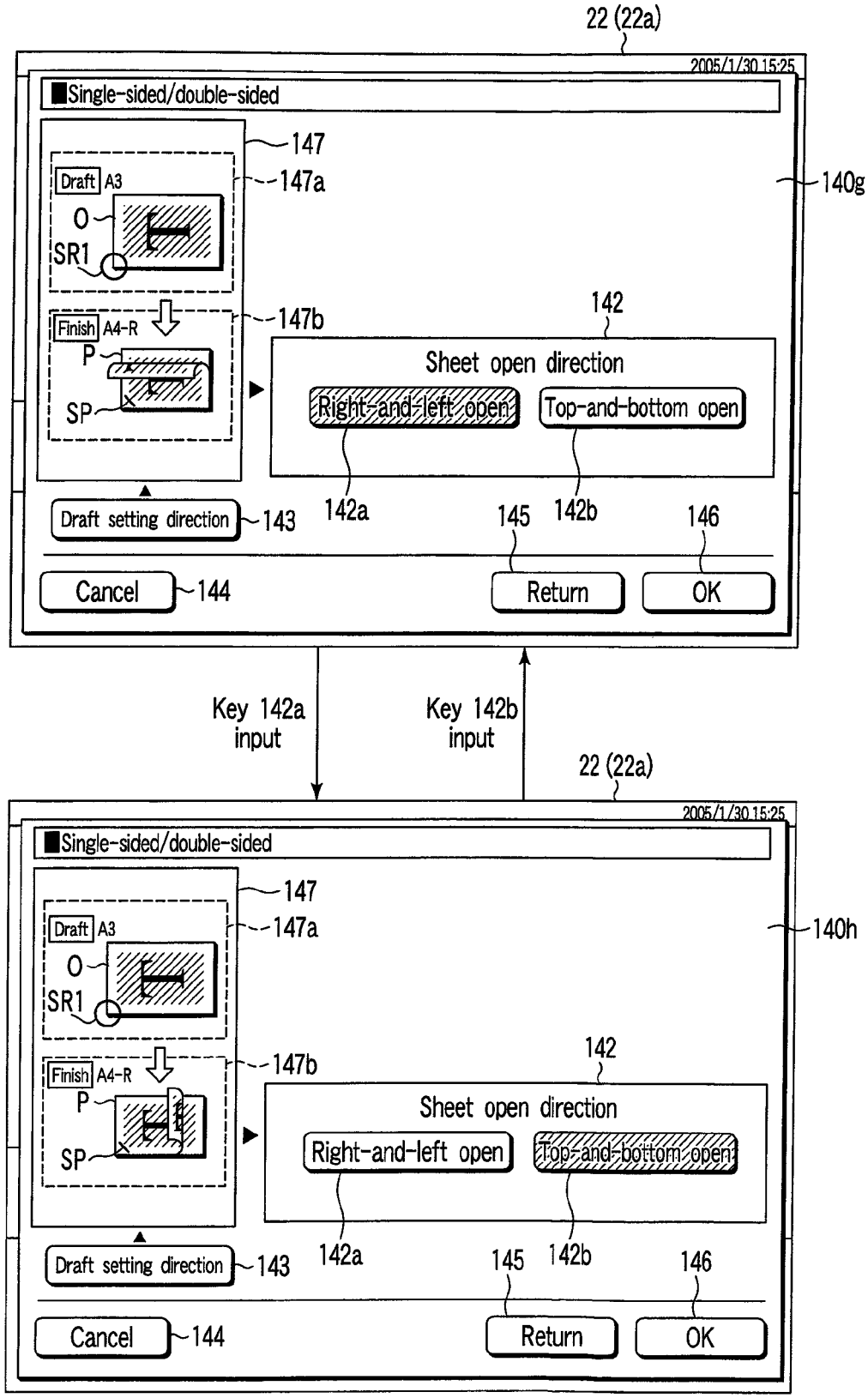
FIG. 27 is a diagram showing a display example of the basic screen in a state in which the position to be stapled is set to the upper left position.

After the above-described settings are completed, the display section 22 displays the basic screen 70*d* as shown in FIG. 27. In the basic screen 70*d* shown in FIG. 27, the first display area 72*a* and the second display area 72*b* display areas which are equivalent to the first display area 136*a* and the second display area 136*b* of the display area 136 in the photocopy side setting screen 130*i* shown in FIG. 25 (or the first display area 147*a* and the second display area 147*b* of the display area 147 in the open direction setting screen 140*g* shown in FIG. 26).

That is, in the first display area 72*a* of the basic screen 70*d* set as described above, there is displayed the draft graphical image O indicating the "A3, horizontal, portrait, and single-sided" draft. In addition, the staple region mark SR1 is superimposed and displayed on the region corresponding to the position to be stapled in the draft graphical image O. In the second display area 72*b* of the basic screen 70*d*, the finished graphical image P is displayed which indicates "A4, horizontal, portrait, double-sided, right-and-left open, and upper left position to be stapled". In addition, the staple position mark SP is superimposed and displayed on the position corresponding to the position to be stapled in the finished graphical image P.

In a case where a start key is input in a state in which such basic screen 70*d* is displayed, the CPU 51 executes the photocopy processing based on the set contents. In a state in which the basic screen 70*c* is displayed, a setting check screen may be displayed in the display section 22 in order to check the setting. In a case where the user touches a setting check key in a state in which the basic screen 70*d* is displayed, the CPU 51 displays a setting check screen 160.

Figure 28:
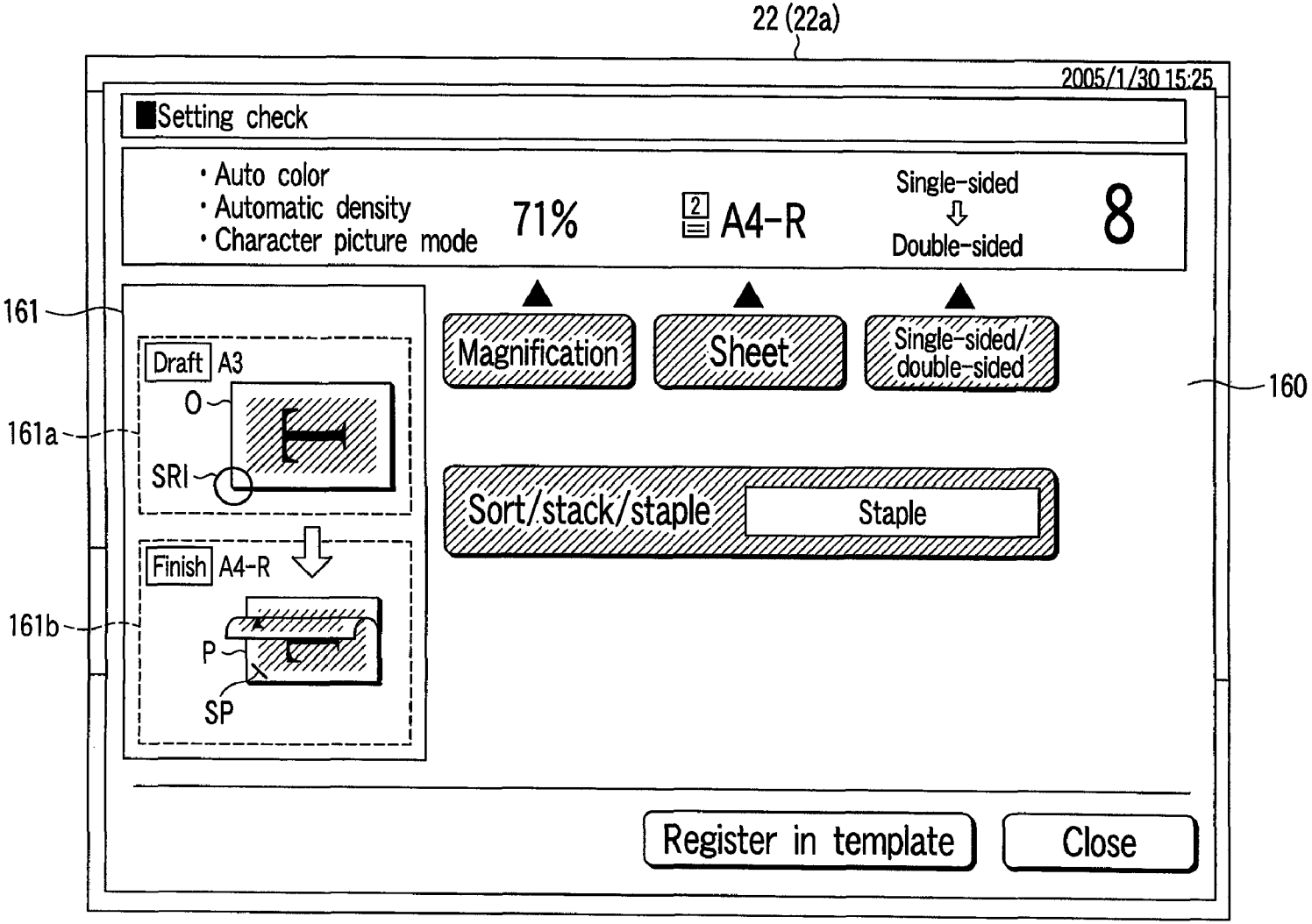
FIG. 28 is a diagram showing a display example of a setting check screen.

FIG. 28 is a diagram showing a display example of the setting check screen 160. As shown in FIG. 28, the setting check screen 160 is constituted of a layout which is substantially equivalent to that of the basic screen 70*d*. In such setting check screen 160, a first display area 161*a* and a second display area 161*b* display contents similar to those of the display area 72 having the first display area 72*a* and the second display area 72*b* in the basic screen 70*c*. That is, even in the setting check screen 160, in the same manner as in the other setting screens, the draft graphical image O is displayed in the first display area 161*a* in accordance with the set draft setting, and the finished graphical image P is displayed in the second display area 161*b* in accordance with the set sheet setting.

Furthermore, in a case where the position to be stapled is set, the staple region mark SR1 indicating the region corresponding to the position to be stapled in the draft is superimposed and displayed on the draft graphical image O, and the staple position mark SP indicating the position corresponding to the position to be stapled in the sheet is superimposed and displayed on the finished graphical image P. In consequence, the user can securely confirm various set contents including the position to be stapled.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A method of displaying on a display unit of an image forming apparatus settings of the image forming apparatus, comprising:

displaying on the display unit an image of an auto document feeder, a graphical image of an original sheet as positioned on the auto document feeder, a finished graphical image, and a plurality of staple settings;

receiving a selection of a selected staple setting from the plurality of staple settings;

updating the display of the graphical image to show a staple region mark on a portion of the graphical image of the original sheet and to show a staple location mark on a portion of the finished graphical image in accordance with the selected staple setting.

2. The method according to claim 1, wherein the display unit comprises a touch panel and the selection is made by touching a graphic displayed on the touch panel.

3. The method according to claim 2, wherein the touch panel displays a plurality of graphics associated respectively with the plurality of staple settings.

4. The method according to claim 1, wherein the staple location mark is substantially circular.

5. The method according to claim 1, wherein the staple location mark is elliptical.

6. The method according to claim 1, wherein a selection of a first staple setting updates the display to show a staple location mark on a first portion of the graphical image and a selection of a second staple setting updates the display to show a staple location mark on a second portion of the graphical image.

7. The method according to claim 6, wherein at least one of the first and second portions of the graphical image is a corner portion of the graphical image.

8. The method according to claim 6, wherein at least one of the first and second portions of the graphical image is not a corner portion of the graphical image.

9. An image forming apparatus comprising:

a scanner that reads an image of an original;

a printer that prints the image of the original on a sheet;

a staple unit that staples sheets having printed images when the staple setting is selected;

a display unit; and a display controller that displays on the display unit an image of an auto document feeder, a graphical image of an original sheet as positioned on the auto document feeder, a finished graphical image, and a plurality of staple settings, and updates the display of the graphical image to show a staple region mark on a portion of the graphical image of the original sheet and to show a staple location mark on the finished graphical image in accordance with a selection of a staple setting from the plurality of staple settings.

10. The image forming apparatus according to claim 9, wherein the display unit comprises a touch panel, and the staple settings are displayed on the touch panel and selected using the touch panel.

11. The image forming apparatus according to claim 10, wherein the touch panel displays a plurality of graphics associated respectively with the plurality of staple settings.

12. The image forming apparatus according to claim 9, wherein the staple location mark is substantially circular.

13. The image forming apparatus according to claim 9, wherein the staple location mark is elliptical.

14. The image forming apparatus according to claim 9, wherein a selection of a first staple setting updates the display to show a staple location mark on a first portion of the graphical image and a selection of a second staple setting updates the display to show a staple location mark on a second portion of the graphical image.

15. The image forming apparatus according to claim 14, wherein at least one of the first and second portions of the graphical image is a corner portion of the graphical image.

16. The image forming apparatus according to claim 14, wherein at least one of the first and second portions of the graphical image is not a corner portion of the graphical image.

17. A method of displaying on a display unit of an image forming apparatus settings of the image forming apparatus, comprising:

displaying on the display unit an image of an auto document feeder, a graphical image of an original sheet as positioned on the auto document feeder, a finished graphical image, and a plurality of staple settings;

receiving a selection of one of the staple settings;

updating the display to show a substantially circular or elliptical staple region mark on a different portion of the graphical image of the original sheet and to show a staple location mark on the finished graphical image in accordance with a change in the selection of the staple setting.

18. The method according to claim 17, wherein the display unit displays the original sheet next to the auto document feeder in an insertion ready position.

19. The method according to claim 17, wherein the display unit comprises a touch panel and the selection is made by touching a graphic displayed on the touch panel.

20. The method according to claim 19, wherein the touch panel displays a first graphic associated with a top left staple setting and a second graphic associated with a top right staple setting.

* * * * *